United States Patent [19]

Noda

[11] Patent Number: 5,070,362

[45] Date of Patent: Dec. 3, 1991

[54] IMAGE FORMING APPARATUS HAVING A PLURALITY OF SELECTIVELY OPERABLE DEVELOPERS

[75] Inventor: Takashi Noda, Osaka, Japan

[73] Assignee: Minolta Camera Kabushiki Kaisha, Osaka, Japan

[21] Appl. No.: 482,800

[22] Filed: Feb. 21, 1990

[30] Foreign Application Priority Data

Feb. 21, 1989 [JP] Japan ..... 1-41382
Feb. 21, 1989 [JP] Japan ..... 1-41383
Feb. 21, 1989 [JP] Japan ..... 1-41384

[51] Int. Cl.[5] ..... G03G 15/06

[52] U.S. Cl. ..... 355/206; 355/245; 355/326

[58] Field of Search ..... 355/326, 322, 245, 246, 355/260, 205, 206, 207

[56] References Cited

U.S. PATENT DOCUMENTS 4,579,443 4/1986 Abuyama et al. .
4,620,783 11/1986 Tanaka et al. .
4,841,329 6/1989 Kasamura et al. ..... 118/645
4,841,336 6/1989 Kusumoto et al. ..... 355/245
4,841,337 6/1989 Hiratsuka ..... 355/326 X
4,878,091 10/1989 Morita et al. ..... 355/245 X
4,891,672 1/1990 Takagi ..... 355/245
4,941,018 7/1990 Kasamura et al. ..... 355/245
4,954,844 9/1990 Morita et al. ..... 355/326 X
4,958,191 9/1990 Yamada et al. ..... 355/245
4,963,927 10/1990 Ishihara ..... 355/207

FOREIGN PATENT DOCUMENTS 1515654 7/1986 Japan .

*Primary Examiner*—R. L. Moses
*Attorney, Agent, or Firm*—Burns, Doane, Swecker & Mathis

[57] ABSTRACT

A control member of image forming unit controls a driving motor so as to move a unit of combined developing devices in accordance with a developing mode or a specific operational condition which is set when the unit is moved to a toner supply position due to a shortage of toner. The control member functions so as to reserve the power cut off caused by malfunction until the unit is stopped at a predetermined position if it is still in the transit to the predetermined position.

56 Claims, 52 Drawing Sheets

(L=V+t)

IMAGE FORMING APPARATUS HAVING A PLURALITY OF SELECTIVELY OPERABLE DEVELOPERS

BACKGROUND OF THE INVENTION

1. Technical Field of the Invention

The present invention relates to an electrophotographic image forming apparatus, and more particularly, to an electrophotographic image forming apparatus wherein a developing unit which is provided with a plurality of developing means is capable of performing relative movement to a photoconductor by which each one of the developing means is selectively positioned at a predetermined developing position opposite to the photoconductor.

2. Description of Related Art

As an image forming apparatus of this kind, copying machines and laser printers have heretofore been offered that are provided with four developing devices which contain toner of three primary colors of cyan, magenta and yellow, and black for composing each color image by successively performing developing operation on each color to form a color image. The apparatus is also arranged to be able to perform a monocolor image forming operation under a monocolor mode by using only one optional color or a composite monocolor image forming operation under a composite monocolor mode by composing images with a combination of two colors.

There are two methods for arranging positional relation between each one of the developing devices and the photoconductor in the image forming apparatus, that is, (i) all developing devices are disposed always at a predetermined developing position (the position opposite to the surface of photoconductor) as the one disclosed in U.S. Pat. No. 4,579,443, (ii) only a developing device which performs developing operation is positioned at a developing position and other devices are retracted.

The latter method (ii) includes the following two methods; (a) Rotary Method: Developing sleeves of four developing devices are disposed at regular intervals on the circumferential surface of an imaginary cylinder and by rotating a holding member of the developing device around the central axis of the cylinder as the axis of rotation, one of the developing devices selected is only positioned at the developing position as disclosed in Japanese Patent Application TOKKAI SHO61-151564 and U.S. Pat. No. 4,620,783, and (b) Method for moving up and down: Four developing devices are disposed up and down at regular intervals to compose of an unit, and by moving the unit in the upward-and-downward direction, only one developing device is positioned at the developing position as disclosed in U.S. Pat. No. 4,620,783. As transformed methods of the upward-and-downward moving method as described in (ii) (b) above, it may be considered to arrange the movement in the different directions such as the one which is arranged to move around the photoconductor in reciprocating motion.

However, in the case of the apparatus which is arranged to relatively move the unit with respect to the photoconductor for selective use of the plural developing devices as described in the method of (ii) above, toner replenishment for each one of the developing devices is conducted from the position out of the operating range of the unit for operational convenience' sake. In this case, it is necessary to move the unit to the position where toner can be replenished when toner is replenished to a developing device.

For instance, the image forming apparatuses disclosed in U.S. Pat. Nos. 4,841,329 and 4,620,783 are provided with a detecting means in each developing device for detecting residual toner in order to detect a shortage of toner, and whenever a developing device is detected short of toner, the developing device is always moved to a toner replenishing position. It may also be considered to arrange the toner replenishing operation to be performed when predetermined conditions such as turning on of the main switch of the image forming apparatus, completion of image forming operation and the like are satisfied other than the time when toner shortage is detected.

However, in a copying machine which is provided with four color developing devices of cyan, magenta, yellow and black, copying operation is not necessarily be conducted under a color mode using four colors as described above. For instance, under the monocolor mode, only one selected colored toner is used. Under the composite monocolor mode, only two selected colors (red: magenta, yellow, blue: cyan, magenta, green: yellow, cyan) out of cyan, magenta and yellow are used.

Accordingly, in the control to return the developing unit to the uppermost position when a predetermined condition is satisfied, there arises a problem how to determine predetermined conditions. For instance, for users who frequently conduct copying operation using black toner only, it is a waste of time and energy if the developing unit is controlled to be returned whenever colored toner empty is detected. For users who frequently conduct copying operation using four full colors, there arises a problem that the reproduction of color tone becomes worse unless the developing unit is immediately returned for toner replenishment whenever any one of the colors is detected as empty state. For users who want to conduct copying operation as quickly as possible even if the density of reproduced image is somewhat light, it is preferable not to have the returning operation at all. The conditions to be fixed preliminarily thus differs according to the purposes of use by users. Under the circumstances, an image forming apparatus which can comply with these requirement is eagerly required for.

On the other hand, in the method of (ii) (b) above, it may be considered to arrange the uppermost position of a unit as a toner replenishing position to readily replenish toner from above. And, by arranging the position as a developing position of black developing device which is frequently used and setting the position as a home position, it will become advantageous in changing over developing devices of the unit and the movement of each developing device for toner replenishing operation is rationalized.

In this kind of image forming apparatus, however, the developing device can not be fixedly positioned at the developing position when image forming operation is started and completed since it depends on a developing mode set. For instance, in the case of color mode, developing operation is carried out in a predetermined order of cyan, magenta, yellow and black. Accordingly, the cyan developing device has to be positioned at the developing position when image forming operation is started. Consequently, when the image forming operation is finished, the black developing device is supposed to be positioned at the developing position. In the case of monocolor mode, a specified developing device has to be positioned at the developing position when image forming operation is started, and said developing unit is positioned again at the developing position when the image forming operation is finished. In the case of composite monocolor mode, developing device can not be fixedly positioned when image forming operation is started and finished since it depends on the color specified. Accordingly, in such an image forming apparatus, it is a waste of time and energy to forcibly return the developing unit to a standard position when image forming operation is started and finished. It is, therefore, desired to avoid such an inconvenient returning operation.

Further, in the case of the method of (ii) and its transformed method, the developing unit is provided with large inertia by its own weight, and the state is stabilized since any one of the developing devices is arranged to be positioned at a predetermined developing position when they are not being moved. Accordingly, even if the main power source is turned off by jamming trouble and the like for the sake of safety, any inconvenience is not occurred caused by the developing unit.

However, the following inconveniences might occur if the main electric source is turned off during the movement of the developing unit.

(i) Generally, braking force is given to a moving developing unit from a certain time point for smoothly positioning the unit at the developing position. If the electric source is turned off before such braking force is given, the developing unit is excessively moved by the inertia, and consequently, it may damage the developing unit or peripheral members of the unit.

(ii) Generally, the position of the developing unit is detected discontinuously. In other words, the position of the developing unit can be detected only when any one of the developing device is positioned at the predetermined developing position. Accordingly, if a developing device is stopped when the device is not positioned at the predetermined developing position, the position of the developing unit can not be detected after the machine is reset when trouble, such as a paper jam occurs, and the movement of the developing unit can not be controlled, thereby prohibiting image forming operation.

(iii) If a developing unit which is not positioned at a predetermined position is manually moved in order to remove a jammed sheet of paper, there arises a possibility for damage the developing unit or peripheral members of the unit.

SUMMARY OF THE INVENTION

A primary object of the present invention is to provide an image forming apparatus which is capable of accomplishing operation of a developing unit corresponding to a mode set without causing any trouble or other wasteful action.

Another object of the present invention is to provide an image forming apparatus which is capable of accomplishing operation of the developing unit corresponding to a mode set without causing any trouble or other wasteful action with movement control to a toner replenishing position which takes precedence over specific conditions that are set.

A further object of the present invention is to provide an image forming apparatus which is capable of setting various conditions of the unit and accomplishing necessary operation of the developing unit corresponding to various requirements of users without causing any trouble and wasteful action.

A still another object of the present invention is to provide an image forming apparatus which is capable of moving the developing unit to a toner replenishing position at a predetermined timing when a developing device which is positioned at the developing position in response to a developing signal is detected short of toner, and thereby accomplishing operation of the developing unit with a simple operational control.

A still further object of the present invention is to provide an image forming apparatus which is capable of avoiding malfunctions which might occur when the main electric source of the image forming apparatus is turned off when the developing unit is not positioned due to jamming trouble and the like during the movement of the developing unit.

These and other objects and features of the present invention will become more apparent from the following description taken in conjunction with the accompanying drawings which illustrate specific embodiments of the invention.

DESCRIPTION OF THE PREFERRED EMBODIMENT

Embodiments of the present invention will now be described below referring to the accompanying drawings.

EXPLANATION ON THE STRUCTURE OF A COPYING MACHINE

Figure 1:
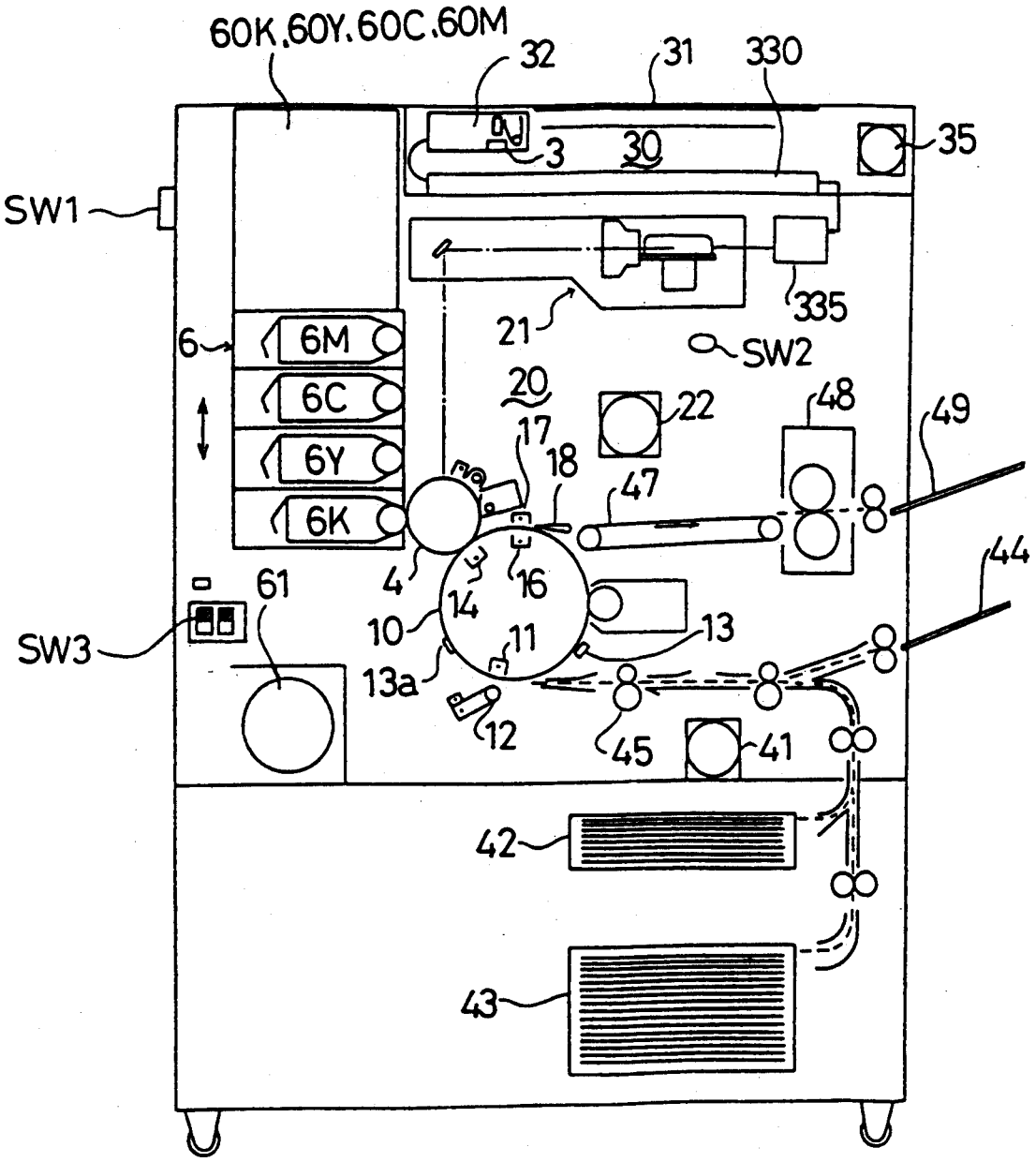
FIG. 1 is a schematic construction view of a copying machine to which a first embodiment of the present invention is applied.

FIG. 1 is a typical view for explaining the structure of a digital color copying machine to which a first embodiment of the present invention is applied. The copying machine is comprised of reading section 30 and printer section 20.

(1) Reading Section 30:

In the reading section 30, an image of original which is placed on an original table 31 is scanned by a scanner 32 and the reflected light of the image is photoelectrically converted by an image sensor (CCD) 3. Then, at image signal processing section 330, a predetermined process is conducted after the photoelectric conversion to create digital image for driving a laser diode, and the digital image data is stored in a buffer memory 335. The scanner 32 is driven by a scanner motor 35.

(2) Printer Section 20:

The printer section 20 comprises image forming section, a developing unit and sheet processing section.

(a) In the image forming section, an electrostatic latent image is written on the surface of photoconductive drum 4 by laser equipment 21 which is driven by the digital image data and the like. The electrostatic latent image is developed by toner with a developing unit 6. After the developing process, the toner image is transferred on the surface of a sheet held on a transfer drum 10. The photoconductive drum 4 and the transfer drum 10 are synchronously driven by a drum driving motor 22.

Figure 4:
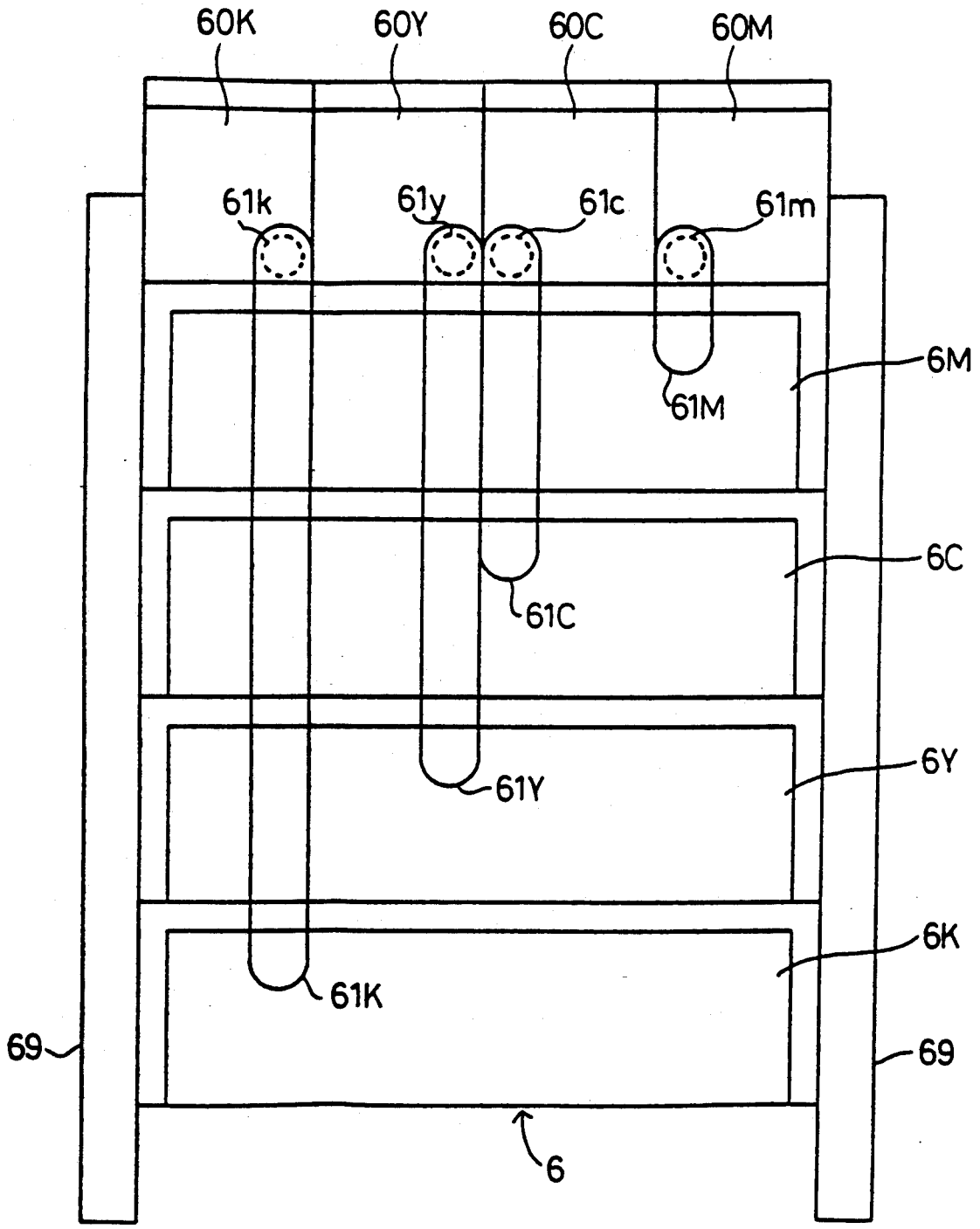
FIG. 4 is a typical view showing structures of toner hoppers.

(b) The developing unit 6 is provided with a magenta developing device 6M for performing developing process with magenta toner, a cyan developing device 6C for performing developing process with cyan toner, a yellow developing device 6Y for performing developing process with yellow toner and a black developing device 6K for performing developing process with black toner. Above the developing devices, four toner hoppers 60K, 60Y, 60C, 60M are provided for supplying colored toner to each relative developing device as illustrated in FIG. 4. The movement of the developing unit 6 in the upward-and-downward direction is conducted by a developing unit motor 61. The mechanism for moving and stopping the developing unit 6 will be described later.

(c) In the sheet processing section, supply of copy sheets, winding the sheet around the transfer drum 10, image fixing, sheet discharging and the like are performed. A sheet sent out of a sheet storing cassette 42 or 43, or a sheet inserted manually into a sheet inserting section 44 is transported to the transfer drum 10 by a group of transport rollers and is wound around the transfer drum 10. Then, a toner image on the photoconductive drum 4 is successively (maximum of 4 colored images) transferred onto a sheet on the transfer drum 10. Thereafter, the sheet is separated from the transfer drum 10 and is forwarded to a fixing device 48 whereat an image is fixed, and the sheet is discharged onto a sheet discharge tray 49. The reference numeral 45 designates a pair of timing rollers for taking register timing and 47 a transport belt. The group of transport rollers, transport belt and the like are driven by a main motor 41.

In the transfer drum 10, there is provided a tip chucking claw for chucking the front end of a sheet, an adsorbing charger 11 for electrostatically adsorbing the sheet onto the transfer drum 10, a sheet pressing roller 12, a transfer charger 14 for electrostatically adsorbing and transferring the toner image visualized on the photoconductive drum 4, chargers 16, 17 for erasing charge from the transfer drum 10 and separating the sheet from the transfer drum 10 after the toner image is transferred, a separation claw 18 for tearing off the sheet from the transfer drum 10 and the like.

The reference numeral 13 designates a standard position sensor for detecting a standard position of the transfer drum and is provided at the periphery of the transfer drum 10. The numeral 13*a* designates an actuator plate for operating the standard position sensor 13 and is arranged on the transfer drum 10. The actuator plate 13*a* turns on the standard position sensor 13 when it reaches the position of the standard position sensor 13. The timing for detecting the standard position will be described later.

In the figure, SW1 represents a main switch of the copying machine, and SW2 represents a front door switch for tuning off electricity when the front door of the copying machine is opened. SW3 represents a dip switch for setting the returning action of the developing unit 6 and description will be made later.

EXPLANATION ON THE MECHANISM OF MOVING THE DEVELOPING UNIT 6

Figure 2:
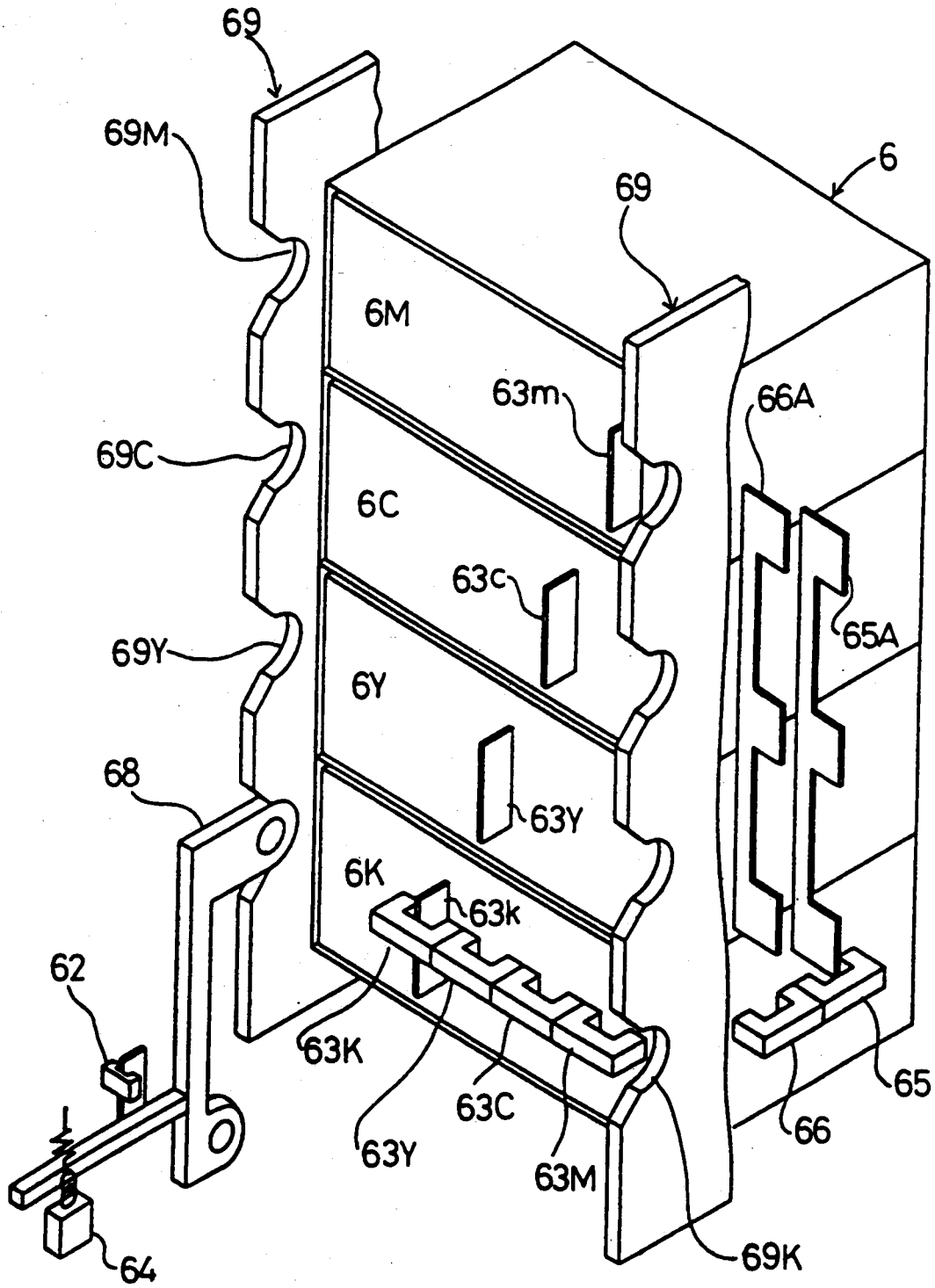
FIG. 2 is a perspective view typically showing a positioning structure of a developing unit in the copying machine.
Figure 3A:
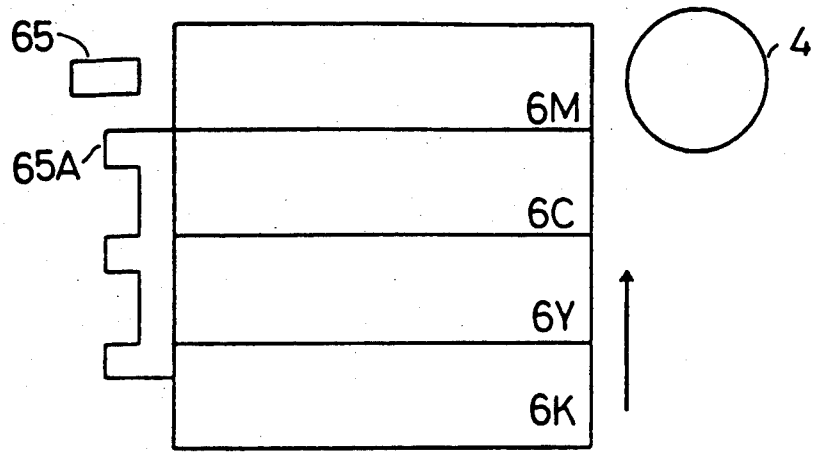
FIG. 3 is an explanatory view showing how brake sensors of the developing unit are disposed.
Figure 3B:
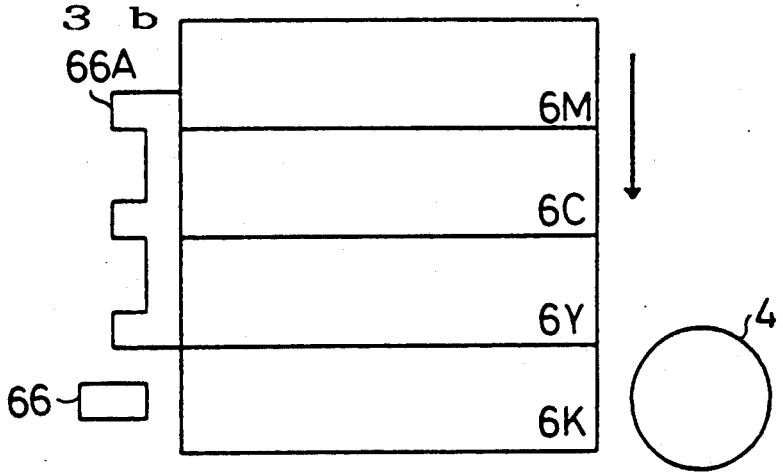
Figure 3C:
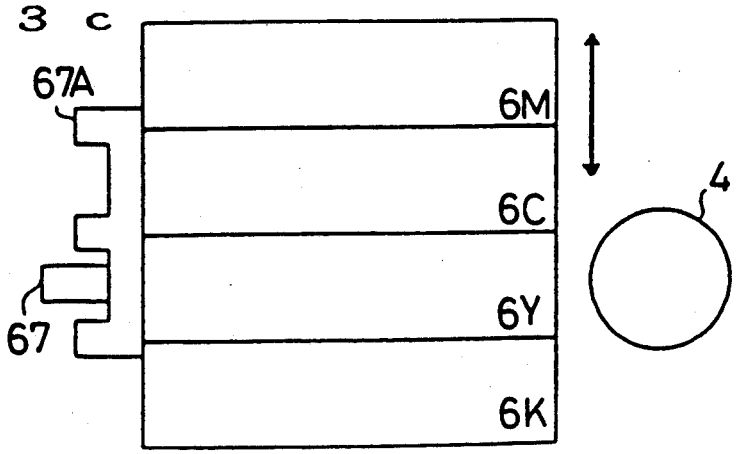

FIG. 2 is a typical perspective view for explaining the mechanism of moving and stopping the developing unit 6, and FIG. 3 is an explanatory view of brake sensors for detecting the timing of stopping the developing unit 6.

The developing unit 6 is, as described above, provided with a magenta developing device 6M for performing developing operation with magenta toner, a cyan developing device 6C for performing developing operation with cyan toner, a yellow developing device 6Y for performing developing operation with yellow toner and a black developing device 6K for performing developing operation with black toner. Four of the developing devices are incorporated into one unit which is movable in the upward-and-downward direction.

At the back of both side walls of the developing unit (the side not facing the photoconductive drum 4: the developing sleeve side facing the photoconductive drum 4 is hidden in the figure), lock receiving boards 69 are fixed and incorporated with both walls of the unit. The lock receiving boards 69 are members for receiving locking members 68. More specifically, at each position of the lock receiving board 69 which corresponds to each developing device, there are formed notch portions 69M, 69C, 69Y and 69K. With the tip of the locking member 68 entered into any one of the notch portions, positioning to a developing position (the position where the sleeve of a developing unit faces the photoconductive drum 4) is performed. The entry of the locking member 68 into the notch portion is carried out by energizing a spring 64*a* actuated on the locking member 68. The completion of the positioning operation is detected upon turning on of a lock sensor 62 fixed on the main body of the copying machine. A retracting action of the locking member 68 is conducted by operating a lock releasing solenoid 64.

At the back lower portion of the unit, positioning sensors 63M, 63C, 63Y, and 63K are fixedly disposed to the main body of the copying machine for detecting which of the developing devices is positioned at the developing position. Further, at the back wall of each developing unit, actuator plates 63*m*, 63*c*, 63*y*, 63*k* are attached for operating each of the sensors 63M, 63C, 63Y, and 63K. Detection of which of the developing devices is positioned at the developing position occurs when any one of the actuator plates 63*m*, 63*c*, 63*y*, 63*k* turns on the sensor which corresponds to a device with upward-and-downward movement of the unit. The FIG. 2 shows a state when the actuator plate 63*k* has turned on the sensor 63K, in other words, the black developing device 63K is positioned at the developing position.

At the lower portion of a side wall of the unit, an ascent brake sensor 65 for obtaining the timing to brake the upward movement of a developing device and a descent brake sensor 66 for obtaining the timing to brake the downward movement of a developing device are fixedly disposed respectively on the main body of the copying machine. To the side wall of the unit, actuator boards 65A and 66A are respectively attached for respectively operating the ascent brake sensor 65 and the descent brake sensor 66 corresponding to the sensors.

As illustrated in the figure, at the positions corresponding to boundaries of each developing device on the actuator boards 65A and 66A, there are formed convex portions 65A, 66A for turning on sensors. For instance, this is so arranged as to start braking the descent brake sensor 66 by turning on three times when it is desired to move the magenta developing device 6M to the developing position when the black developing device 6K is positioned at the developing position as shown in the FIG. 2. For further details, description will be made later.

In this embodiment, the ascent brake sensor 65 and the descent brake sensor 66 are separately provided as brake sensor as described above. It can, however, be arranged to use one sensor for both purposes by providing an actuator plate 67A as shown in FIG. 3(*c*). When the ascent brake sensor and descent brake sensor are separately arranged as in the present embodiment illustrated in FIGS. 3(*a*) and 3(*b*), stopping action can be performed more smoothly.

The toner hoppers 60M, 60C, 60Y, 60K are connected with each of the respective developing devices 6M, 6C, 6Y, 6K through supply pipes 61M, 61C, 61Y, 61K extending from the lower portion of each toner hopper as shown in FIG. 4. At the junction of each toner hopper and each supply pipe, toner supply rollers 61*m*, 61*c*, 61*y*, 61*k* are disposed respectively, and by rotating the toner supply roller, the toner stored in the toner hopper is supplied to respective developing device through the toner supply pipe. The toner supply roller is rotatively driven by a toner supply motor.

Figure 5:
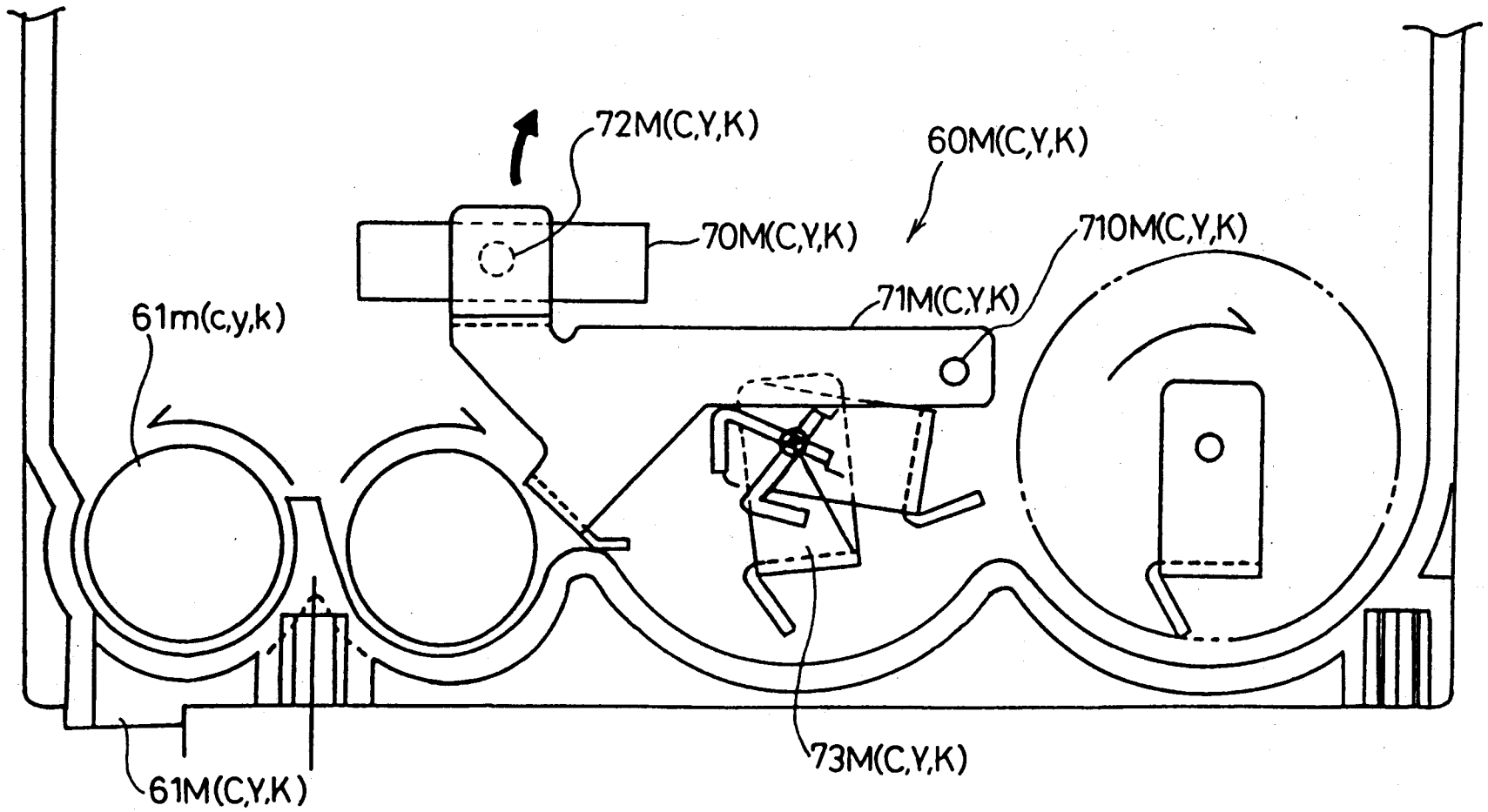
FIG. 5 is an explanatory view showing how a toner empty detecting sensor is operated.

In the toner hoppers 60M (C, Y, K), reed switches 70M (C, Y, K) are disposed for detecting a toner empty state as illustrated in FIG. 5. The reed switches 70M (C, Y, K) are arranged to be turned on when they are positioned opposite to magnets 72M (C, Y, K) held on the tip portion of magnet supporting plates 71M (C, Y, K).

Below the magnet supporting plates 71M (C, Y, K), toner stirring members 73M (C, Y, K) which are driven by a toner supply motor are arranged. The toner stirring member 73M (C, Y, K) functions like an eccentric cam with respect to the magnet supporting plate 71M (C, Y, K). In other words, with the rotation of the toner stirring member 73M (C, Y, K), the magnet supporting plate 71M (C, Y, K) is gradually lifted up with a shaft 710M (C, Y, K) as a center of rotation, and when it comes to a certain position, it loses support by the toner stirring member 73M (C, Y, K). At this stage, if toner is filled up to the position above the reed switch 70M (C, Y, K), the magnet supporting plate 71M (C, Y, K) is not returned downward since it is supported by toner.

However, when the amount of toner is decreased, the magnet supporting plate 71M (C, Y, K) loses the support and is dropped down to the position of the reed switch 70M (C, Y, K) to turn on the reed switch 70M (C, Y, K). In other words, when the amount of toner in the hopper drops below a predetermined amount, the reed switch is turned on and off repeatedly, and it is detected that toner is emptied. As will be understood from the above description, the detection of toner emptied state can be made only when the toner supply motor is being rotated.

Now, description will be made on a pressing mechanism wherein each of the developing devices is pressed in contact with the photoconductive drum 4 at the developing position to be ready for the developing process.

Figure 6:
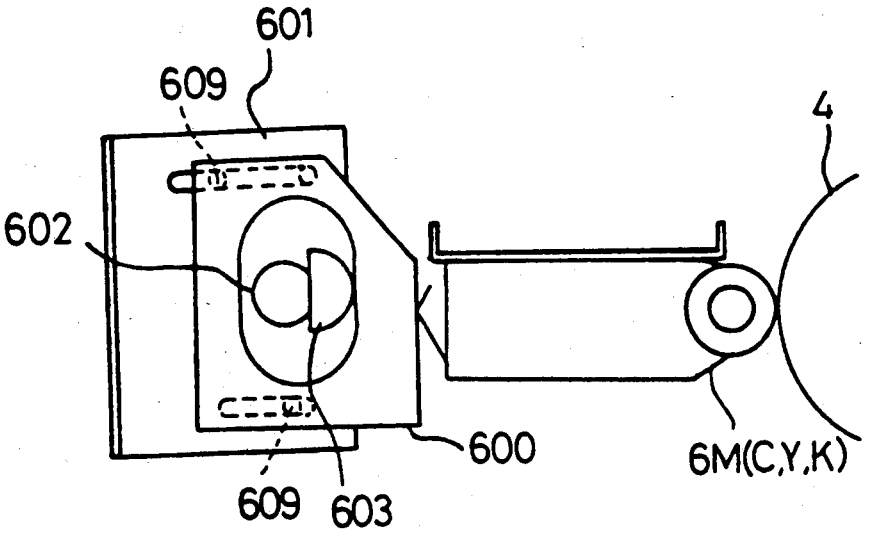
FIGS. 6 through 8 are explanatory views showing pressing mechanisms of developing devices.
Figure 7:
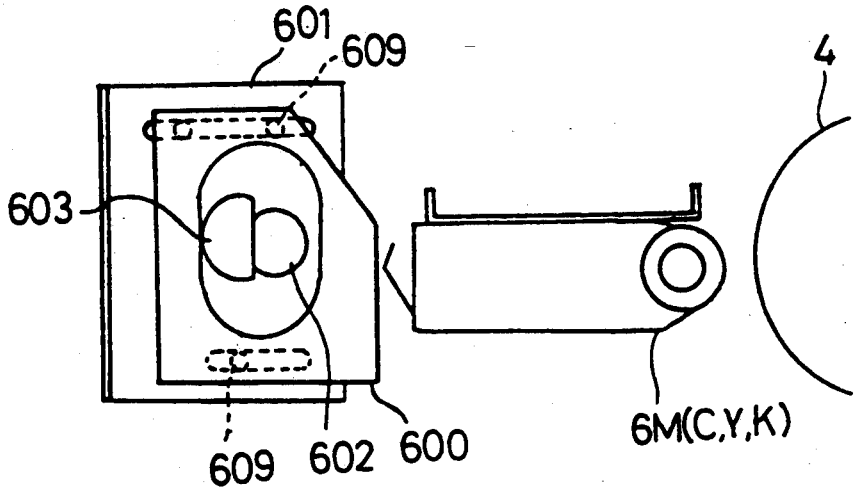
Figure 8:
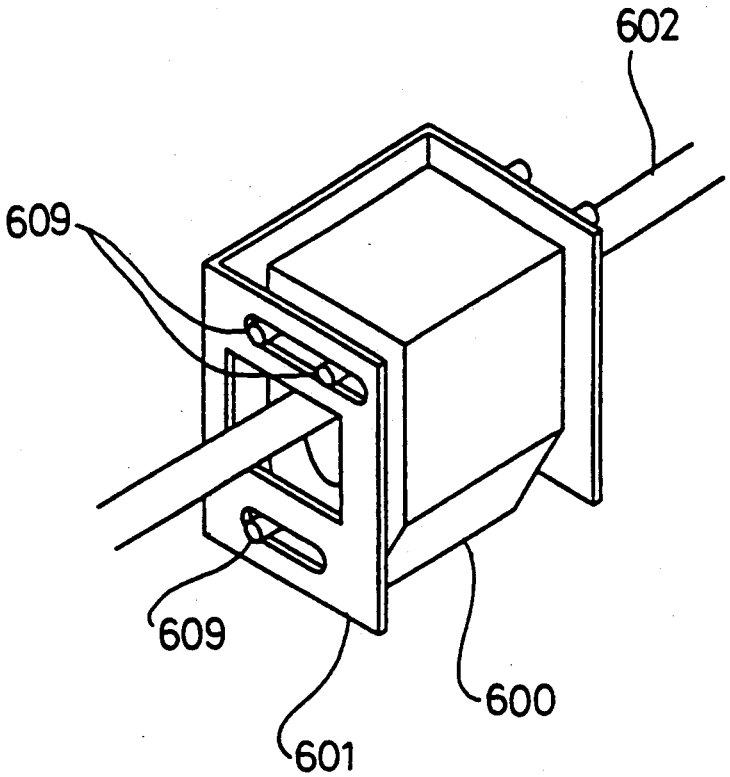

As illustrated in the FIGS. 6 through 8, at the back of the developing device 6M (C, Y, K) (the side which is not facing the photoconductive drum 4), there is disposed a cam retaining member 601 which is fixed on the copying machine. To the cam retaining member 601, a pressing cam 600 is movably held by three slide pins 609 in the right and left directions relative to the cam retaining member 601. In the pressing cam 600, there is formed a through aperture of oval shape. In the through aperture, there is provided a round shaft 602 which is fixed to the copying machine to receive drive force from the main motor 41, and an eccentric cam 603 is attached at the periphery of the round shaft 602. With the rotation of the round shaft 602, the pressing cam 600 is thus pushed by the eccentric cam 603 for displacement in the lateral direction as shown in FIGS. 6 and 7. Accordingly, the developing device 6M (C, Y, K) is also moved in the same direction and pressing or releasing action is performed.

FIG. 6 shows a state when the developing device 6M (C, Y, M) is pressed in contact with the photoconductive drum 4, while FIG. 7 illustrates a state when the developing device is released from the pressing state. The description has been made here as a contacting relation between the developing device and the photoconductive drum for convenience' sake, however, it is actually conducted through an unillustrated roller so as to maintain a predetermined intervals.

EXPLANATION ON EXPOSURE TIMING

The timing for exposure is determined by the positional relation of the leading end of a sheet of paper which is held on the transfer drum 10, and is derived from the timing of detecting the standard position of the transfer drum when the actuator plate 13*a* turns on the standard positioning sensor.

Figure 9:
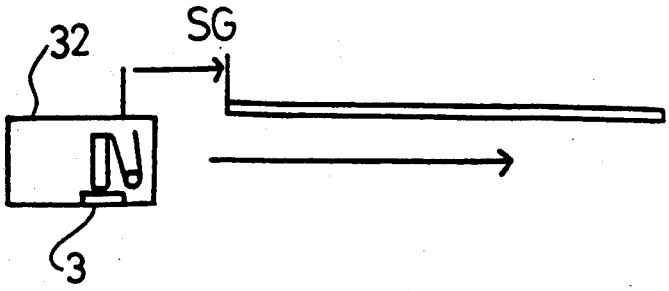
FIG. 9 is an explanatory view showing a timing when the developing device is pressed and an image exposure is carried out.
Figure 9:
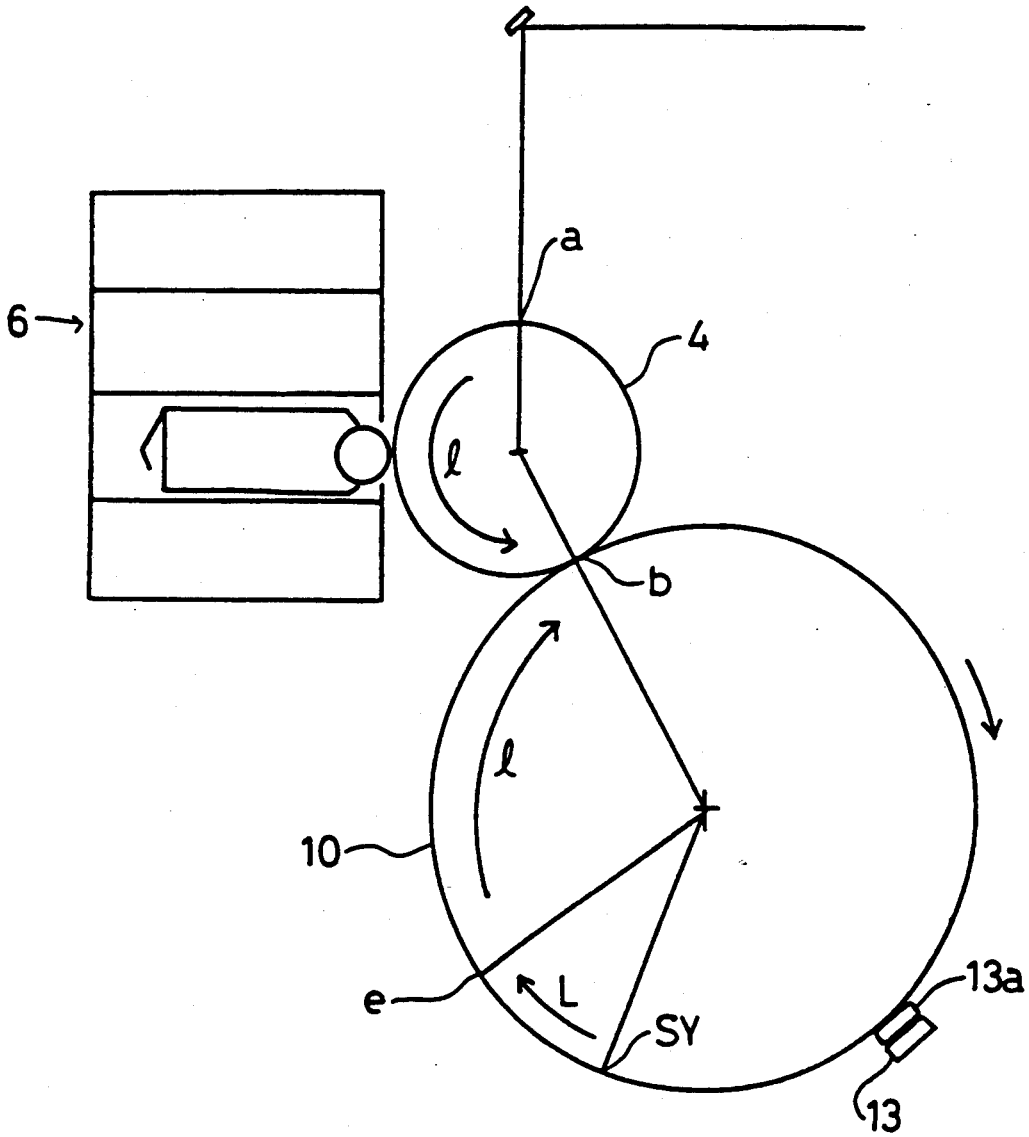

In FIG. 9, a reference letter designates an image exposure position of the photoconductive drum 4, b is a transfer position whereat toner image is transferred onto a sheet of paper, SY is a leading end position of the sheet on the transfer drum 10 when scanning action is started, and SG is a leading end position of an original image. An electrostatic latent image formed by an exposure at the a point as shown in the figure is transferred at the b point. The leading end of the sheet on the transfer drum 10 should, therefore, be positioned at e point ahead of the b point by the distance 1 which is the distance between the points a and b at the time when the leading end SG of the original image is exposed. The time when the leading end SG of the image is exposed delays by the time t from the scan starting time, which is equivalent to a distance L ($L=V\times t$, wherein V is a circumferential speed of the transfer drum 10) on the transfer drum. The leading end position of the paper at scan starting time is, therefore, set to be the position of SY as shown in the FIG. 9. In order to take the timing, the sensor 13 and actuator plate 13*a* are provided so as to turn on the standard sensor 13 when the leading end of the paper reaches the position of SY.

EXPLANATION ON THE OPERATION PANEL

Figure 10:
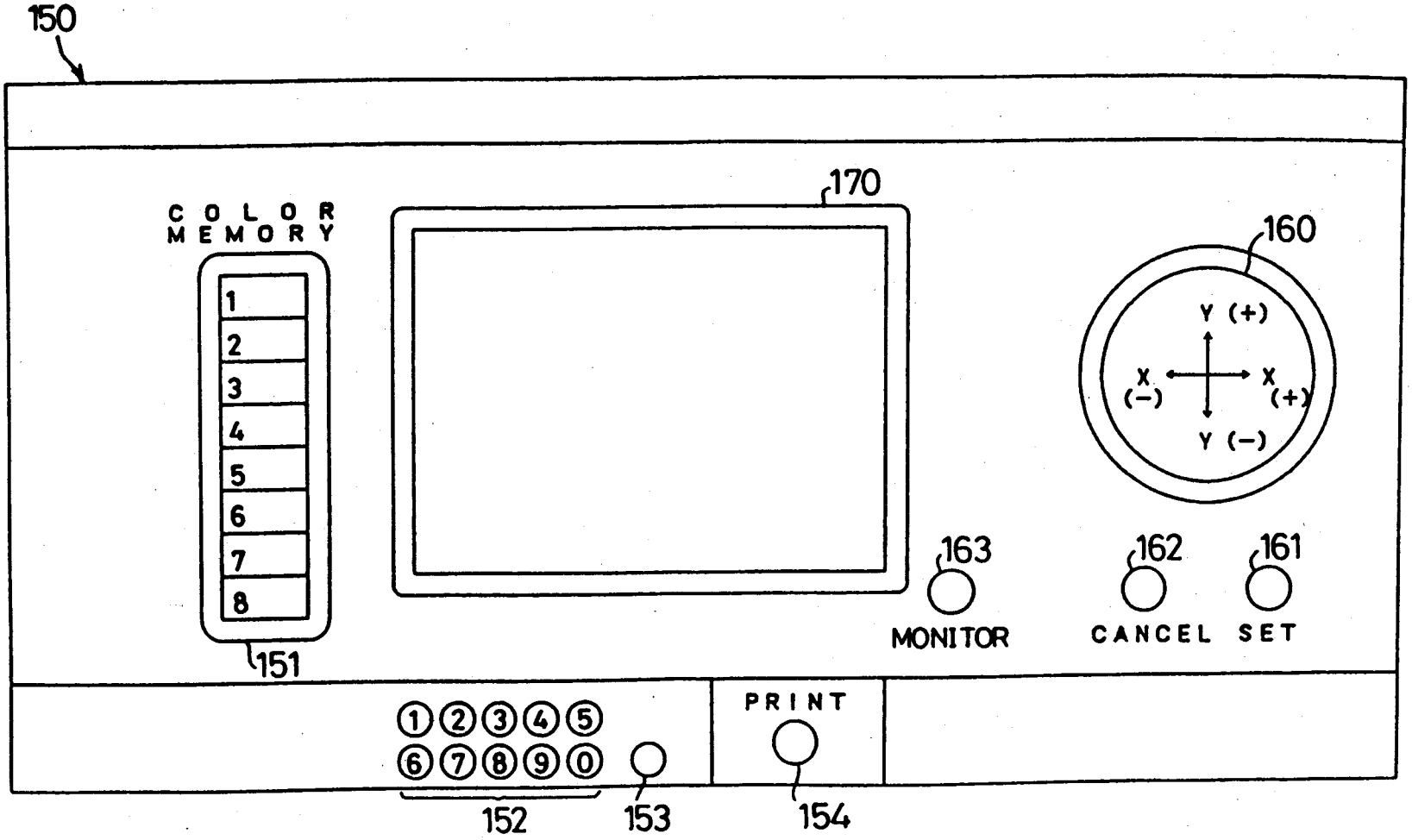
FIG. 10 is an explanatory view showing an operation panel of the copying machine.
Figure 11:
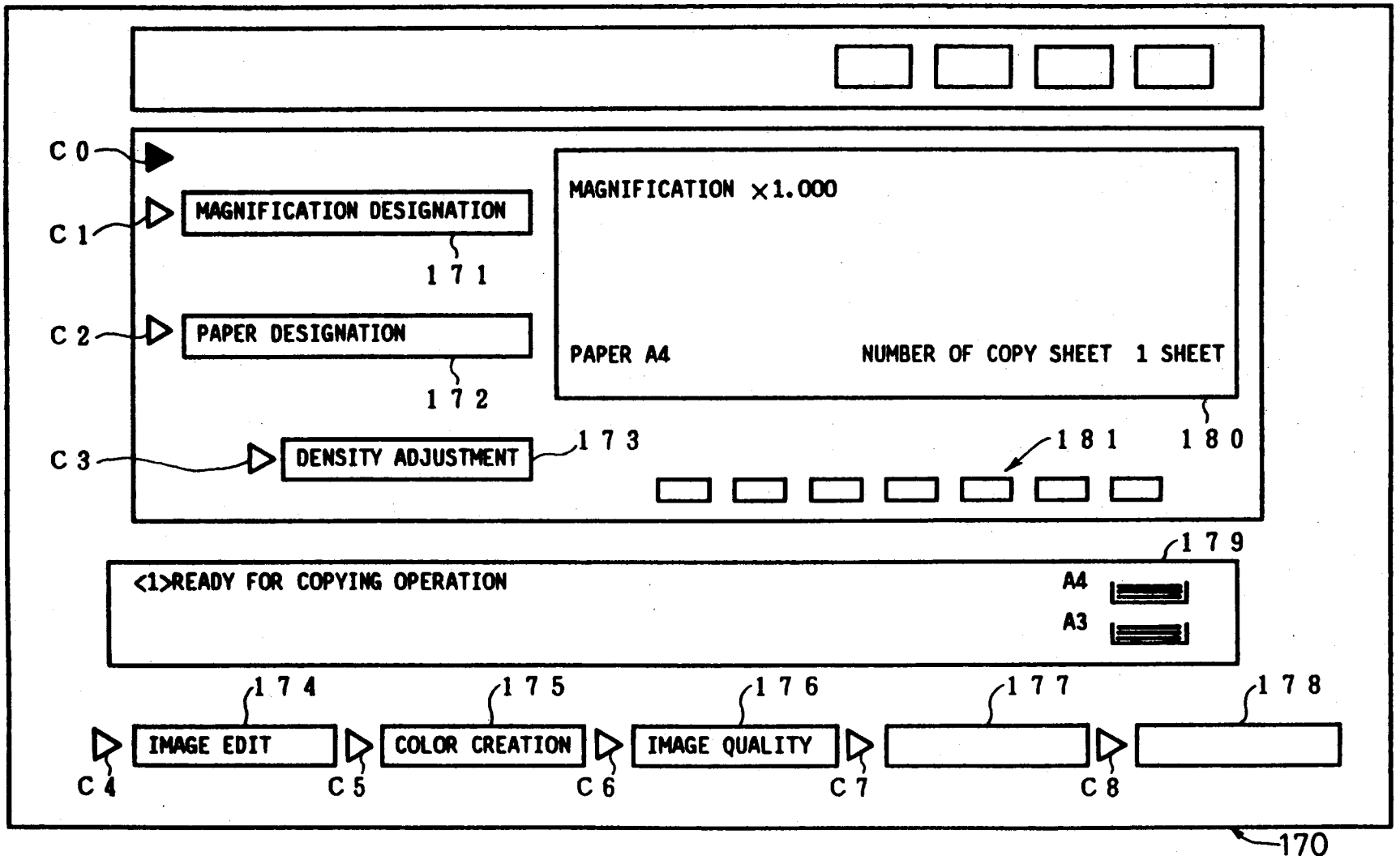
FIG. 11 is an explanatory view showing a liquid crystal display section of the operation panel.

The FIG. 10 shows the operation panel of the copying machine, and the FIG. 11 shows the liquid crystal display section.

On the operation panel 150, as illustrated in the FIG. 10, there are provided a registered color setting section 151 for inputting color editing mode such as color conversion and color designation, a group of ten keys 152 for inputting data of numerical value, a clear and stop key 153 for inputting the suspension of mode initialization and copying operation, a start key 154 for inputting the start of copying operation, a liquid crystal display section 170 for performing various displays, a joy ball 160 for selecting the content of the menu displayed on the liquid crystal display section 170, a set key 161 for deciding the content of menu or the like selected by the joy ball 160, a cancel key 162 for canceling the content decided by the set key 161, and a monitor key 163 for displaying an original image on the liquid crystal display section 170.

On the liquid crystal display section 170, as shown in the FIG. 11, there are provided menu cursor C0–C8 (in the figure, the cursor is at a home position C0) which is designated by the rotation of the joy ball 161 and selected by the set key 161, various mode displays 171–178 which correspond to each of the menu cursor positions C1–C8, a data display 180 for displaying a number of copy sheets, copying magnification, sheet size and the like, a copy density display 181, an information display 179 for displaying operational conditions of the copying machine (such as toner empty), handling procedures and the like.

Figure 12:
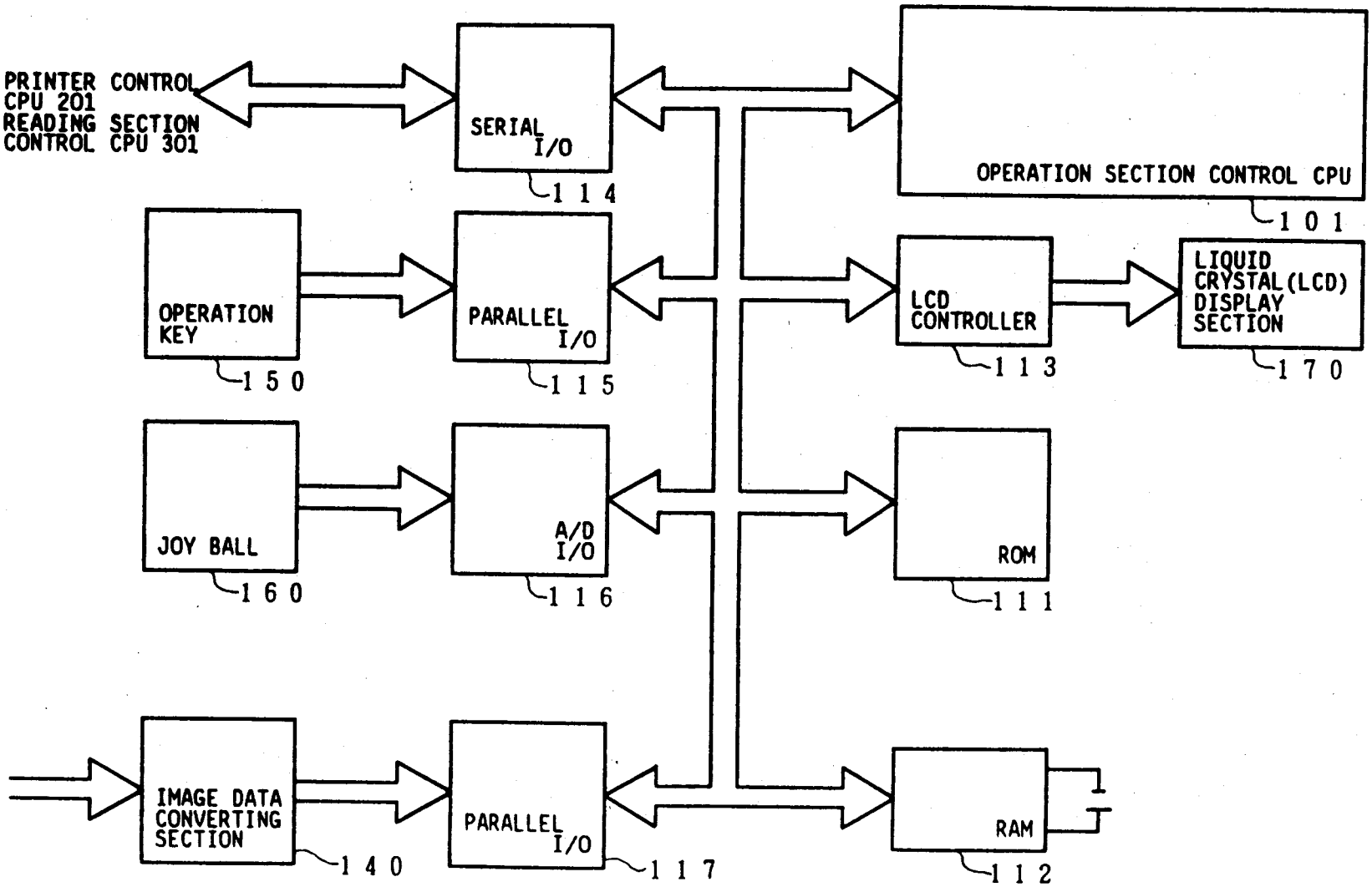
FIG. 12 is a block diagram of a control circuit in the operation panel of the copying machine.

EXPLANATION ON THE CONTROL CIRCUIT (1) FIG. 12 is a block diagram of a circuit for controlling the operation panel 150 of the copying machine. The control CPU 101 in the operation section executes interfacial control between the operation panel 150 and the copying machine. In other words, the input by various keys on the operation panel 150 is controlled through parallel I/O 115, while the input by the joy ball 160 is controlled through A/D.I/O 116.

An original image data transmitted from the reading section 30 is inputted in an image data converting section 140 and converted into an image data to be used for the liquid crystal display. The converted image data is stored in RAM 112 through parallel I/O 117 by the operation section control CPU 101. The RAM 112 is also used for works of control programming. In ROM 111, control program and liquid crystal display data are stored.

The operation control section CPU 101 controls the drive of the liquid crystal display section 170 through LCD controller 113. The operation section control CPU 101 further makes communication with printer control CPU 201 and a reading section control CPU 301 to give and receive data and control command through serial I/O 114.

Figure 13:
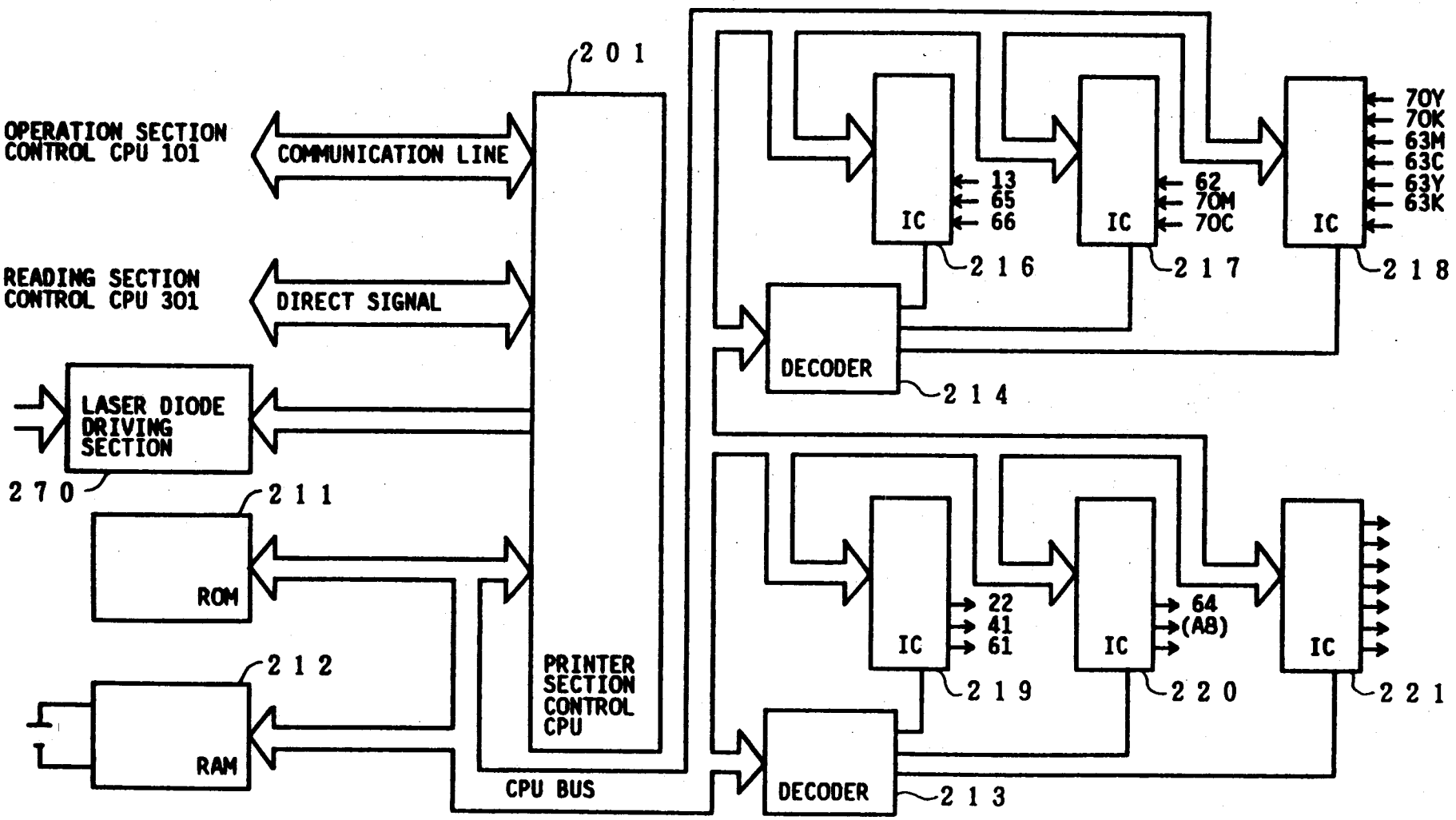
FIG. 13 is a block diagram of a control circuit in printer section of the copying machine.

(2) FIG. 13 is a block diagram of a circuit for controlling the printer section 20 of the copying machine. Signals transmitted from various sensors (lock sensor 62, developing device position detecting sensors 63M, C, Y, and K, brake sensors 65 and 66, standard position sensor 13, toner empty sensors 70M, C, Y and K and the like) that are disposed in the printer section 20 for detecting conditions of operation and the like are inputted into printer control CPU 201 through expansion input IC 216–218 which are selected by decoder 214.

From the printer control CPU 201, on the other hand, control signals are output respectively to the driving circuit of motors in the printer section 20 (drum motor 22, developing unit moving motor 61, main motor 41 and the like), solenoid (lock releasing solenoid 64 and the like), and of clutch and the like, and also to circuit A8 (refer to FIG. 16) for turning on and off main relay through expansion output IC 219–221 which are selected by decoder 213. The printer control CPU 201 transmit a signal to control the timing of luminous emission relative to laser diode driving section 270.

In the ROM 211, a control program is stored and the RAM 212 is also utilized for the work on control programming. The printer control CPU 201 further makes communication with the reading control CPU 301 and the operation section control CPU 101 to give and receive data and commands.

Figure 14:
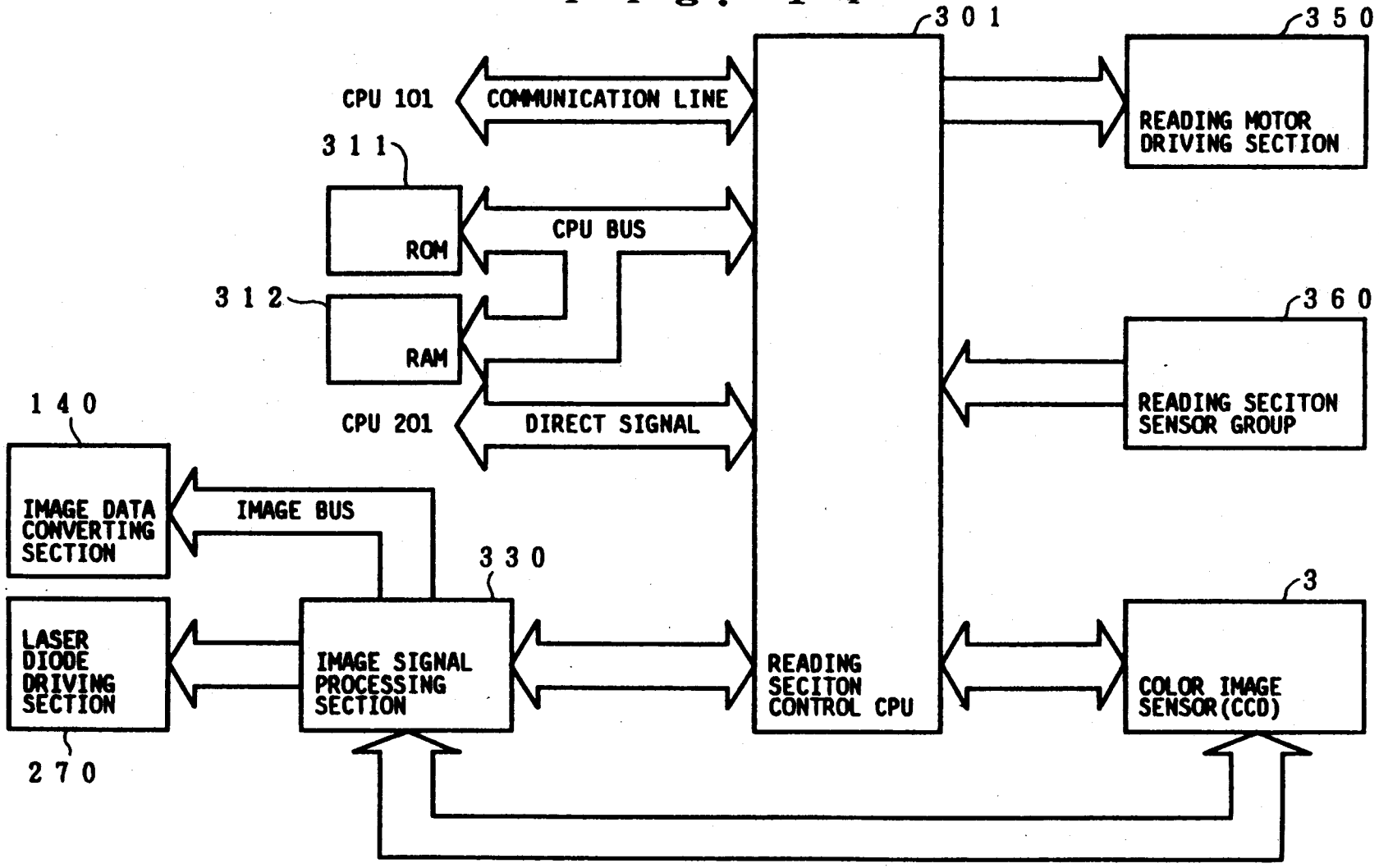
FIG. 14 is a block diagram of a control circuit in reading section of the copying machine.

(3) FIG. 14 is a block diagram of a circuit for controlling the reading section 30 of the copying machine. To the CPU 301 for controlling reading section, signals from a group of sensors disposed in the reading section 30 for detecting operating condition and also a signal from a CCD image sensor 3 are inputted. From the reading section control CPU 301, on the other hand, a drive control signal is output to a motor driving section 350 such as a scanner driving motor 35 in the reading section, and a control signal is also output to the CCD image sensor 3.

An image data received from the CCD image sensor 3 is inputted in an image signal processing section 330, and after predetermined processing, it is given to a laser diode driving section 270. The image data which has been processed with a predetermined process as described above is also output to an image data conversion section 140 and is converted into a data for the liquid crystal display as described above.

EXPLANATION ON POWER CIRCUIT

Figure 16:
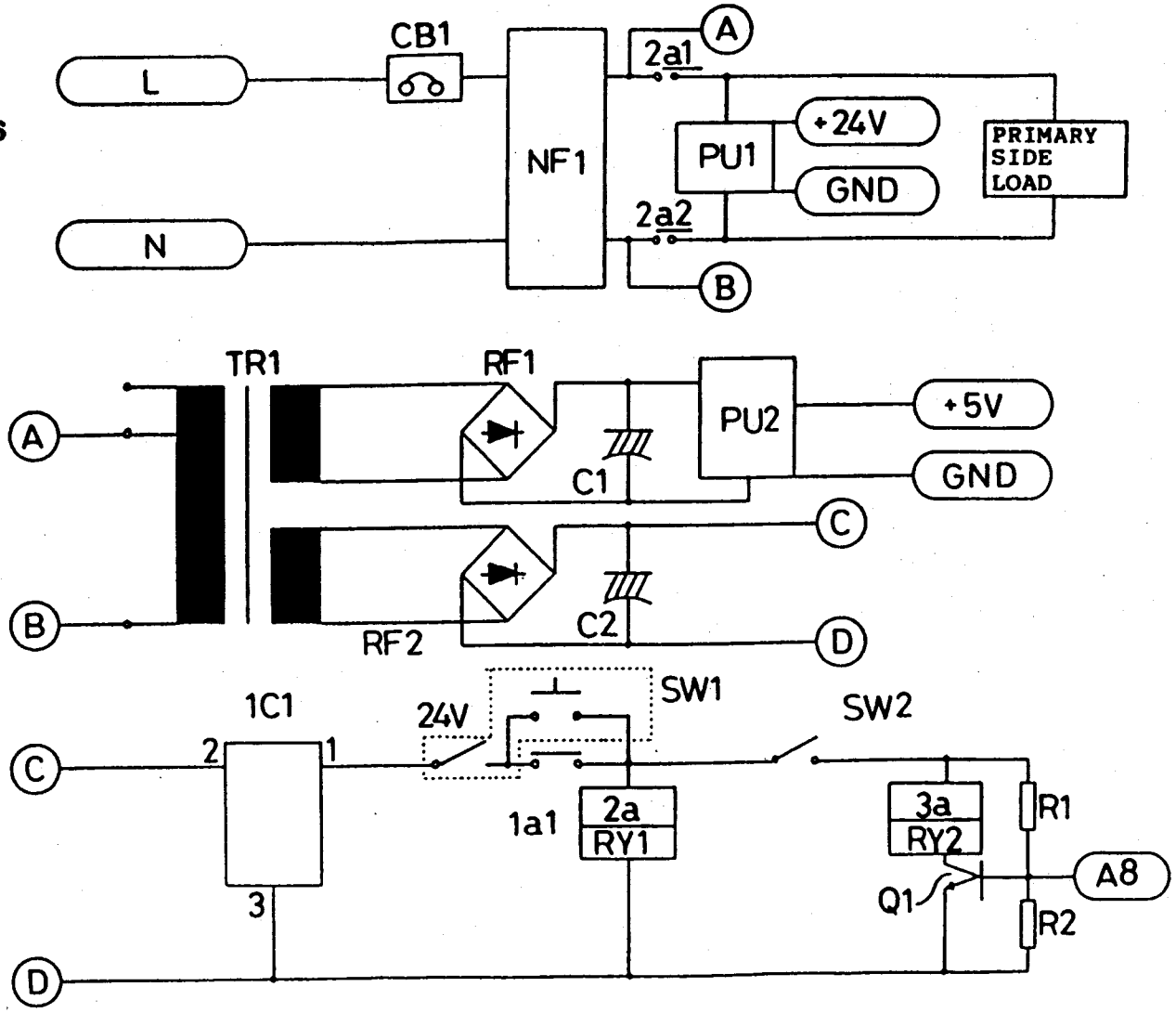
FIG. 16 is a circuit construction view showing a power source circuit of the copying machine in the present embodiment.

Description will now be made on a power circuit illustrated in the FIG. 16.

Electric power to the copying machine is supplied from power source input line L and N through breaker CB1 and noise filter NF1.

IN THE CASE OF POWER SUPPLY THROUGH MAIN RELAY CONTACT

For a power unit PU1, to which a primary side load of 100 (V) is applied to a heater in the fixing device or exposure lamp and the like, and a secondary side load of 24 (V) is applied to a main motor 41, or a developing unit moving motor 61 and the like, the power source is connected through relay contacts 2a1 and 2a2 of main relay RY2.

IN THE CASE OF POWER SUPPLY NOT THROUGH MAIN RELAY CONTACT

To a power transformer TR1 for supplying electric power to the control circuit such as CPU and to a group of sensors, the power source is connected not through the relay contacts 2a1 and 2a2. In this case, from the power transformer TR1, 5 (V) is supplied through rectifying circuit RF1 and the power unit PU2, and 24 (V) is supplied through a rectifying circuit RF2 and a stabilizing circuit ICI.

ON AND OFF MECHANISM OF MAIN RELAY

By activating a main switch SW1 connected with the stabilizing circuit ICI, relay RY1 is operated and it is maintained by the turning on of the relay contact 1a1. To the main relay RY2 which is connected with the relay contact 1a1 in series, a front door switch SW2 and a switching transistor Q1 are connected in series. Turning on and off of the switching transistor Q1 is managed by a driver A8 which is controlled by a signal (on-off signal of power source) from the CPU201. More particularly, when a signal from the CPU 201 became 'on signal', output from the driver A8 becomes 'high level', by which the main relay RY2 is activated to close relay contacts 2a1 and 2a2. Consequently, electric power is supplied to the primary side load and secondary side load.

On the other hand, when the on-off signal of power source became 'off signal', output of the driver A8 becomes 'low level', by which the transistor Q1 is cut off to turn off the main relay RY2 and the relay contacts 2a1 and 2a2 are opened. As a result, electric power supply to the primary side and secondary side load is cut off.

EXPLANATION ON THE PROCESS AT CPU

Description will now be made on the operation of the apparatus used in the present embodiment based on the process at CPU. In the following explanation, ON-edge is defined as the conditional change when the signal changes from OFF to ON state, while OFF-edge is defined as the conditional change when the signal changes from ON to OFF state.

(A) Main Routine of each Control CPU

Figure 17:
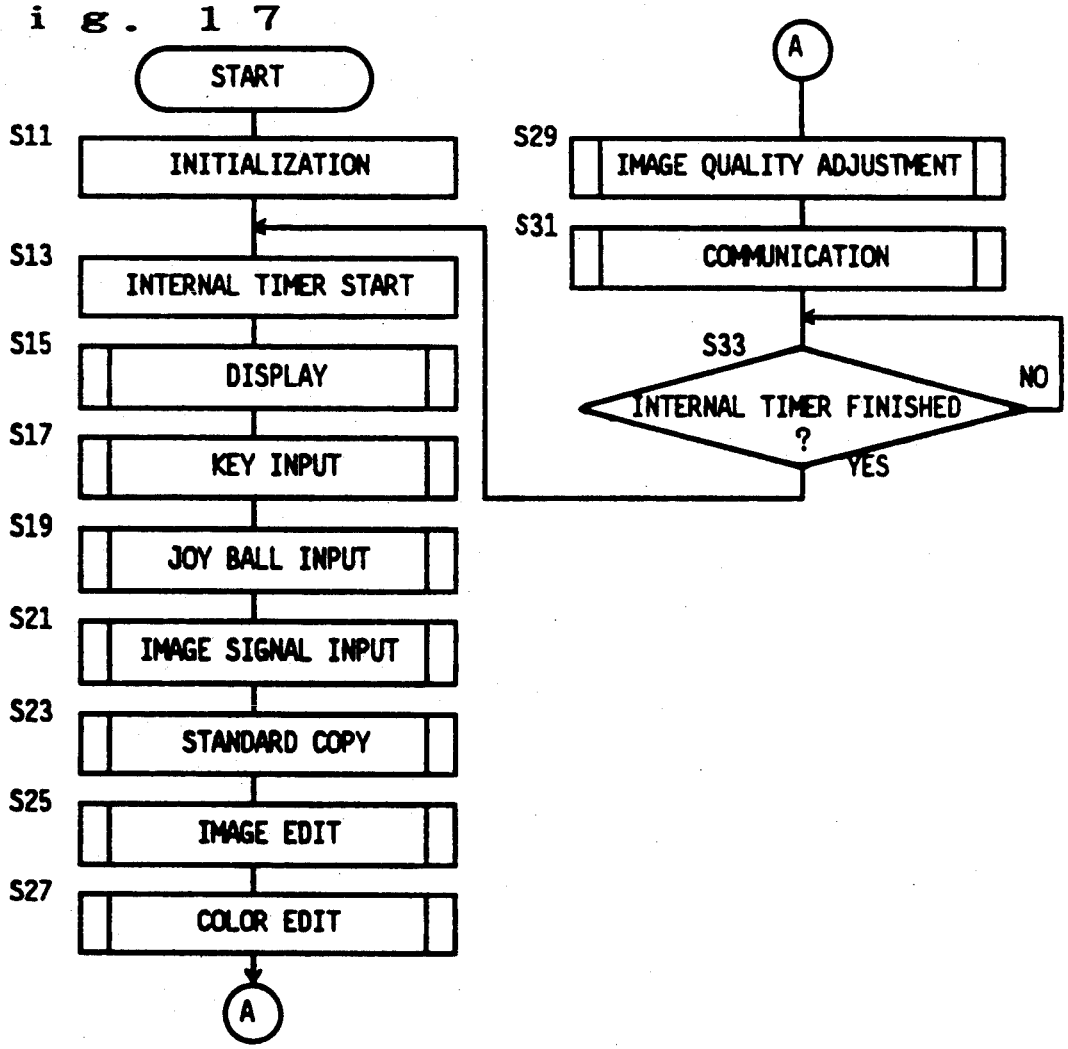
FIG. 17 is a flow chart showing a main routine for processing a control CPU in the operation panel section.
Figure 18:
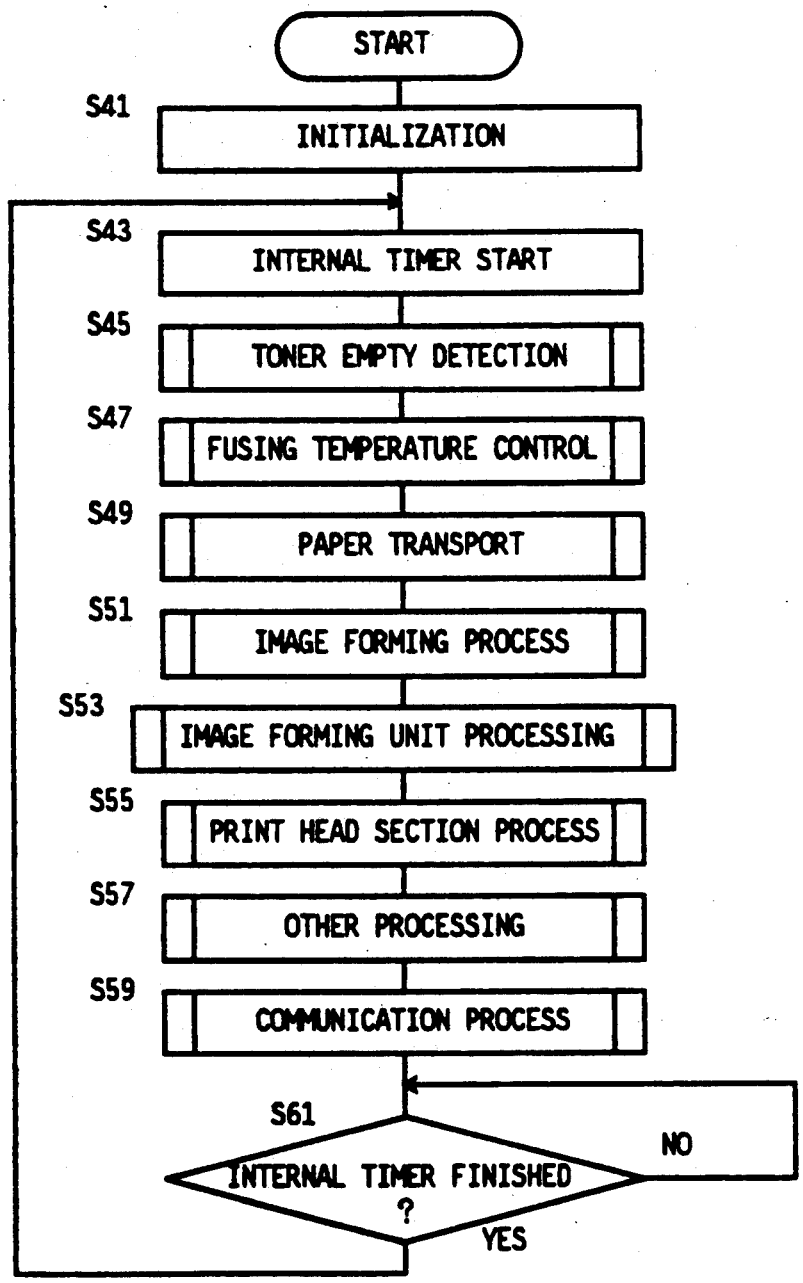
FIG. 18 is a flow chart showing a main routine for processing a control CPU in the printer section.
Figure 19:
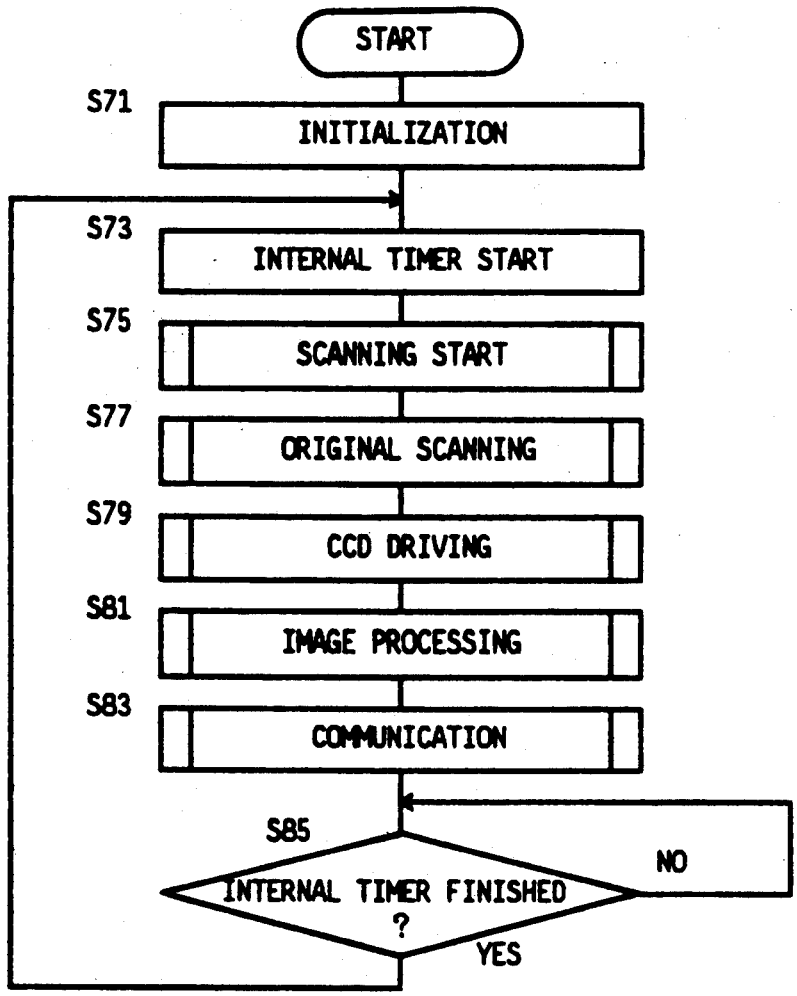
FIG. 19 is a flow chart showing a main routine for processing a control CPU in the reading section.

FIGS. 17 through 19 are flow charts showing main routines of processing at each control CPU 101, 201 and 301.

(1) Operating Section Control CPU 101

The operating Section Control CPU 101, for instance, starts processing when electric power is supplied, and firstly, each register flags and the like are initialized (S11). Then, at step S13, an internal timer for regulating the time of one routine is started to execute each of the following routines.

(i) Display Routine (S15)

This is a step for displaying the liquid crystal 170 by outputting a display data command to CCD (liquid crystal display) controller 113.

(ii) Key Input Routine (S17)

This is a step for renewing the contents of RAM 112 according to the contents judged, wherein on/off of various keys on the operation panel 150 (151–154, 161–163) are judged (process of parallel I/O 115).

(iii) Joy Ball Input Routine (S19)

This is a step for renewing the contents of RAM 112 and flags in accordance with the contents determined, wherein a position of the joy ball 160 is determined (process of A/D, I/O 116).

(iv) Image Signal Input Routine (S21)

This is a step for receiving a data for image data monitor display which is convertibly processed by the image data conversion section (140) (process of parallel I/O 117) and store the data in the RAM 112.

(v) Basic Copying Routine (S23)

This is a step for controlling various processes of the basic copying mode according to input data processed at steps S17 and S19.

(vi) Image Editing Routine (S25)

This is a step for controlling various processes of the image editing copy mode in accordance with input data processed at steps S17, S19 and S21.

(vii) Color Editing Routine (S27)

This is a step for controlling various processes of the color editing copy mode according to input data processed at steps S17, S19 and S21.

(viii) Image Quality Adjusting Routine (S29)

This is a step for controlling various processes of the image quality adjusting routine in accordance with input date processed at steps S17 and S19.

(ix) Communicating Routine (S31)

This is a step for performing serial communication between the printer control CPU 201 and the reading section control CPU 301.

After the above processing have been performed, the program returns to the step S13 upon completion of the internal timer which started at the step S13 (S33: Yes), and the processing is repeatedly executed.

(2) Printer Control CPU 201

The printer control CPU 201 starts processing when electric power is applied, and firstly, each register flag and the like are initialized (S41). Then, at step S43, an internal timer for regulating the time of one routine is started to execute each of the following routines.

(i) Toner Empty Detecting Routine (S45)

The amount of residual toner in the toner hoppers 60M, 60C, 60Y, 60K of each developing device is checked and when toner is emptied, flags corresponding to respective hopper are set at this step.

(ii) Fusing Temperature Control Routine (S47)

At this step, preparatory rotation for fusing is conducted in order to unify fusing temperature and performs temperature control of the fixing device 48.

(iii) Paper Transporting Routing (S49)

Copy paper is supplied, transported and wound around the transfer drum 10, and then the paper is separated from the drum 10 for further transport and discharge operation at this step.

(iv) Image Forming Process Routine (S51)

Here at this step, operations are conducted for charging the photoconductive drum 4, developing an electrostatic latent image by toner, transferring the toner image, removing residual toner on the photoconductive drum 4, erasing the charge on the photoconductive drum 4, and controlling the image forming process.

(v) Developing Unit Process Routine (S53)

This is a step for controlling the developing unit 6 (movement of the developing unit, pressing the developing device in contact with the photoconductive drum 4 and releasing the developing device from the drum.

(vi) Print Head Section Process Routine (S55)

This is a step for controlling the print head section 21 (polygon mirror, laser emission and the like).

(vii) Other Process Routine (S57)

This is a step for processing the printer section 20, and other processes other than the process described above are conducted collectively. A problem or interrupt processing routine (refer to FIG. 24) is included in this step.

(viii) Communication Routine (S59)

Serial communication with the operation section control CPU 101 is conducted at this step.

After the above processing have been finished, the program returns to the step S43 upon completion of the internal timer which started at the step S43 (S61: Yes), and the processing is repeatedly executed.

Description will be made later with regard to the toner empty detecting routine (S45), the fusing temperature adjusting routine (S47), the developing unit process routine (S53) and trouble processing routine executed in other process routines.

(3) Reading Section Control CPU 301

The reading section control CPU 301 starts processing when electric power is applied, and firstly, each register flag and the like are initialized (S71). Then, at step S73, an internal timer for regulating the time of one routing is started to execute each of the following routines.

(i) Scan Starting Routine (S75)

Exposure scanning operation for an original image is started in response to a scan start request from the printer control CPU 201 at this step.

(ii) Original Scanning Routine (S77)

This is a step for controlling the speed of the scanner motor 35 and the position of the scanner 32 in response to a timing signal from the printer control CPU 201 in order to conduct original scanning operation.

(iii) CCD Driving Routine (S79)

This is a step for driving the CCD image sensor 3 synchronously with a scanning signal.

(iv) Image Processing Routine (S81)

This is a step for controlling the image signal processing section 330 to perform image data processing.

(v) Communication Routine (S83)

This is a step for conducting a serial communication with the operation section control CPU 101.

After the above processing have been finished, the program returns to step S73 upon completion of the internal timer which is started at the step S73 (S85: Yes), and the processing is repeatedly executed.

(B) Subroutine of CPU 201

This is a process which is executed in the printer control CPU 201, and the processing directly related to the present invention (toner empty detecting routine, fusing temperature control routine, trouble processing routine, developing unit process routine) will now be described.

(i) Toner Empty Detecting Routine

Figure 20:
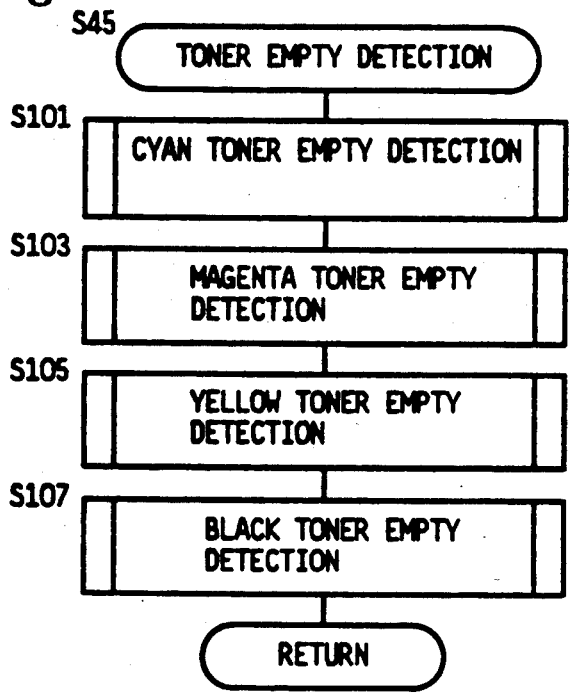
FIG. 20 is a flow chart showing the processing of the toner empty detecting routine (S45) in the FIG. 18.

FIG. 20 is a flowchart showing a process executed in the toner empty detecting routine (S45) which is called in the main routine of the printer control CPU 201. In this routine, the amount of residual toner is checked for each one of the toner hoppers 60M, 60C, 60Y and 60K. More particularly, cyan toner empty detecting routine (S101), magenta toner empty detecting routine (S103), yellow toner empty detecting routine (S105) and black toner empty detecting routine (S107) are successively called and the program returns to main routine.

The subroutine for detecting toner empty will be described below taking the cyan toner empty detecting routine (S101) as an example. The contents of control are the same as each of the magenta toner, yellow toner and black toner detecting routines, and therefore, illustration and description of the additional will be omitted.

Figure 21:
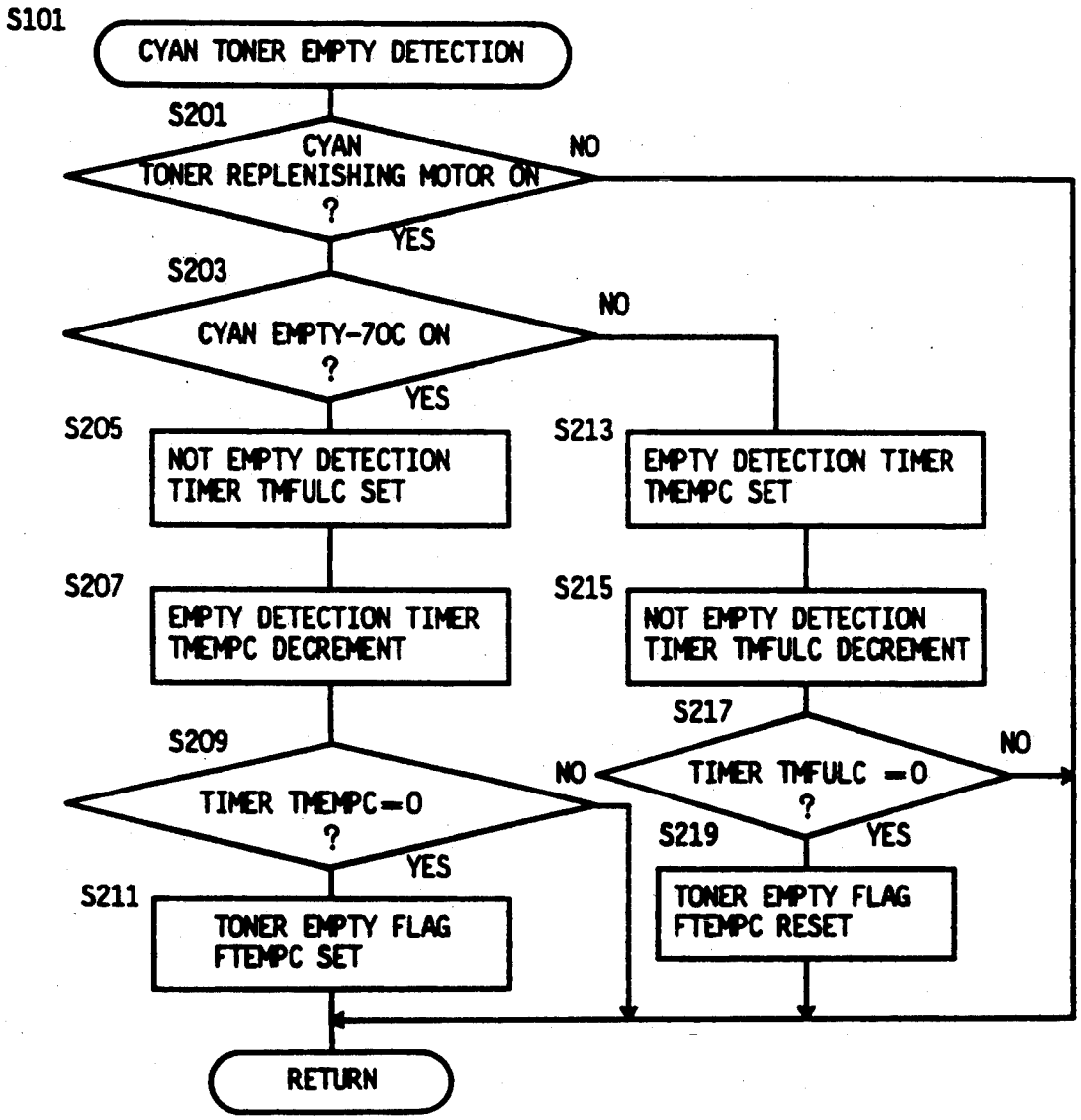
FIG. 21 is a flow chart showing the processing of cyan toner empty detecting routine (S101) in the FIG. 20.

FIG. 21 is a flowchart showing a cyan toner empty detecting routine (S101) which is called in the toner empty detecting routine (S45). Firstly, at step S201, judgement is made whether or not the cyan toner replenishing motor is turned on, in other words, whether it is in a state that toner empty can be detected or not.

When the cyan toner replenishing motor is turned on (S201: Yes), judgment is made on a reed switch 70C which detects emptiness of cyan toner (S203). When judgment is made that the reed switch 70C is turned on (S203: Yes), NOT empty detection timer counter TMFULC is set (S205), and an empty detection timer counter TMEMPC is decreased (S207).

In case when the empty detection timer counter TMEMPC became 0 (S209: Yes), a cyan toner empty flag FTEMPC is set (S211). In other words, when the reed switch 70C is kept turning turned on for a predetermined Lime which is regulated by the empty detection timer counter TMEMPC, toner emptiness is detected.

On the other hand, when the judgment is made that the reed switch 70C is turned off at step S203 (Step S203: Yes), the program proceeds to step S213 and the empty detection timer counter TMEMPC is set, and NOT empty detection timer TMFULC is decreased (S215). In case when the NOT empty detection timer counter TMFULC became 0 (S217: Yes), cyan toner empty flag FTEMPC is reset (S219). In other words, when the reed switch 70C is kept turned off for a predetermined time which is regulated by the NOT empty detection timer counter TMFULC, the toner empty detecting state is released. In the same manner, the toner empty detection is conducted for magenta toner, yellow toner and black toner.

(2) Fusing Temperature Control Routine

Figure 22:
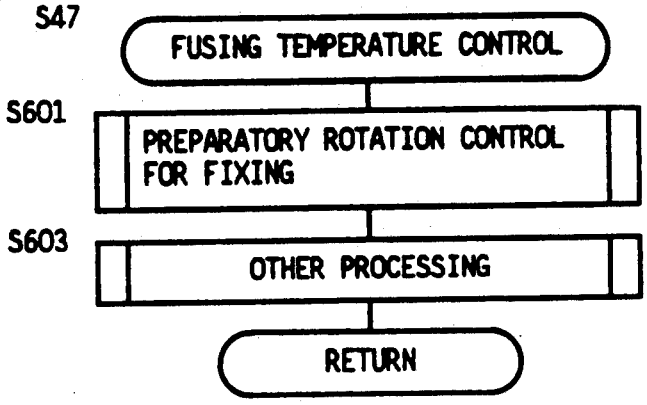
FIG. 22 is a flow chart showing the processing of fusing temperature control routine (S47) in the FIG. 18.
Figure 23:
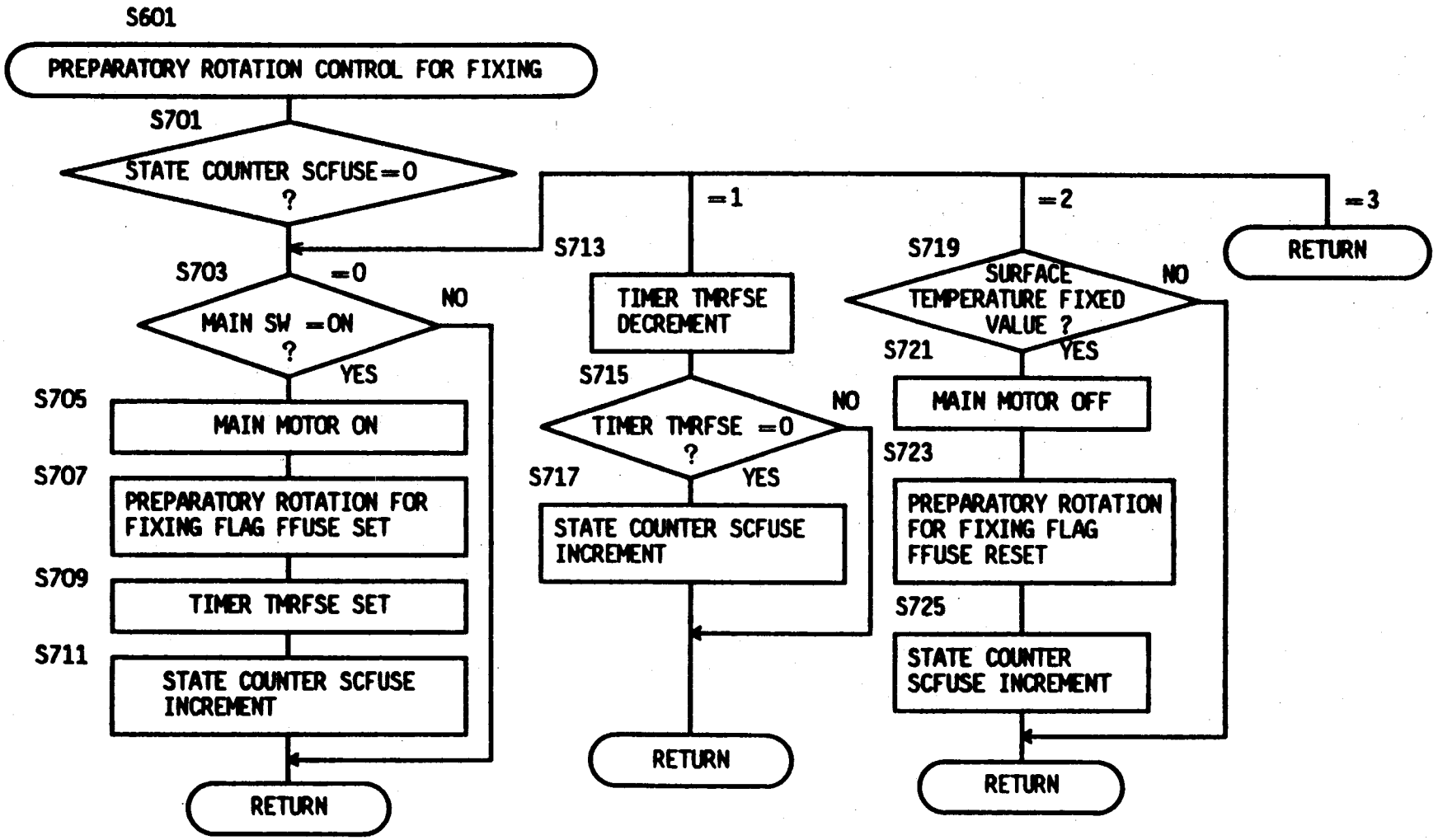
FIG. 23 is a flow chart showing the processing of preparatory rotation control for fixing (S601) in the FIG. 22.

FIG. 22 is a flowchart showing the fusing temperature control routine (S47) which is in the main routine of the CPU 201, and FIG. 23 is a flowchart showing the preparatory rotation control routine for fusing operation (S601) which is in the fusing temperature control routine (S47). In the fusing temperature control routine, temperature adjustment of the fixing device 48 is performed with a process for quickly unifying the temperature of fixing roller through the preparatory rotation control routine for fusing.

The preparatory rotation control routing for fusing (S601) will now be described below.

At step S701, judgment is made on a state counter SCFUSE provided for the preparatory rotation control process, and in accordance with the result of judgment, the program proceeds to either one of step S703 (SCFUSE=0), or step S713 (SCFUSE=1), or step S719 (SCFUSE=2). In the case of SCFUSE=3, the program returns to the fusing temperature control routine.

.SCFUSE=0

Indicates a stand by for the time the main switch is turned on. When turning on of the main switch is detected (S703: Yes), the main motor 41 is turned on (S705) and a flag of preparatory rotation for fusing FFUSE is set (S707). Further, the preparatory rotation timer counter TMRFSE is set (S709) and the state counter SCFUSE is increased (S711), and then, the program returns to the fusing temperature control routine.

.SCFUSE=1

The preparatory rotation timer counter TMRFSE is decreased each time (S713), and when the preparatory rotation timer counter TMRFSE became 0 (S715: Yes), the state counter SCFUSE is increased (S717). In other words, the preparatory rotation for fusing operation is kept continuing at least for the time regulated by the preparatory rotation timer counter TMRFSE.

.SCFUSE=2

When the surface temperature of fixing roller reaches a predetermined temperature (S719: Yes), the main motor is turned off (S721). Then, the preparatory rotation for fusing flag FFUSE is reset (S723), and the state counter SCFUSE is increased (S723). The preparatory rotation for fusing is thus finished.

(3) Trouble Processing Routine

Figure 24:
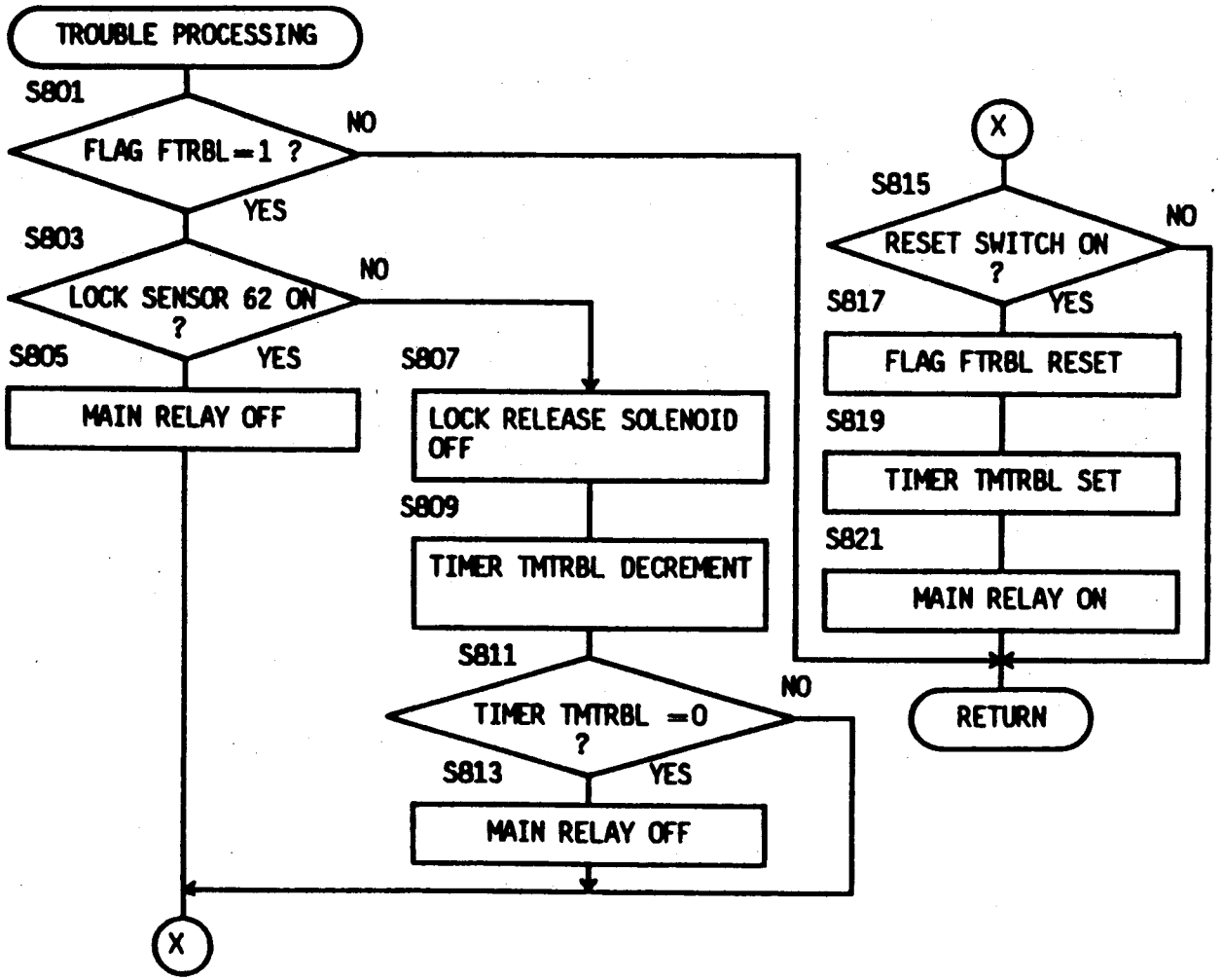
FIG. 24 is a flow chart of trouble processing routine executed in other processing (S57) in the FIG. 18.
Figure 25:
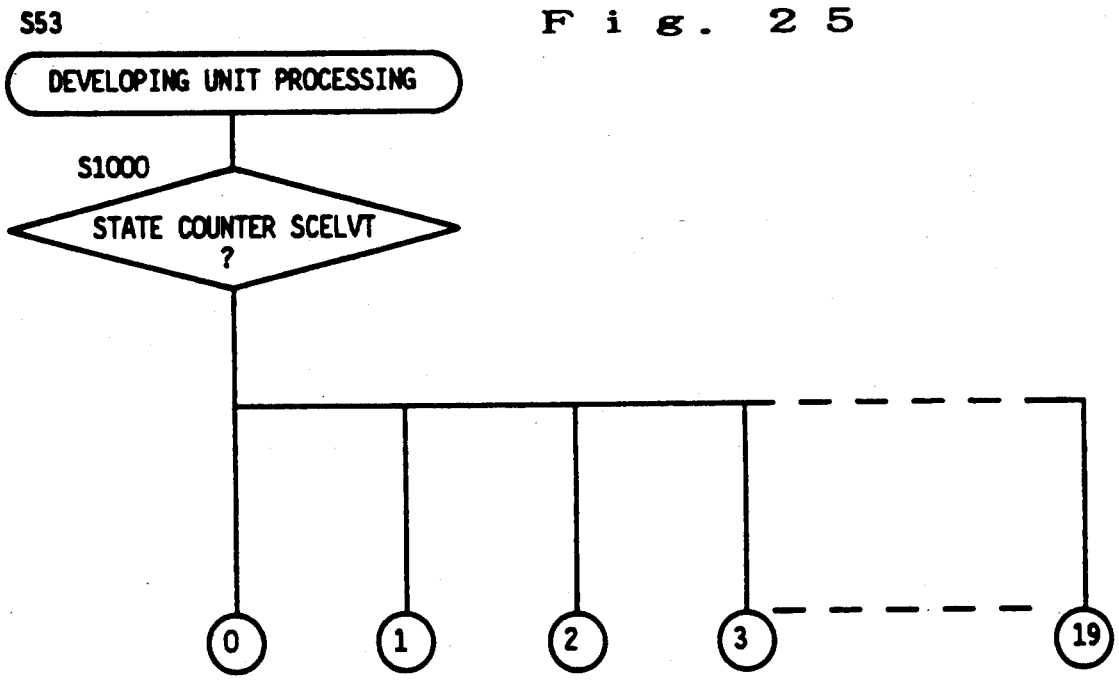
FIGS. 25 through 45 are flow charts showing the processing under color mode in a developing unit processing routine (S53) in the FIG. 18.
Figure 26:
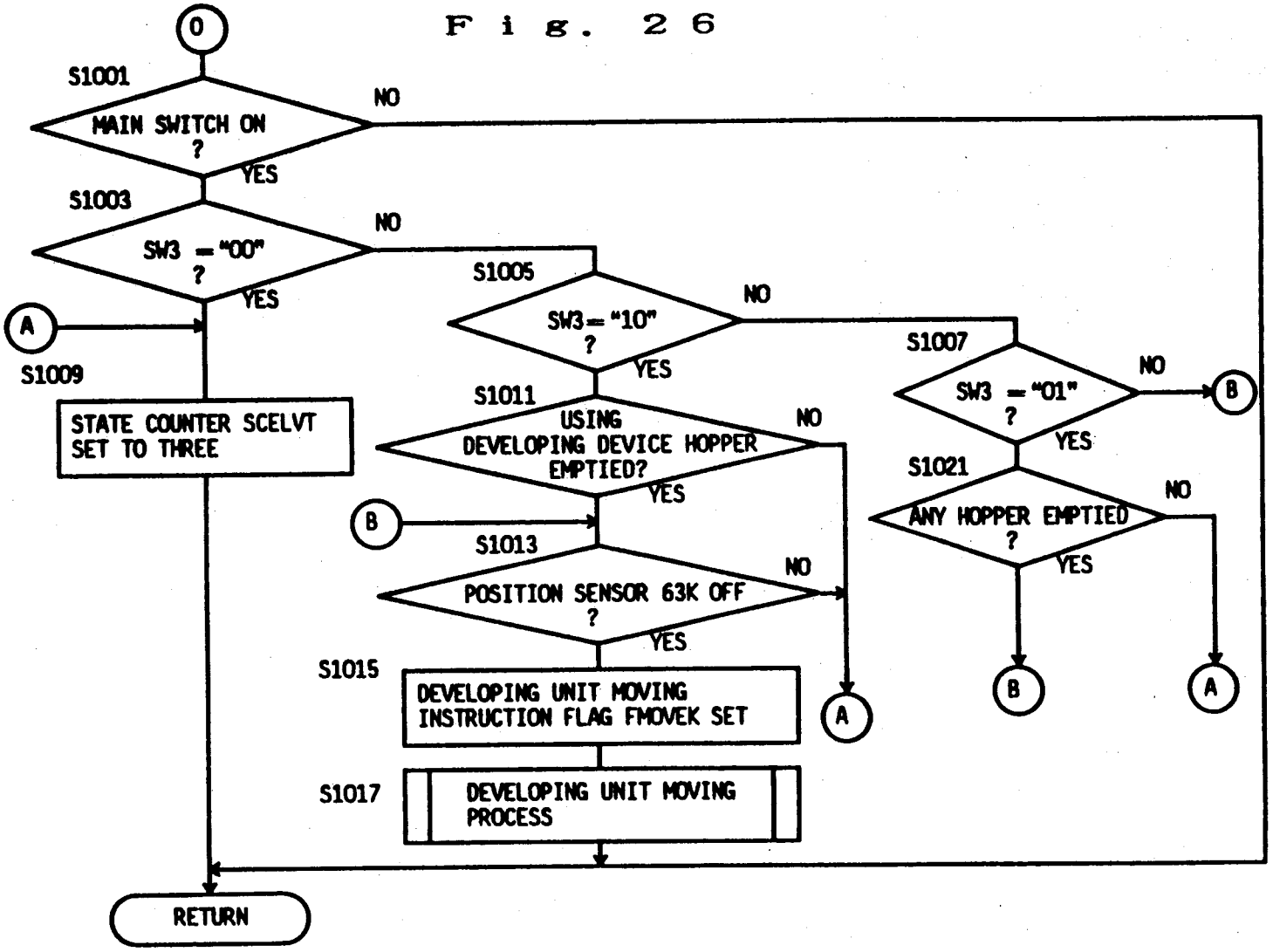
Figure 27:
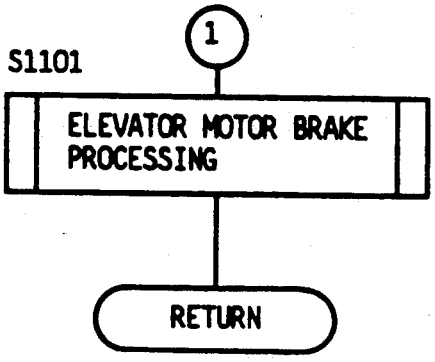
Figure 28:
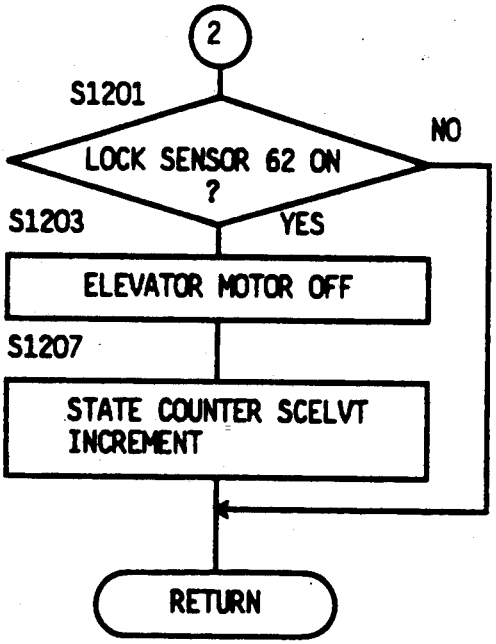
Figure 29:
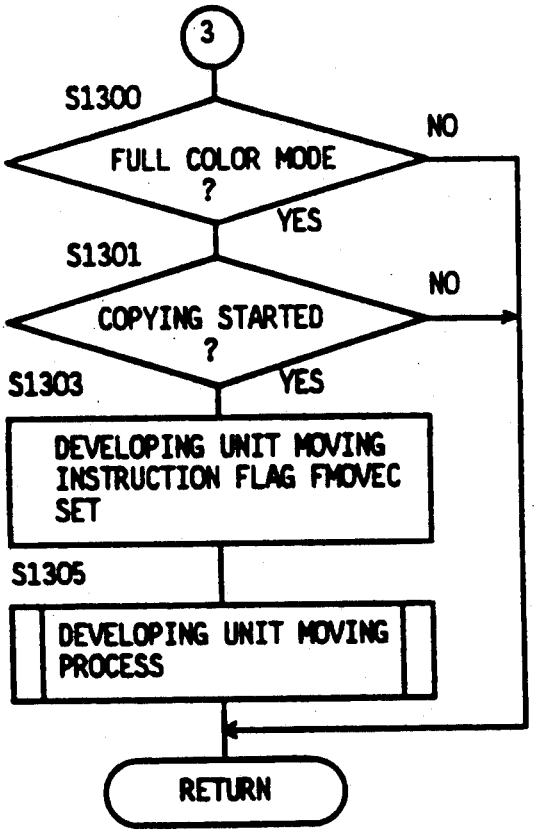
Figure 30:
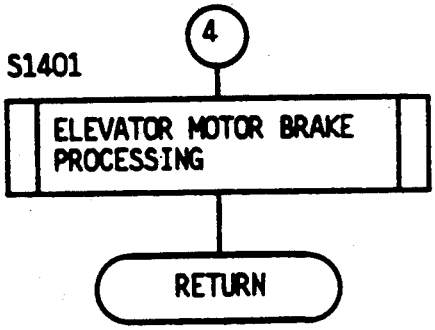
Figure 31:
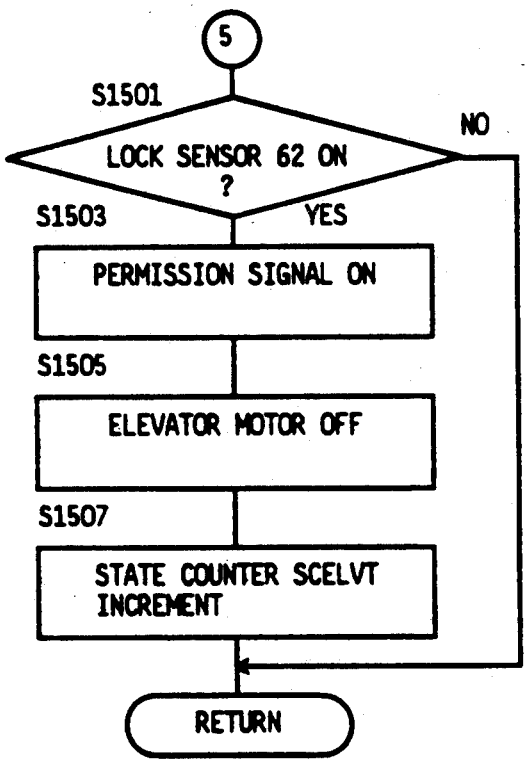
Figure 32:
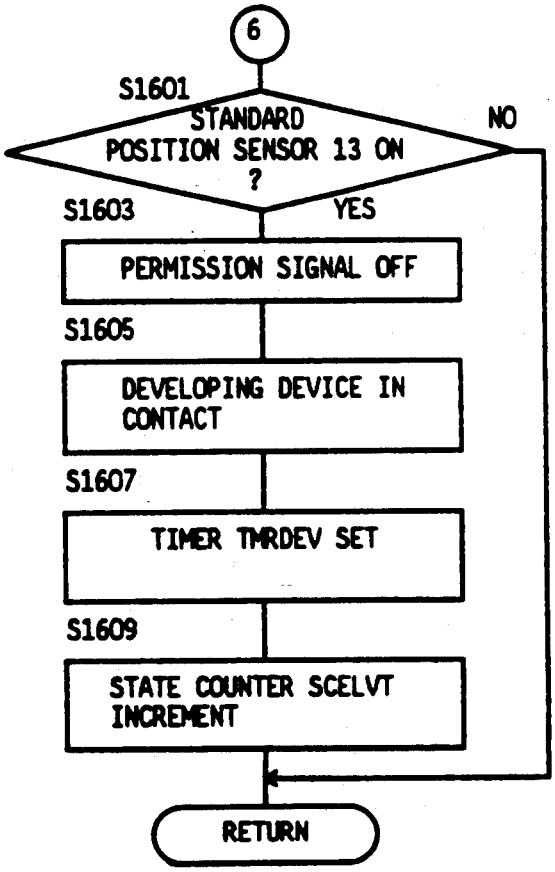
Figure 33:
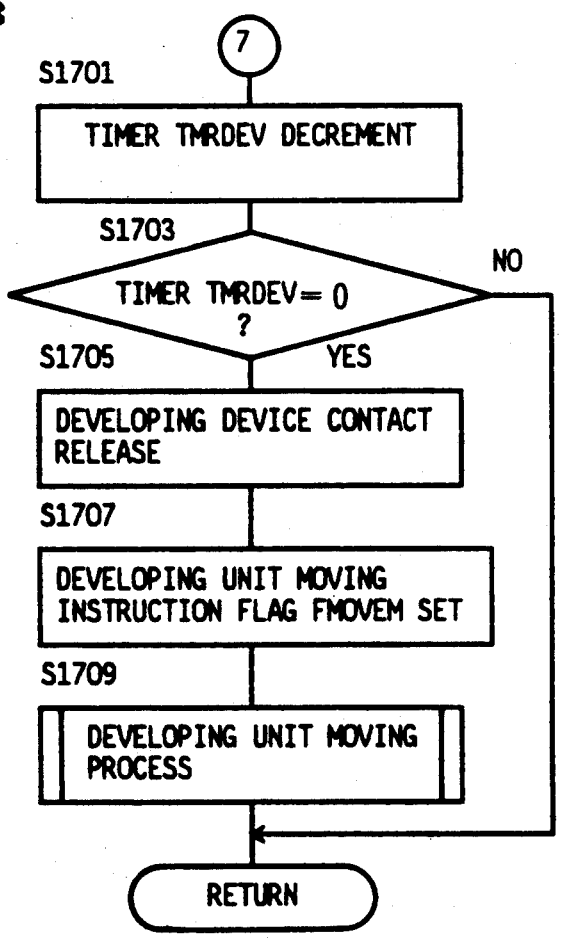
Figure 34:
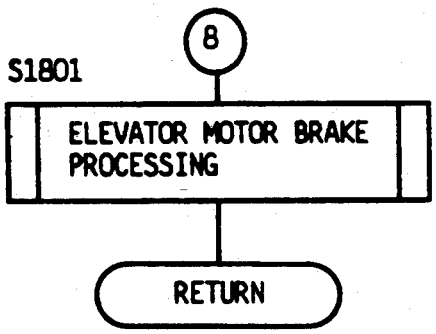
Figure 35:
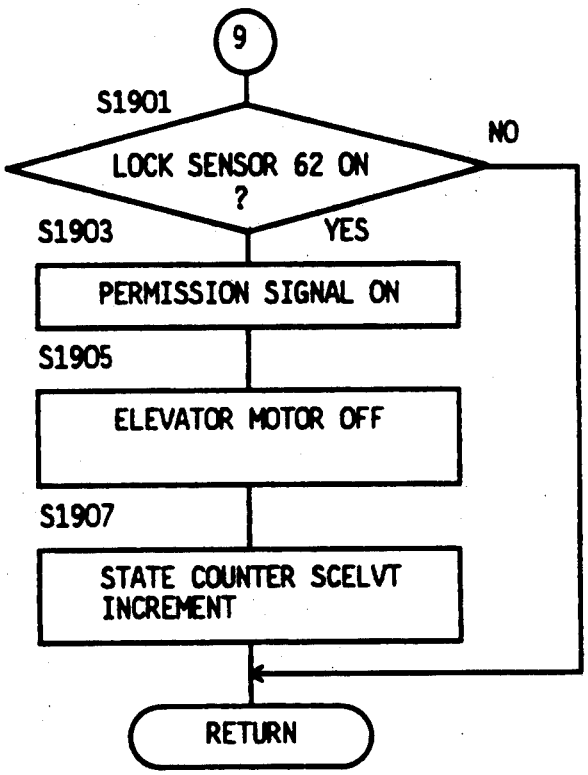
Figure 36:
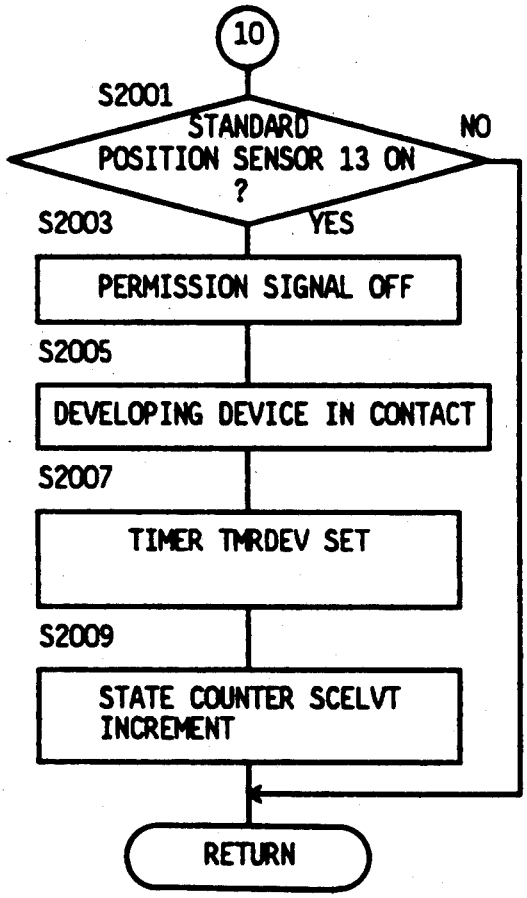
Figure 37:
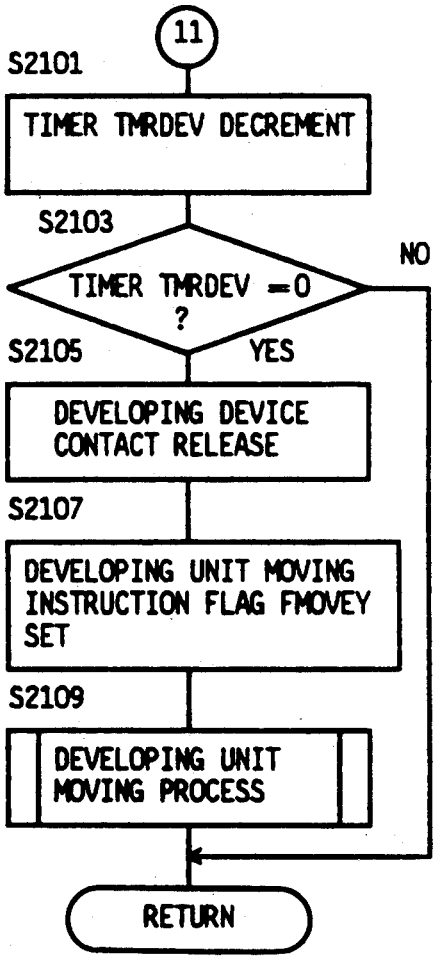
Figure 38:
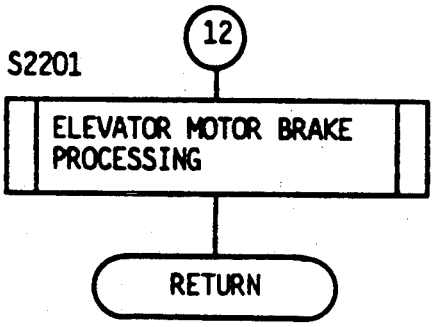
Figure 39:
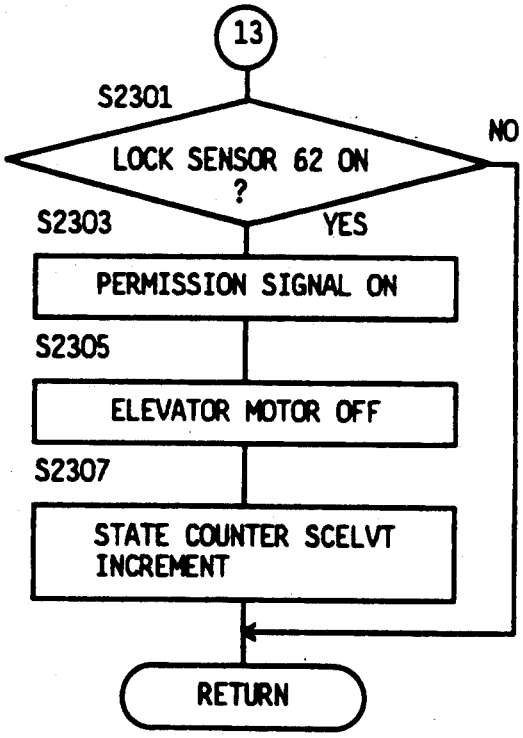
Figure 40:
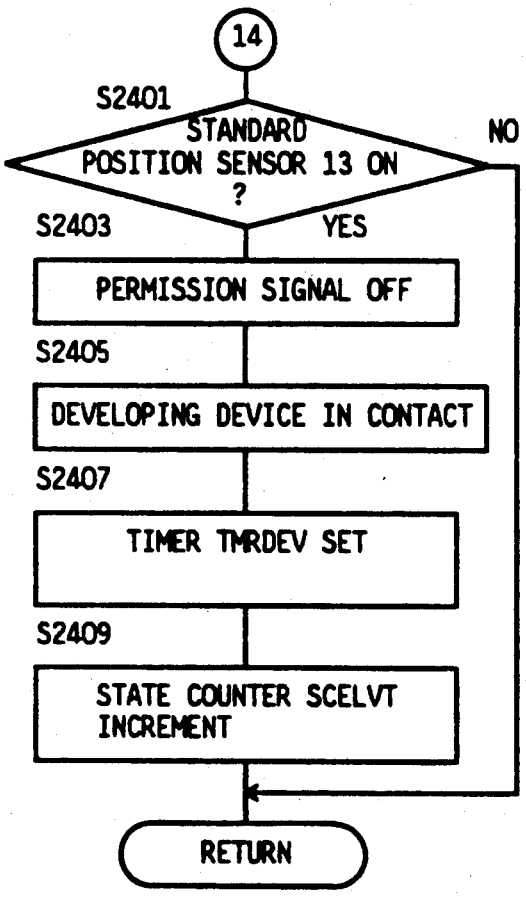
Figure 41:
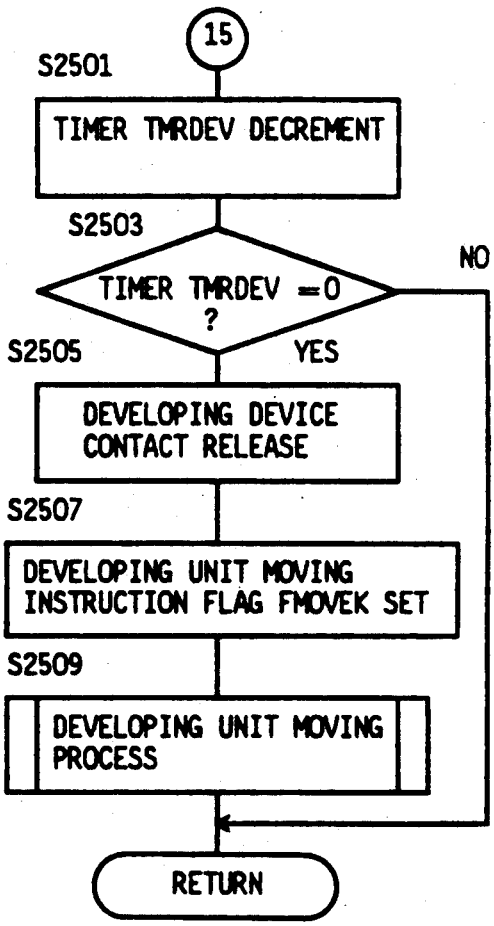
Figure 42:
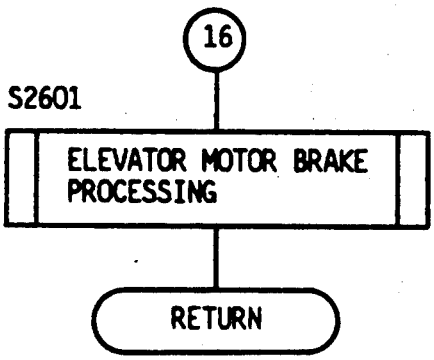
Figure 43:
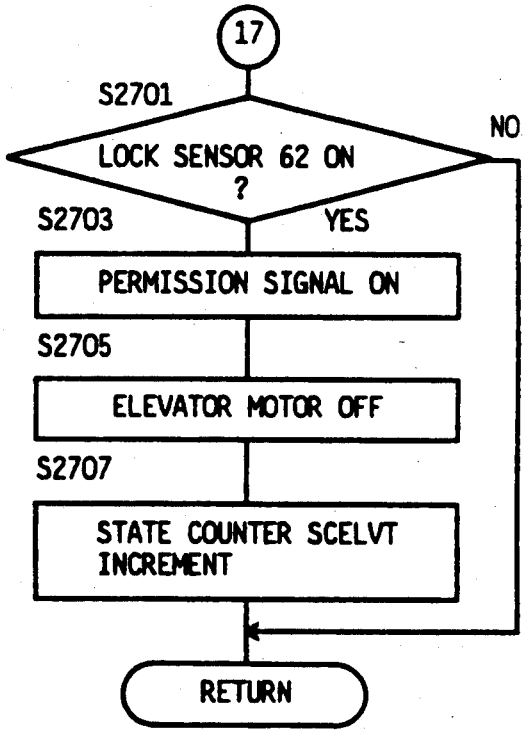
Figure 44:
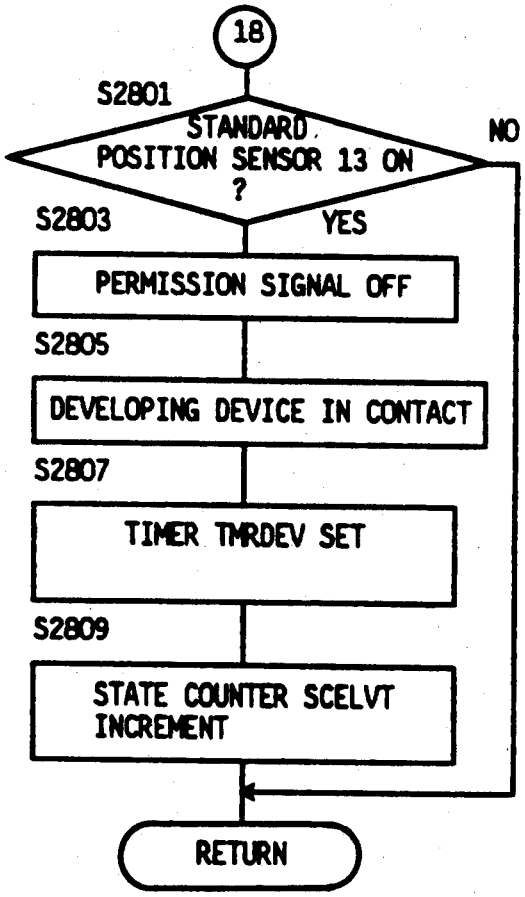
Figure 45:
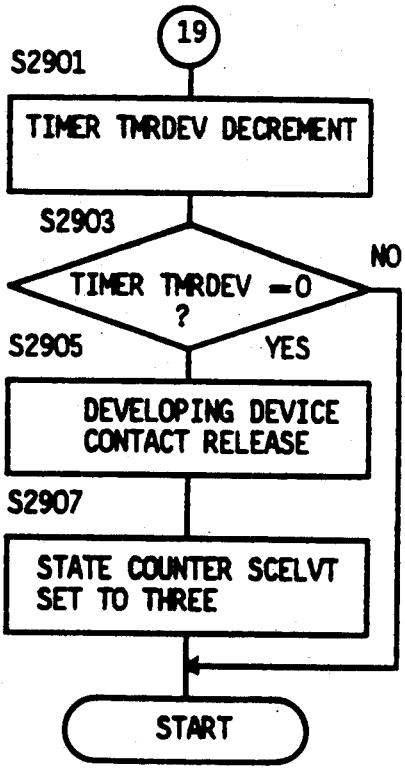
Figure 46:
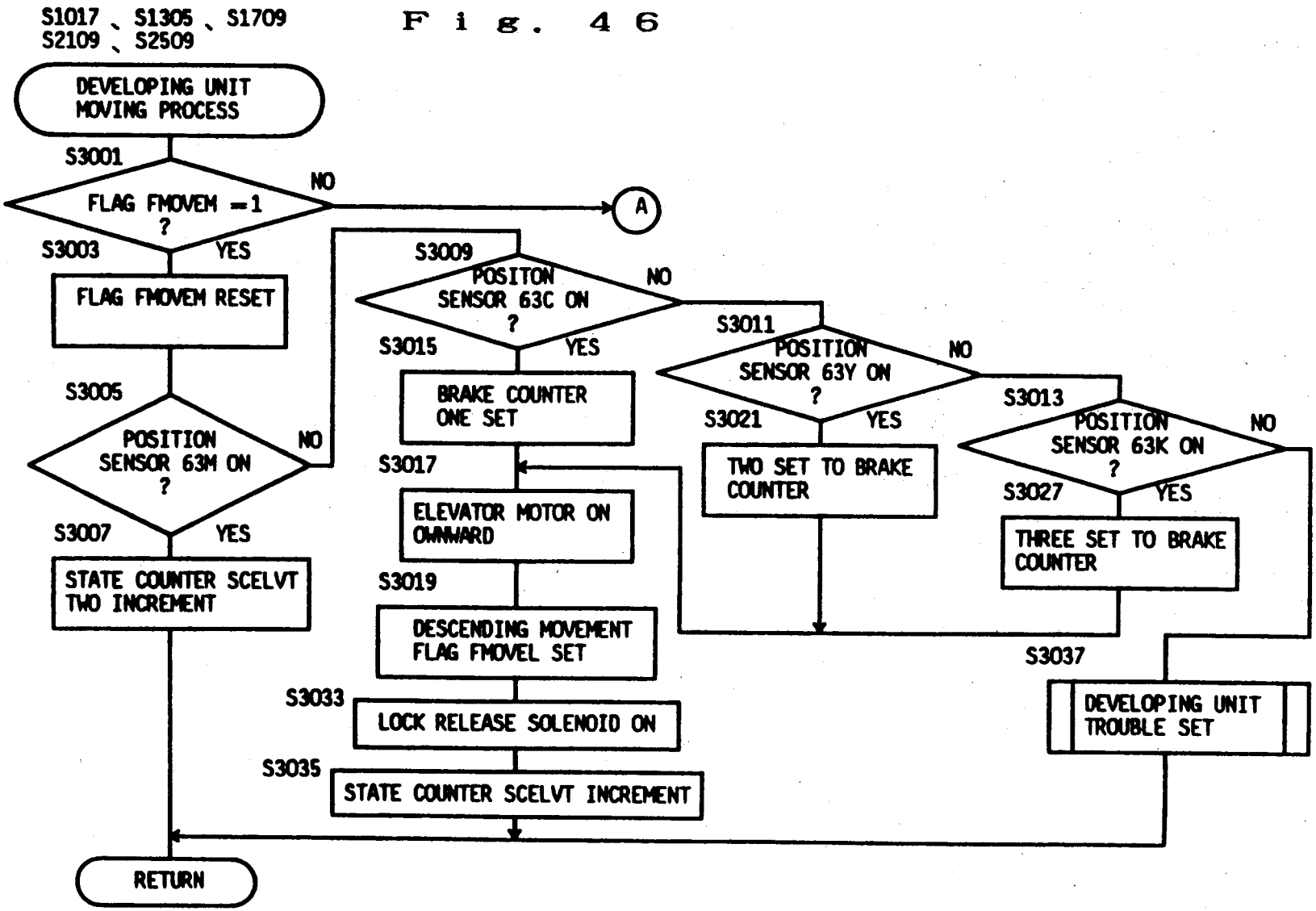
FIGS. 46 through 49 are flow charts showing the developing unit movement process under full color mode which is called at S1017, S1305, S1709, S2109, S2509 in the developing unit processing routine (FIGS. 25 through 45).
Figure 47:
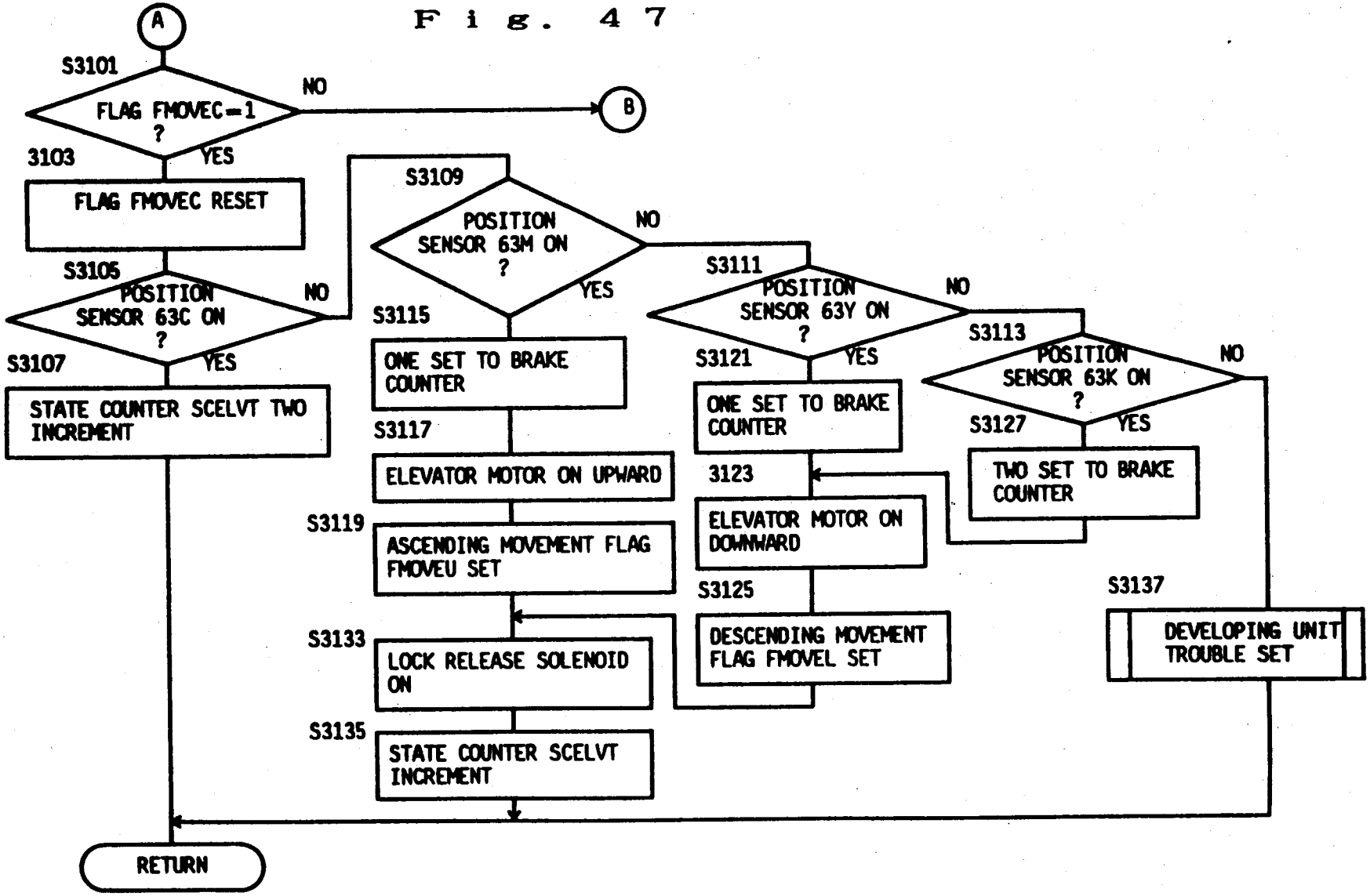
Figure 48:
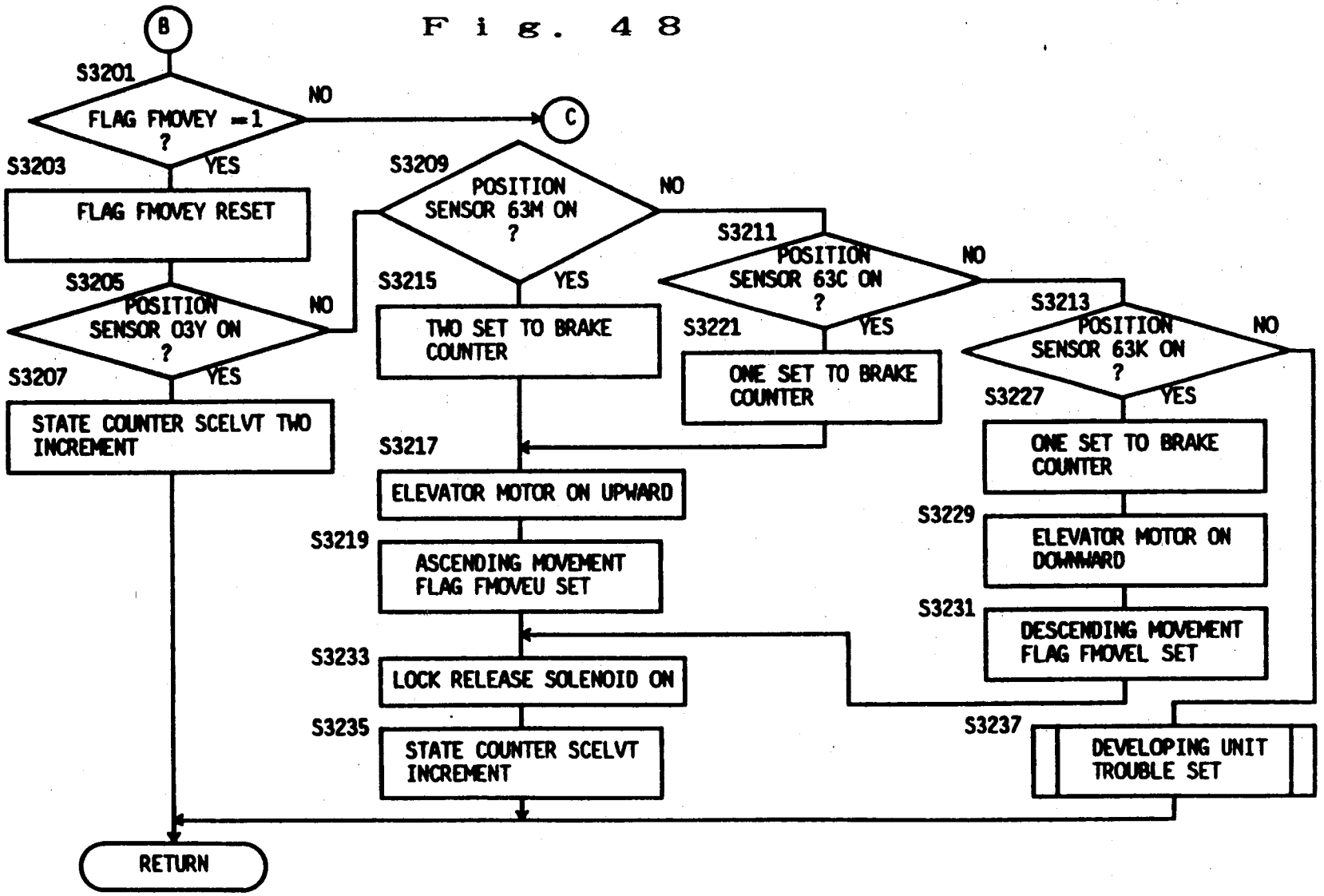
Figure 49:
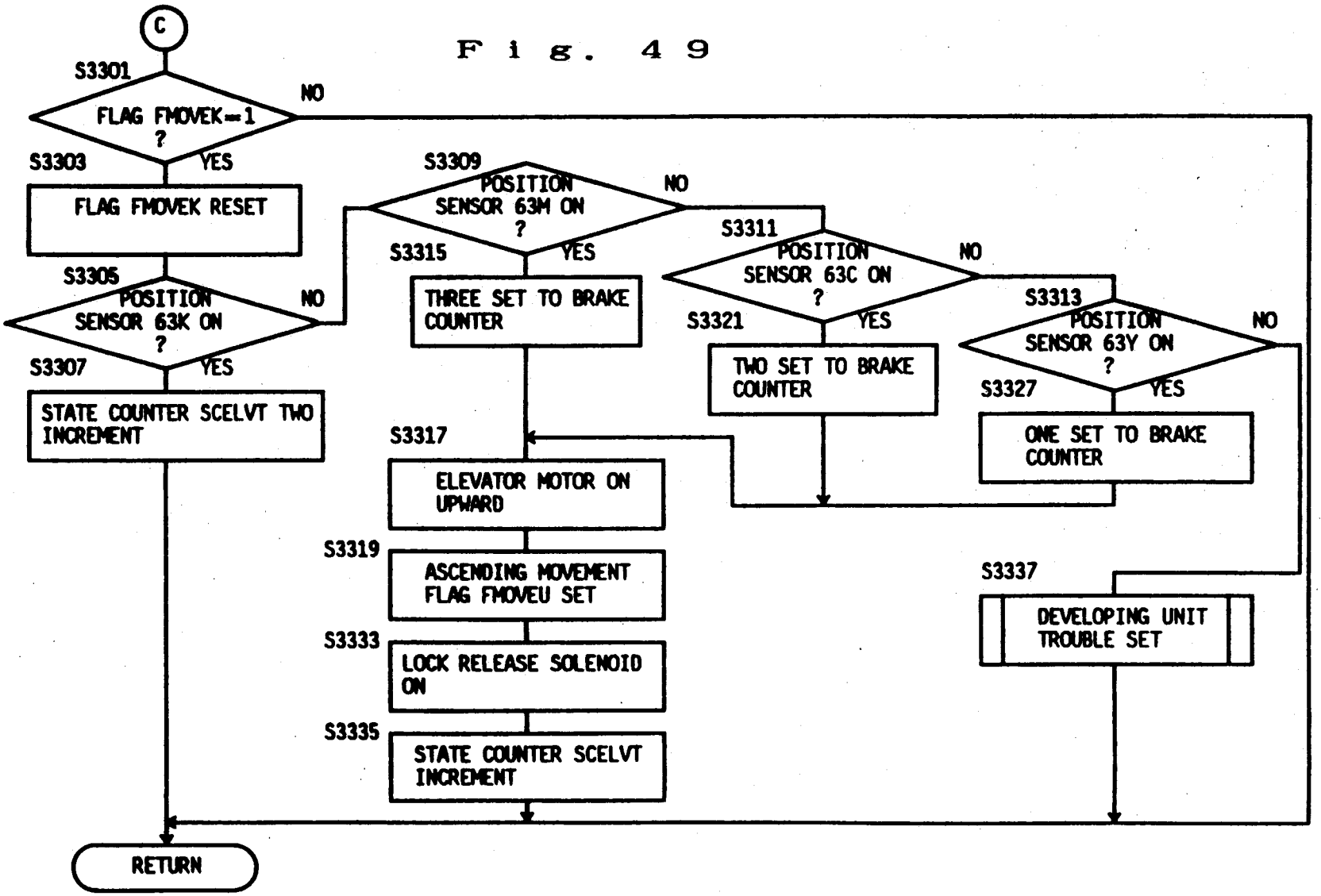

FIG. 24 is a flowchart showing the trouble processing routine which is executed in the other process (S57) of the CPU 201.

(i) Firstly, description will be made on a trouble processing routine for turning off the main relay of the power source when trouble such as jamming has occurred.

Steps S801 through S813 deal with a case when trouble has occurred. Firstly, judgment is made on a trouble or interruption of the copying process flag FTRBL (S801). When the trouble flag FTRBL is set (S801: Yes), judgment is made on a lock sensor 62, and when the lock sensor 62 is turned on (S803: Yes), in other words, when any one of the developing devices is already positioned at the developing position, the main relay is immediately turned off and the power circuit is cut off (S805).

On the other hand, when the lock sensor 62 is turned off at step S803, in other words, when the developing unit 6 is in the process of movement (S803: No), the lock releasing solenoid 64 is turned off in order to stop the moving developing unit 6 at the nearest developing position (S807). Further, the trouble timer counter TMTRBL which is set at a predetermined value is decreased at every routine (S809). If the developing unit 6 does not stop at the nearest developing position and the lock sensor 62 is not turned on even if a predetermined time has passed after the trouble has occurred, the main relay is turned off (S813) at the finishing timing of the trouble timer counter TMTRBL (S811: Yes).

Steps S815 through S821 are the processing performed after the trouble processing routine is reset.

When a predetermined trouble reset switch is turned on (S815: Yes), the trouble flag FTRBL is reset (S817), and the trouble timer counter TMTRBL is set (S819). While, the main relay is turned on (S821). The trouble timer counter TMTRBL is decreased only when the trouble flag FTRBL is set as described above. The control for turning off the main relay when trouble has occurred is thus performed.

(4) Developing Unit Process Routine (S53)

FIGS. 25 through 45 are flowcharts showing a developing unit process routine which is called in the main routine of the CPU 201. In this routine, vertical movement and suspension of the developing unit 6, and pressing and releasing operation of the developing devices are controlled. The routine deals with a color developing process wherein four colors of cyan, magenta, yellow, and black are used, and when an image forming process is finished, the developing unit 6 is positioned at the home position, which is an initialized position. Description will be made later for a case when only one colored toner is used.

Control action is performed by converting processing in accordance with the value of the state counter SCELVT provided for developing unit process. In the FIGS. 25 through 45, numerals in the connector circles represent the value of the state counter SCELVT.

Firstly, at step S1000, judgment is made on the value of the state counter SCELVT.

(a) SCELVT=0

Indicates a stand by state for the turning on of the main switch SW1 (S1001). When ON-edge of the main switch SW1 is detected (S1001: Yes), judgment is made on a setting state of the dip switch SW3 (S1003, S1005, S1007). The dip switch SW3 comprises two change-over switches, and with their on-off combination, one of the four modes of "00", "10", "01", and "11" is preliminarily set. Each mode is defined as follows.

"00": This is a mode for not performing returning action to the home position

"10": This is a mode for performing returning action to the home position when a color to be used when a selected developing mode is found emptied.

"01": This is a mode for performing returning action to the home position when there is a hopper in which toner is emptied.

"11": This is a mode for surely performing returning action to the home position.

As a result of the judgment on the dip switch SW3, when the dip switch SW3 is under the mode of:

(i) "00" (S1003: Yes), the state counter SCELVT is set at 3 (S1009) since the returning action to the home position is not performed, and wait for the time of starting copying operation.

(ii) "10" (S1005: Yes), firstly, judgment is made whether or not there is a color empty among the colors to be used for development (S1011). The colors to be used for development includes four colors of cyan, magenta, yellow and black in the case of color mode, and in the case of composite color mode, it includes two colors among the colors of cyan, magenta and yellow (magenta and yellow (Red), or cyan and magenta (Blue), or yellow and cyan (Green). In the case of monocolor mode, it means one of the colors of cyan, magenta, yellow or black.

Now, description will be made on the color mode operation. As a result of the judgment made at step S1011, when there is no empty state among the colors to be used for development (S1011: No), the program proceeds to step S1009 since toner replenishment is not necessary, and the state counter SCELVT is set at 3 to wait for the start of copying operation.

On the other hand, when there is a color which is empty among the colors to be used for development as a result of judgment made at step S1011 (S1011: Yes), the program proceeds to step S1013 and judgment is made whether or not the developing unit 6 is positioned at the home position. When the unit is positioned at the home position (S1013: No), the program proceeds to step S1009 since the movement of the developing unit 6 is not necessary, and the state counter SCELVT is set at 3 to wait for the start of copying operation.

When judgment is made at step S1013 that the unit is not positioned at the home position (S1013: Yes), a developing unit moving instruction flag FMOVEK is set to move the developing unit 6 to the home position (S1015) and a developing unit moving process is executed.

The developing unit moving process routine is provided for moving the developing unit 6 to a position designated by the developing unit moving instruction flag, and when the movement to a designated position is set, the value of the state counter SCELVT is increased.

(iii) "01" (S1007: Yes), firstly, judgment is made whether or not there is a color emptied among the developing colors regardless of use or non-use (S1021). When there is not any color emptied (S1021: No), the program moves to step S1009 since toner replenishment is not necessary, and the state counter SCELVT is set at 3 to wait for the start of copying operation. On the other hand, when judgment is made at step S1021 that there is more than one color emptied among the colors to be used for development (S1021: Yes), the program proceeds to steps after step S1013, and moving process to the home position is performed on the condition that the unit is not positioned at the home position (S1013 through S1019), and the value of the state counter SCELVT is increased.

(iv) "11" (S1007: No), returning action to the home position is performed regardless of whether toner is emptied or not. In other words, the program moves to the steps after step S1013, and moving process to the home position is performed on the condition that developing unit 6 is not positioned at the home position yet (S1013 through S1019), and the value of the state counter SCELVT is increased. Thus, the selection of actions for returning or non-returning the developing unit 6 is controlled when the main switch SW1 is turned on in accordance with the setting state of the dip switch SW3.

At the step S1013, the state when the developing unit is not positioned at the home position is the case that the preceding copying operation is performed under composite monocolor mode or monocolor mode (refer to FIGS. 51 through 58), or the case the developing unit is stopped at a position other than the home position because of occurrence of trouble or problems during the movement of the developing unit.

(b) SCELVT=1

Elevator motor brake process routine is executed (S1101). The elevator motor brake process routine is a process for stopping the developing unit at a position designated by braking the unit during its moving action. When the braking is set, the value of the state counter SCELVT is increased.

(c) SCELVT=2

Stand by for the returning action of the developing unit 6 to the home position. When the developing unit lock sensor 62 is turned on upon returning to the home position (S1201: Yes), the developing unit motor 61 is turned off (S1203). Thereafter, the state counter SCELVT is increased (S1207) to wait for the start of copying operation.

(d) SCELVT=3

On condition of the color mode (S1300: Yes), stand by for the start of copying operation. When the start of copying operation is detected (S1301: Yes), a developing unit moving flag FMOVEC is set to move the cyan developing device 6C to the developing position (S1303), and the developing unit moving process routine is executed (S1305). When the movement to the cyan developing position is set, the value of the state counter SCELVT is increased.

(e) SCELVT=4

Elevator motor brake process routine is executed (S1401). In this case, a process for stopping the cyan developing device 6C at the developing position is executed. When braking is set, the value of the state counter SCELVT is increased.

(f) SCELVT=5

Stand by for positioning of cyan developing device 6C at the developing position. When the developing unit lock sensor 62 is turned on upon positioning the cyan developing device 6C at the developing position (S1501: Yes), a permission signal to a logical gate 250 (FIG. 15) is turned on (S1503), and at the same time, the developing unit motor 61 is turned off (S1505). Further, the state counter SCELVT is increased (S1507) to wait for the developing device to come in contact.

The permission signal functions in a manner which will be described below.

Figure 15:
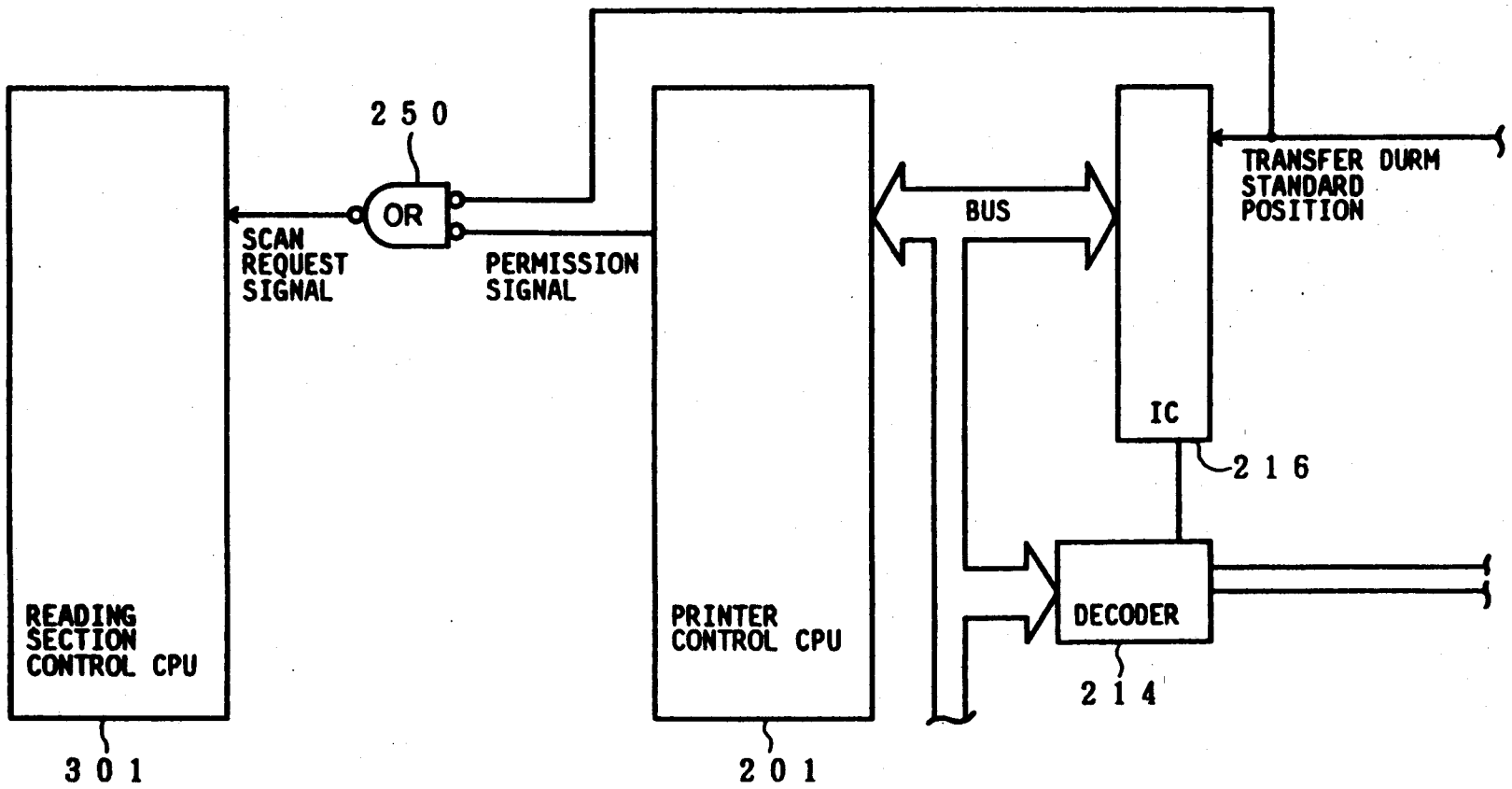
FIG. 15 is an explanatory view showing a function of permission signal.

A scan request signal to the CPU 301 is transmitted from the logical gate 250 as illustrated in FIG. 15 when the transfer drum 10 is positioned at a standard position with the permission signal turned on (the state the transfer drum 10 is positioned at the standard position is detected by turning on the standard position sensor 13).

Accordingly, in case when the permission signal is turned off even if the transfer drum 10 is at the standard position, that is, when movement of the developing unit 6 is not finished, the scan request is not emitted and exposure scanning is not started either. Since the copying machine is provided with a mechanism to perform developing operation by converting developing devices with the movement of the developing unit, the machine is prevented from starting scanning action for image exposure before preparation of developing operation is completed.

(g) SCELVT=6

Stand by for the turning on of the standard position sensor 13 (S1601). At step S1601, when the standard position sensor 13 is turned on (S1601: Yes), permission signal is turned off (S1603) in order not to emit scan request signal every time when the transfer drum 10 make one round of rotation. The cyan developing device 6C is pressed to come in contact with the photoconductive drum 4 (S1605). The timing for pressing the device is, as it is understood from the description made above, sufficiently before the leading end of original image (SG) is exposed. Since the photoconductive drum 4 is somewhat vibrated when the developing device is pressed thereto, an electrostatic latent image to be written is disarranged if the pressing action is made at the time of image exposure process. This is the reason why the pressing action is conducted at a time sufficiently before the leading end of original image is exposed. At step S1607, a timer counter in developing process TMRDEV is set, and further at step S1609, the state counter SCELVT is increased.

(h) SCELVT=7

The timer counter in developing process TMRDEV is decreased at each round of routine (S1701). When the timer counter TMRDEV is time up upon completion of the developing process (S1703: Yes), the pressing state of the cyan developing device 6C in contact with the photoconductive drum 4 is released (S1705). A developing unit movement flag FMOVEM is set in order to move the magenta developing device 6M to the developing position (S1707), and a developing unit movement process routine is executed (S1709). When the movement to the magenta developing position is set, the value of the state counter SCELVT is increased.

(i) SCELVT=8

An elevator motor brake process routine is executed (S1801). In this case, a process for stopping the magenta developing device 6M at the developing position is performed. When the braking is set, the value of the state counter SCELVT is increased.

(j) SCELVT=9

Indicates stand by for the time the magenta developing device 6M is positioned at the developing position. When the device is positioned and the developing unit lock sensor 62 is turned on (S1901: Yes), a permission signal to the logical gate 250 (FIG. 15) is turned on (S1903), and at the same time, the developing unit moving motor 61 is turned off (S1905). Further, the state counter SCELVT is increased (S1907) to wait for the developing device to come in contact with the drum.

(k) SCELVT=10

Indicates stand by for the time the standard position sensor 13 is turned on (S2001).

At step S2001, when the standard position sensor 13 is turned on (S2001: Yes), a permission signal is turned off (S2003). And, the magenta developing device 6M is pressed in contact with the photoconductive drum 4 (S2005). At step S2007, the timer counter in developing process TMRDEV is set, and at step S2009, the state counter SCELVT is increased to wait for the completion of developing process by the magenta developing device 6M.

(l) SCELVT=11

The timer counter in developing process TMRDEV is increased at every round of one routine (S2101). When the timer counter in developing process TMRDEV is time up on completion of developing process (S2103: Yes), the pressing state of the magenta developing device 6M in contact with the photoconductive drum 4 is released (S2105).

A developing unit movement flag FMOVEY is set in order to move the yellow developing device 6Y to the developing position (S2107), and a developing unit moving process routine is executed (S2103). When the movement to the yellow developing position is set, the value of the state counter SCELVT is increased.

(m) SCELVT=12

An elevator motor brake process routine is executed (S2201). In this case, a process is performed for stopping the yellow developing device 6Y at the developing position. When the braking is set, the value of the state counter SCELVT is increased.

(n) SCELVT=13

Stand by for the time the yellow developing device 6Y is positioned at the developing position. When the positioning is performed and the developing unit lock sensor 62 is turned on (S2301: Yes), a permission signal to the logical gate 250 (FIG. 15) is turned on (S2303), and at the same time, the developing unit motor 61 is turned off (S2305). Further, the state counter SCELVT is increased (S2307) to wait for the time the developing device comes in contact with the drum.

(o) SCELVT=14

Stand by for the time the standard position sensor 13 is turned on (S2401).

At step S2401, when the standard position sensor 13 is turned on (S2401: Yes), a permission signal is turned off (S2403). And, the yellow developing device 6Y is pressed in contact with the photoconductive drum 4 (S2405). At step S2407, the timer counter in developing process TMRDEV is set, and further at step S2409, the state counter SCELVT is increased to wait for the time the yellow developing device 6Y completes its developing process.

(p) SCELVT=15

The timer counter in developing process TMRDEV is decreased at each round of one routine (S2501). When the timer counter in developing process TMRDEV is time up on completion of the developing process (S2503: Yes), the pressing state of the yellow developing device 6Y in contact with the photoconductive drum 4 is released (S2505).

A developing unit movement flag FMOVEK is set in order to move the black developing device 6K to the developing position (S2507), and a developing unit moving process routine is executed (S2509). When the movement to the black developing position is set, the value of the state counter SCELVT is increased.

(q) SCELVT=16

An elevator motor brake process routine is executed (S2601). In this case, a process for stopping the black developing device 6K at the developing position is performed. When the braking is set, the value of the state counter SCELVT is increased.

(r) SCELVT=17

Stand by for the time the black developing device 6K is positioned at the developing position. When the positioning is performed and the developing unit lock sensor 62 is turned on (S2701: Yes), a permission signal to the logical gate 250 (FIG. 15) is turned on (S2703), and at the same time, the developing unit motor 61 is turned off (S2705). Further, the state counter SCELVT is increased (S2707) to wait for the developing device to be pressed.

(s) SCELVT=18

Stand by for the time the standard position sensor 13 is turned on (S2801). At step S2801, when the standard position sensor 13 is turned on (S2801: Yes), a permission signal is turned off (S2803). And, the black developing device 6K is pressed in contact with the photoconductive drum 4 (S2805). At step S2807, the timer counter in developing process TMRDEV is set, and further at step S2809, the state counter SCELVT is increased to wait for the completion of developing process by the black developing device 6K.

(t) SCELVT=19

The timer counter in developing process TMRDEV is decreased at each round of one routine (S2901). When the timer counter in developing process TMRDEV is time up on completion of the developing process (S2903: Yes), the pressing state of the black developing device 6K in contact with the photoconductive drum 4 is released (S2905). Further, the state counter SCELVT is set at 3 with two increment in order to be ready for the next round of copying operation (S2907).

(5) Developing Unit Moving Process Routine

Now, description will be made on the developing unit moving process routine which is called in the developing unit process of FIGS. 46 through 49.

(i) Magenta Developing Device 6M

Steps S3001 through S3037 are process for moving the magenta developing device 6M to the developing position. When FMOVEM is set as a developing unit movement flag (S3001: Yes), the flag FMOVEM is reset (S3003), and then, judgment is made which of the developing devices is positioned at the developing position (S3005, S3009, S3011, S3013). In case when the magenta developing device 6M is detected at the developing position (S3005: Yes), the developing unit process state counter SCELVT is set at 3 since the movement of the devices is not necessary (S3007).

When the cyan developing device 6C is at the developing position (S3009: Yes), it may be handled to move down the developing unit by one developing device only as is clear from the FIG. 3. One is, therefore, substituted for a brake counter (S3017). Description will be made of the brake counter later. The developing unit motor 61 is turned on to the descending direction (S3017), and a descending direction movement flag FMOVEL is set (S3019). The lock release solenoid 64 is also turned on to separate the lock member 68 from the lock receiving board 69 (S3033). Thereafter, the state counter SCELVT is increased (S3035).

When the yellow developing device 6Y is at the developing position (S3011: Yes), two is substituted for the brake counter since the developing unit has to be moved down by two developing devices (S3021), and thereafter, process for steps S3017, S3019, S3033, and S3035 are performed.

When the black developing device 6K is at the developing position (S3013: Yes), three is substituted for the brake counter since the developing unit has to be moved down by three developing devices (S3027), and thereafter, process for steps S3017, S3019, S3033, and S3035 are performed.

When there is no developing device at the developing position, a developing unit trouble or problem set routine is performed since it is an unusual state (S3037) for no developing device to be present.

ii) Cyan Developing Device 6C

At steps S3101 through S3137, a process for moving the cyan developing device 6C to the developing position is performed. When FMOVEC is set as a developing unit movement flag (S3101: Yes), the flag FMOVEC is reset (S3103), and then, judgment is made as to which developing device is at the developing position (S3105, S3109, S3111, S3113).

When the cyan developing device 6C is at the developing position (S3105: Yes), two is increased to the developing unit process state counter SCELVT to set it at 3 (S3107) since the movement of the unit is not necessary.

When the magenta developing device 6M is at the developing position (S3109: Yes), one is substituted for the brake counter since it is only necessary to move down the developing unit by one developing device only (S3115), and the developing unit motor 61 is turned on to the ascending direction (S3117) and an ascending direction movement flag FMOVEU is set (S3119). The lock release solenoid 64 is turned on to separate the lock member 68 from the lock receiving board 69 (S3113), and then, the state counter SCELVT is increased (S3135).

When the yellow developing device 6Y is at the developing position (S3111: Yes), one is substituted for the brake counter since it is only necessary to move down the developing unit by one developing device only (S3121), and then, the developing unit motor 61 is turned on to the descending direction (S3123) to set a descending direction movement flag FMOVEL (S3125). Thereafter, process of the S3133 and S3135 are performed.

When the black developing device 6K is at the developing position (S3113: Yes), two is substituted for the brake counter since it is only necessary to move down the developing unit by two developing devices only (S3127), and then, the developing unit motor 61 is turned on to the descending direction (S3123) to set a descending direction movement flag FMOVEL (S3125). Thereafter, process of the S3133 and S3135 are performed.

When there is no developing device at the developing position, a developing unit trouble or problem set routine is executed since it is an usual state (S3137) for no developing device to be present.

(iii) Yellow Developing Device 6Y

Steps S3201 through S3237 are processes for moving the yellow developing device 6Y to the developing position. When FMOVEY is set as a developing unit movement flag (S3201: Yes), the flag FMOVEY is reset (S3203), and then, judgment is made as to which of the developing devices is positioned at the developing position (S3205, S3209, S3211, S3213). In case when the yellow developing device 6Y is detected at the developing position (S3205: Yes), the developing unit process state counter is set at 3 with increment of two since the movement of the device is not necessary (S3207), and wait for the start of copying operation.

When the magenta developing device 6M is at the developing position (S3209: Yes), two is substituted for the brake counter since it is only necessary to move up the developing unit by two developing devices (S3215), and the developing unit motor 61 is turned on to the ascending direction (S3217) to set an ascending direction movement flag FMOVEU (S3219). The lock release solenoid 64 is also turned on to separate the lock member 68 from the lock receiving board 69 (S3233), and then, the state counter SCELVT is increased (S3235).

When the cyan developing device 6C is at the developing position (S3211: Yes), one is substituted for the brake counter since it is only necessary to move up the developing unit by one developing device (S3221), and process of the steps S3217, S3219, S3233, S3235 are executed.

When the black developing device 6K is at the developing position (S3213: Yes), one is substituted for the brake counter since it is only necessary to move down the developing unit by one developing device only (S3227), and the developing unit motor 61 is turned on to the descending direction (S3229) to set a descending direction movement flag FMOVEL (S3231). Thereafter, process of the S3233 and S3235 are executed.

When there is no developing device at the developing position, the developing unit trouble or problem set routine is executed since it is an usual state (S3237) for no developer device to be present.

(iv) Black Developing Device 6K

Steps S3301 through S3337 are process for moving the black developing device 6K to the developing position. When FMOVEK is set as a developing unit movement flag (S3301: Yes), the flag FMOVEK is reset (S3303), and then, judgment is made as to which of the developing devices is positioned at the developing position (S3305, S3309, S3311, S3313). In case when the black developing device 6K is detected at the developing position (S3305: Yes), the developing unit process state counter SCELVT is set at 3 with increment of two since the movement of the device is not necessary (S3307).

When the magenta developing device 6M is at the developing position (S3309: Yes), three is substituted for the brake counter since it is necessary to move up the developing unit by three developing devices (S3315). The developing unit motor 61 is turned on to the ascending direction (S3317) to set an ascending direction movement flag FMOVEU (S3319), and the lock release solenoid 64 is turned on to separate the lock member 68 from the lock receiving board 69 (S3333). Then, the state counter SCELVT is increased (S3335).

When the cyan developing device 6C is at the developing position (S3311: Yes), two is substituted for the brake counter since it is necessary to move up the developing unit by two developing devices (S3321), and the process of the steps of S3317, S3319, S3333, and S3335 are performed.

When the yellow developing device 6Y is at the developing position (S3313: Yes), one is substituted for the brake counter since it is only necessary to move up the developing unit by one developing device (S3327), and process of the steps S3317, S3319, S3333, and S3335 are performed.

When there is no developing device at the developing position, a developing unit trouble or problem set routine is executed (S3337) since it is an unusual state for no developing device to be present. Thus, the process for moving the developing device designated by the movement instruction flag is carried out.

(6) Elevator Motor Brake Process Routine

Figure 50:
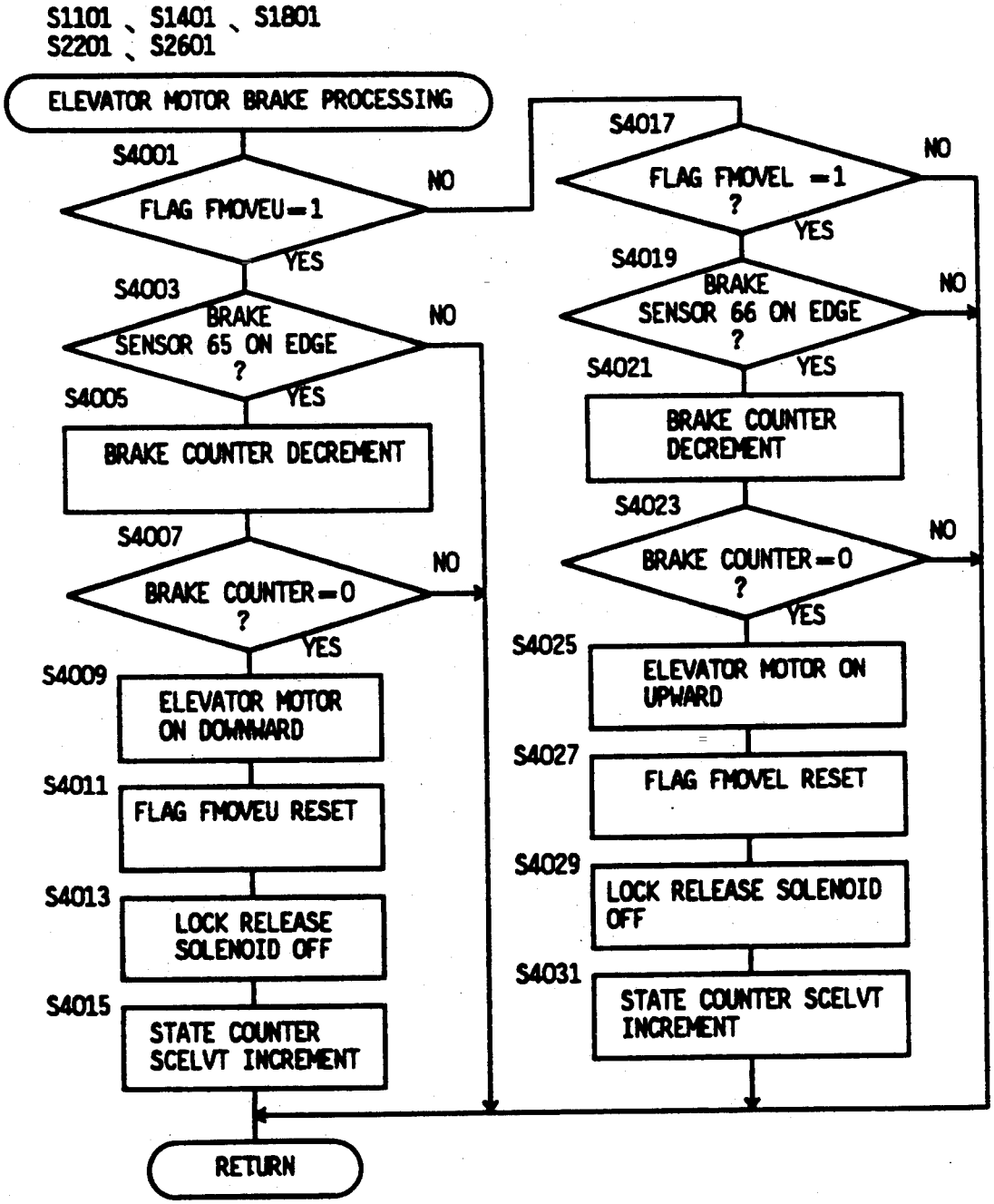
FIG. 50 is a flow chart showing an elevator motor brake processing routine under color mode which is called at S1101, S1401, S1801, S2201, S2601 in the developing unit processing routine (FIGS. 25 through 45).
Figure 51:
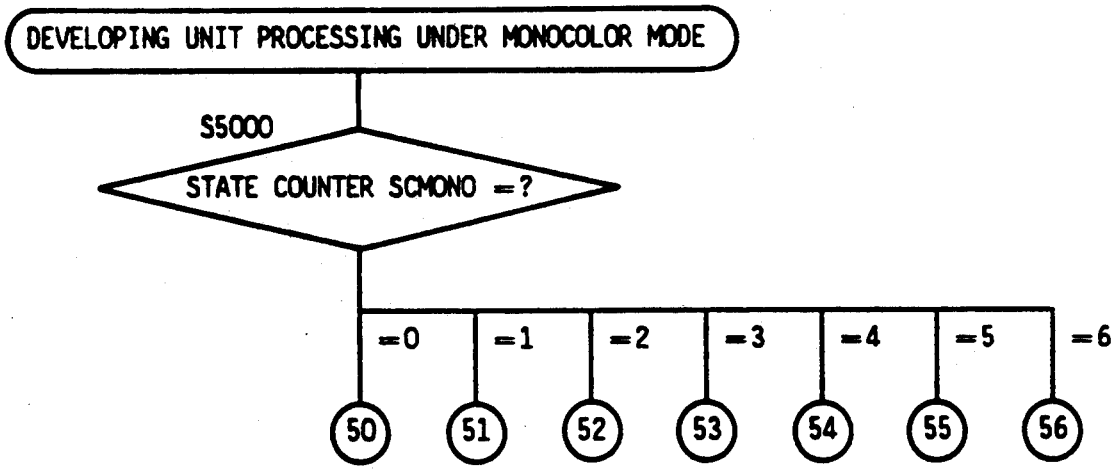
FIGS. 51 through 58 are flow charts showing the processing under monocolor mode in the developing unit processing routine (S53) in the FIG. 18.
Figure 52:
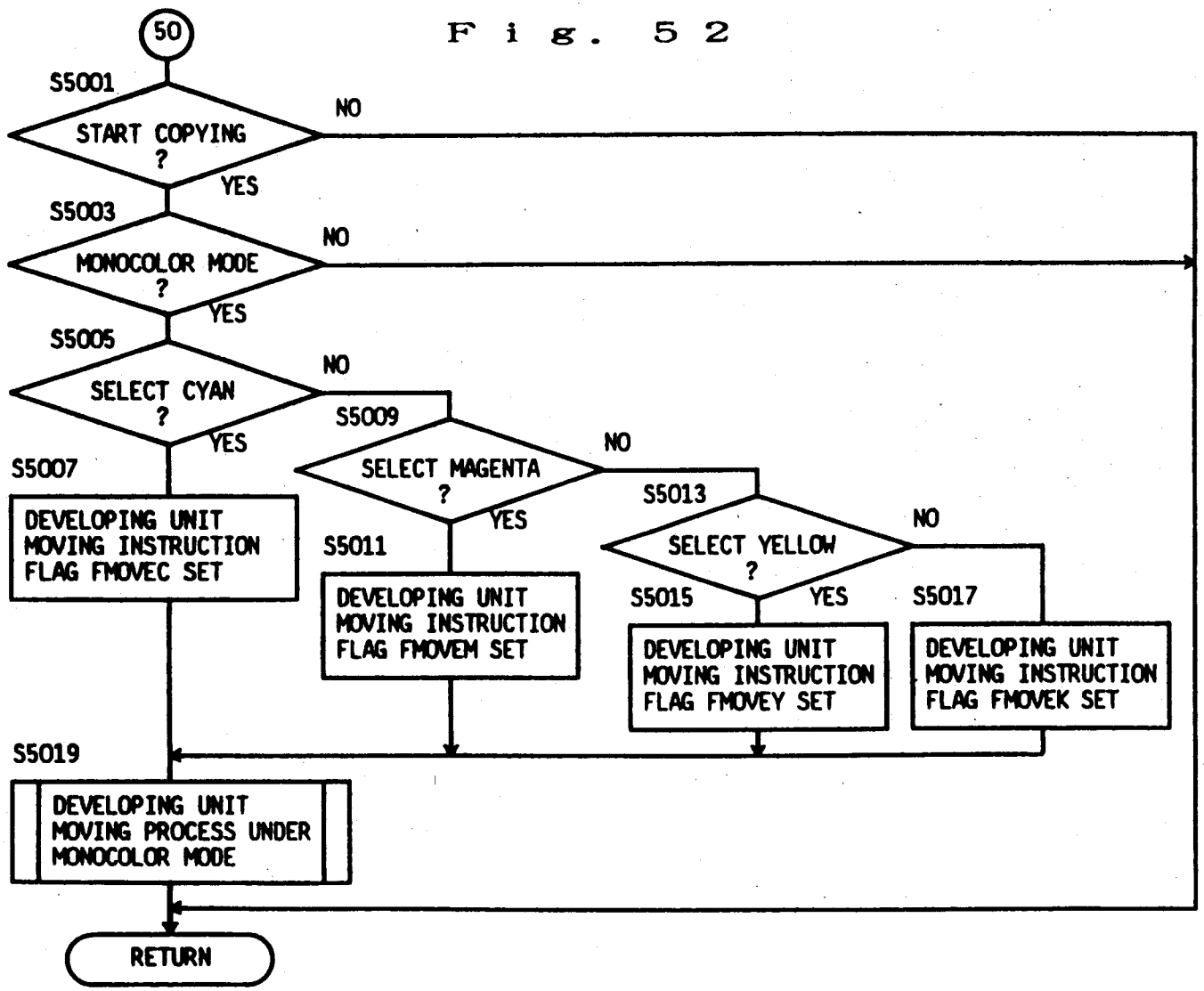
Figure 53:
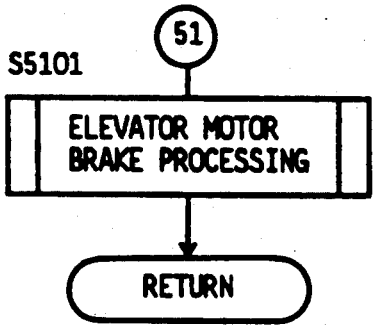
Figure 54:
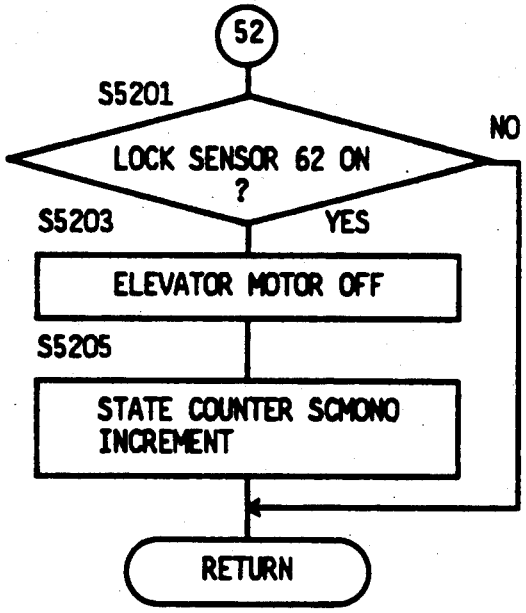
Figure 55:
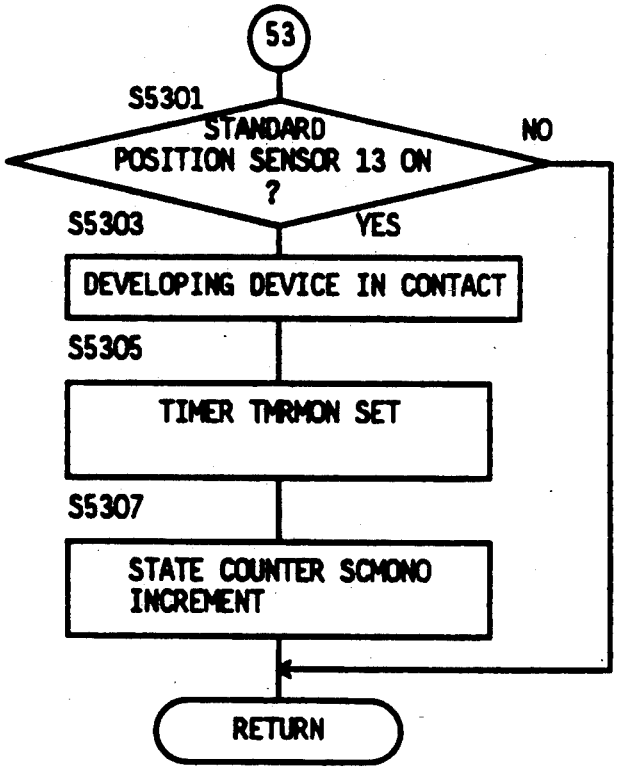
Figure 56:
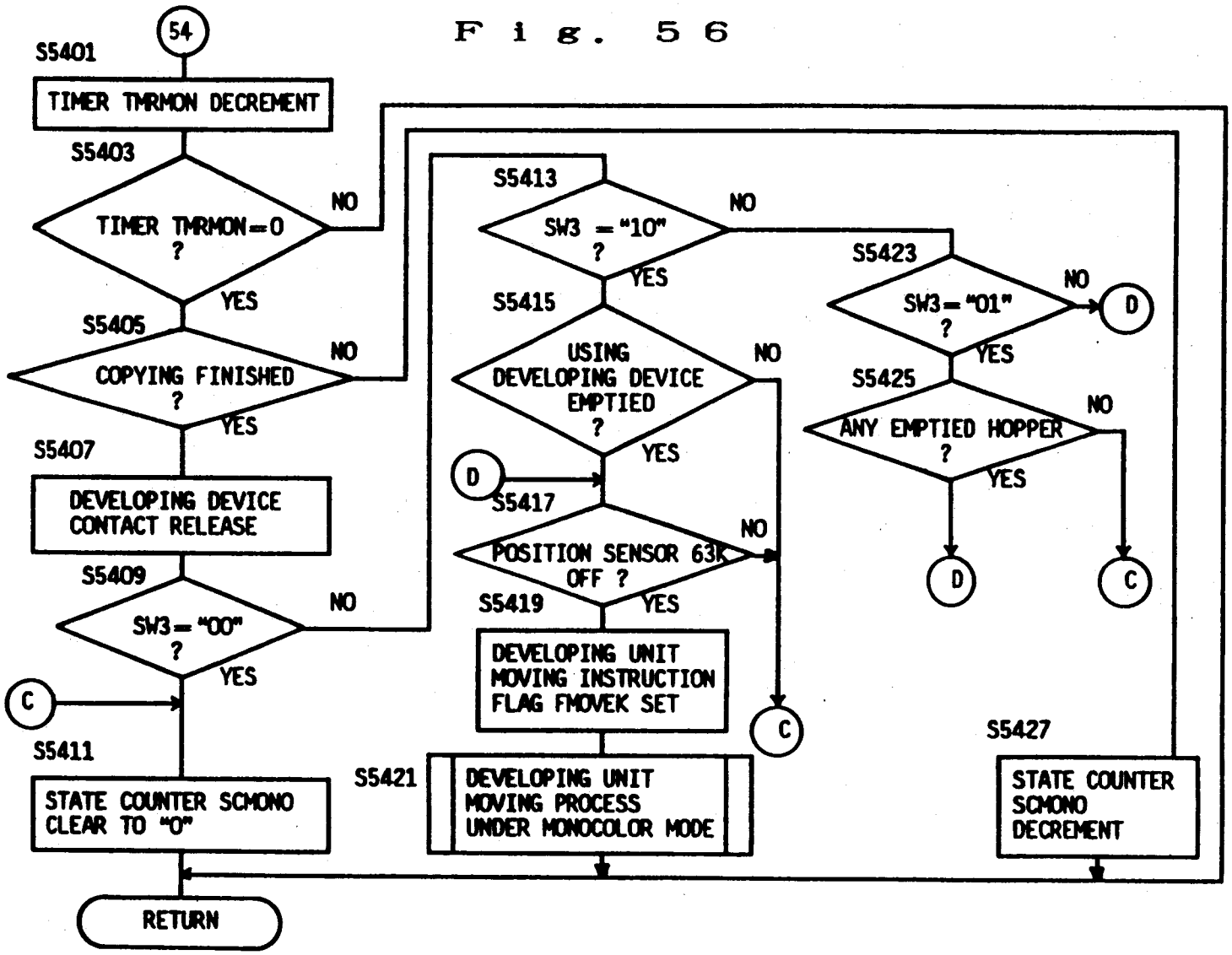
Figure 57:
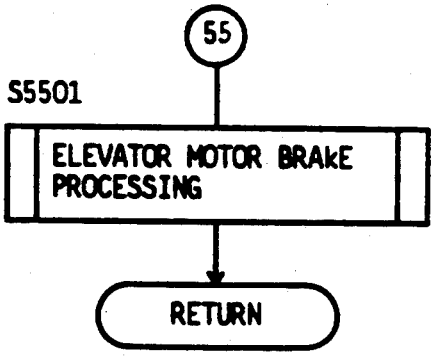
Figure 58:
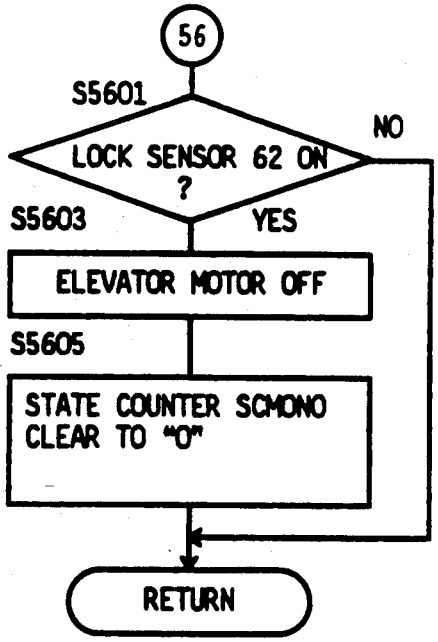
Figure 59:
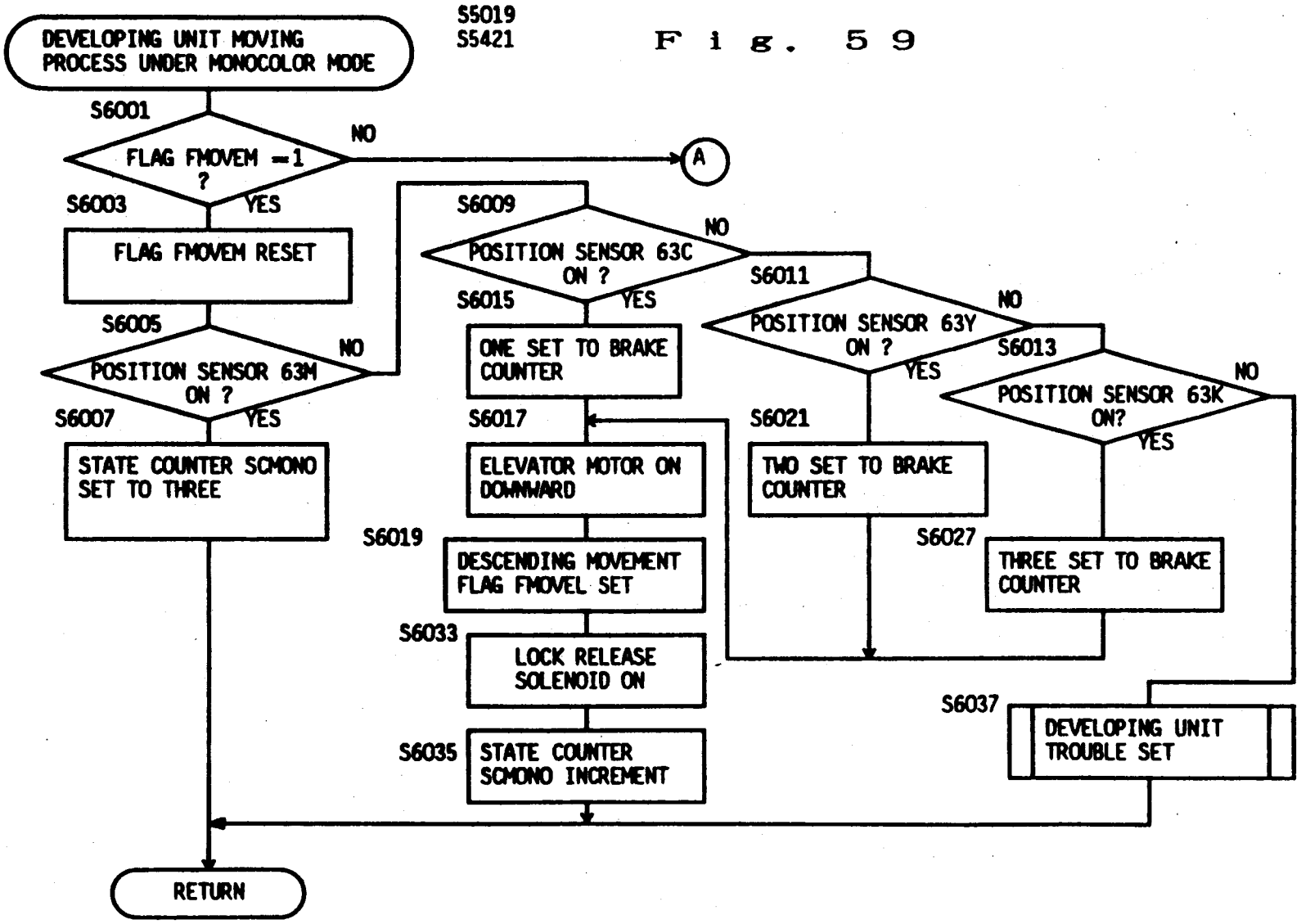
FIGS. 59 through 62 are flow charts showing the developing unit movement processing routine under monocolor mode which is called at S5019, S5421 in the developing unit processing routine under monocolor mode (FIGS. 51 through 58).
Figure 60:
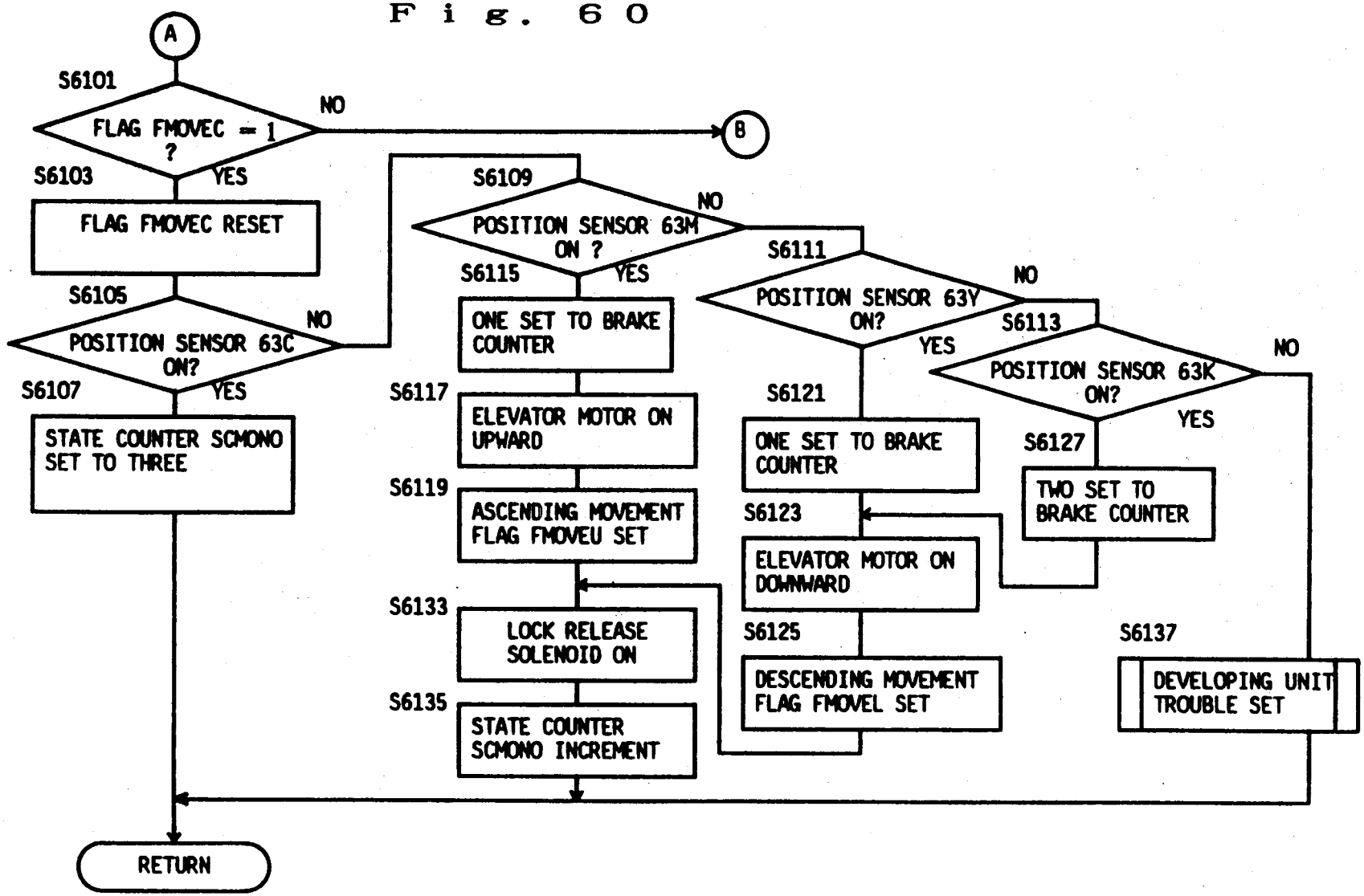
Figure 61:
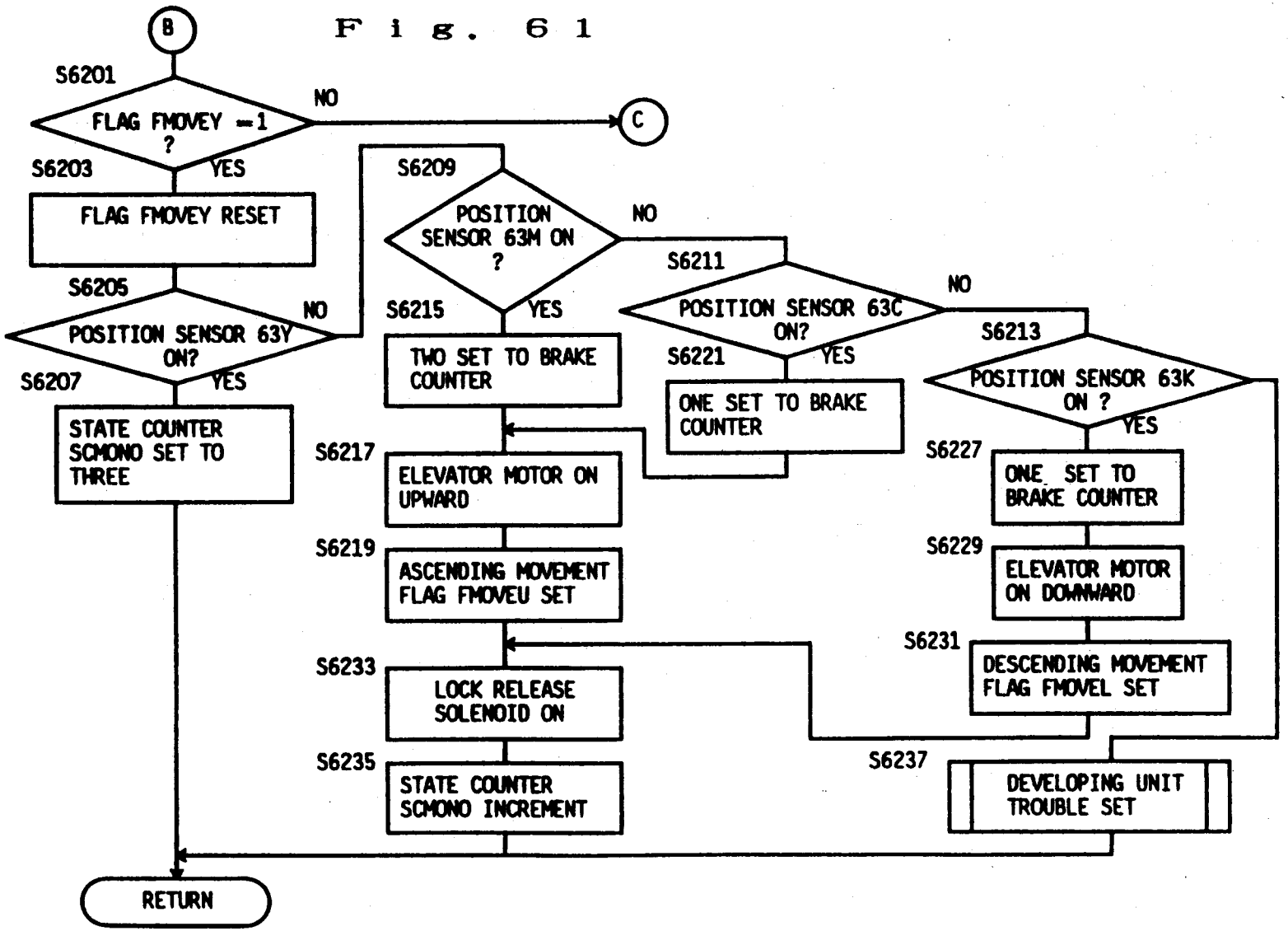
Figure 62:
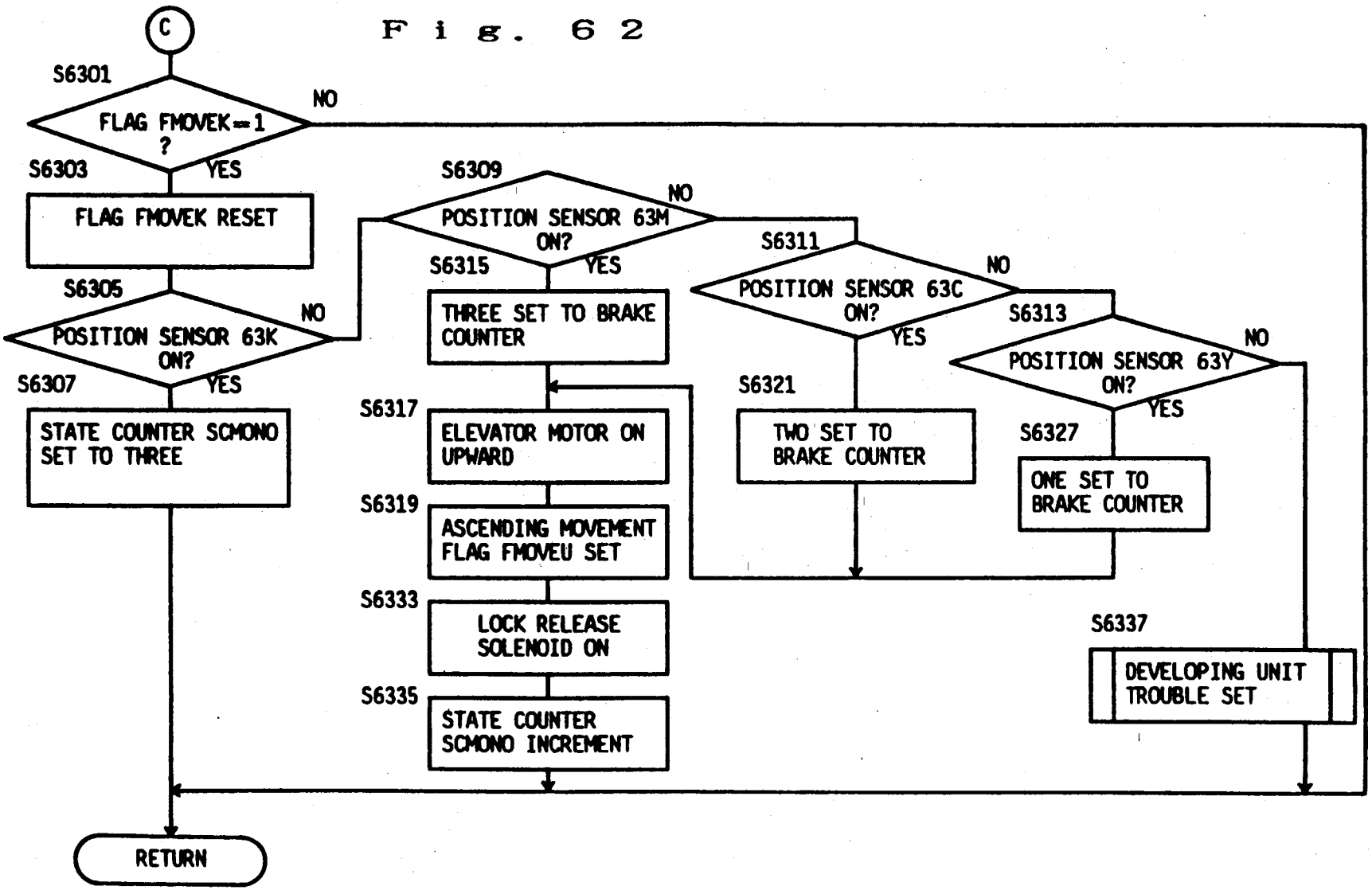

Description will now be made on the elevator motor brake process routine which is in the process of developing unit of FIG. 50.

Firstly, judgment is made as to whether the developing unit is in the ascending action or in the descending action (S4001, S4017).

(i) In case of Ascending Action

When judgment is made that the developing unit is in ascending action (S4001: Yes), the brake counter is decreased (S4005: Yes) at every ON-edge of the ascending movement brake sensor 65 (S4003: Yes). As a result, when the brake counter becomes 0 (S4007: Yes), the developing unit motor 61 is turned on to the descending direction in order to quickly stop the developing unit (S4009). An ascending direction movement flag FMOVEU is reset (S4011), and after the lock release solenoid is turned off (S4013), the state counter SCELVT is increased (S4015).

(ii) In case of Descending Action

When judgment is made that the developing unit is in descending action (S4017: Yes), the brake counter is decreased (S4021) at every ON-edge of the descending brake sensor 66 (S4019: Yes). As a result, when the brake counter became 0 (S4023: Yes), the developing unit motor 61 is turned on to the ascending direction in order to quickly stop the developing unit (S4025). A descending direction movement flag FMOVEL is reset (S4027), and after the lock release solenoid is turned off (S4029), the state counter SCELVT is increased (S4031).

Thus, the process for braking the moving developing unit is performed.

(7) Developing Unit Process under Monocolor Mode

FIGS. 51 through 58 are flowcharts showing developing unit process under monocolor mode which is executed when the monocolor mode is set as a developing mode. This is a process which is conducted at step S53 in the FIG. 18, wherein either the developing unit process routine under full color mode as described above (FIGS. 25 through 45) or the developing unit process routine under the composite monocolor mode (illustration and description are omitted) are alternatively executed in response to the developing mode set. However, for control of returning or not returning the developing unit 6 when there is ON edge on the main switch, the control in the developing unit process routine under color mode is performed.

Firstly, judgement is made on a state counter SCMONO for the developing unit process under monocolor mode, and in compliance with the result, the following processing are performed (S5000).

(a) SCMONO=0

Stand by for the start of copying operation. When the start of copying operation is detected (S5001: Yes), judgment is made as to which of the developing colors is selected as a color to be used for development under monocolor mode (S5005, S5009, S5013). Then, a developing unit movement instruction flag is set in compliance with the developing color selected in order to move a developing device to the developing position corresponding to the color selected (S5007, S5011, S5015, S5017). Thereafter, the developing unit moving process under monocolor mode is performed (S5019).

The developing unit moving process routine under monocolor mode is almost the same process as that of the developing unit moving process routine under color mode (FIGS. 46 through 49). More particularly, this is a process for moving the developing unit 6 to a designated position by a developing unit movement instruction flag, and when the movement to the designated position is set, the value of the state counter SCMONO is decreased. The developing unit moving process routine under monocolor mode is illustrated in the flowcharts in the FIGS. 59 through 62, and description is omitted.

(b) SCMONO=1

Figure 63:
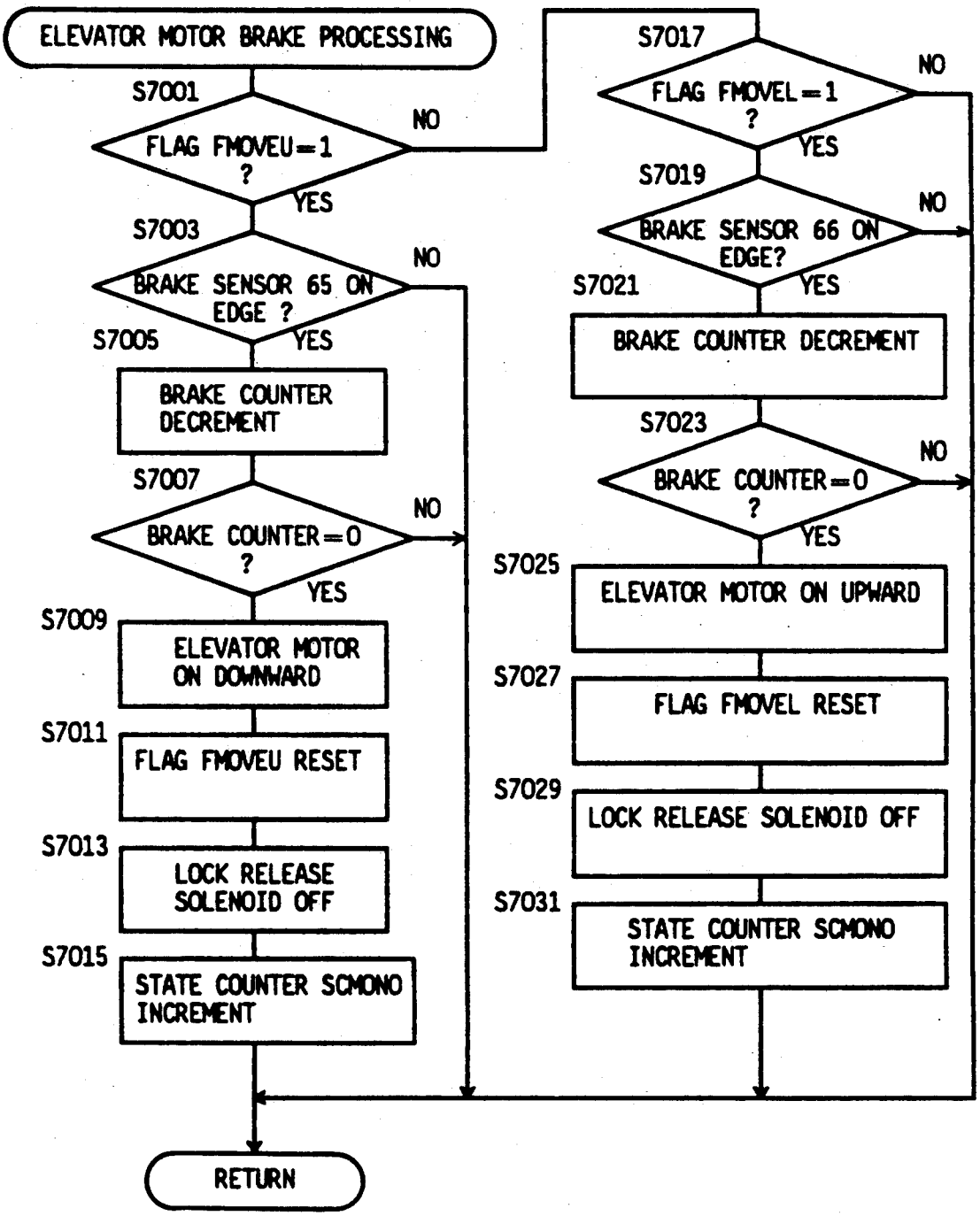
FIG. 63 is a flow chart showing an elevator motor braking process routine under monocolor mode which is called at S5101, S5505 in the developing unit processing routine under monocolor mode (FIGS. 51 through 58).

An elevator motor brake process routine provided for moving the developing unit under monocolor mode is executed (S5101). The elevator motor brake process routine for moving the developing unit in monocolor mode is almost the same as that of the elevator motor brake process routine for a developing unit in color mode (FIG. 50) which is described above. More particularly, this is a process for stopping the movement of the developing unit by braking the unit, and when the braking is set, the value of the state counter SCMONO is increased. The elevator motor brake process routine for moving the developing unit under monocolor mode is illustrated in the flowchart of the FIG. 63 and description is omitted.

(c) SCMONO=2

Stand by for the time until a color selected developing device is positioned at the developing position. When the positioning is set and the developing unit lock sensor 62 is turned on (S5201: Yes), the developing unit motor 61 is turned off (S5203). Further, the state counter SCMONO is increased (S5205) to wait for the developing device to be pressed in contact.

(d) SCMONO=3

Stand by for the time the standard position sensor 13 is turned on (S5301).

At step S5301, when the standard position sensor 13 is turned on (S5301: Yes), the color selected developing device is pressed in contact with the photoconductive drum (S5303). And, at step S5305, a timer counter in developing process TMRMON is set, and further at step S5307, the state counter SCMONO is increased to wait for the completion of developing operation by the developing device.

(e) SCMONO=4

The timer counter in developing process TMRMON is decreased at each round of one routine (S5401). After the time of the timer counter in developing process TMRMON is up with completion of the developing process (S5403: Yes), judgment is made whether all of the copying operation set is completed or not (S5405). When the copying operation is not completed yet (S5405: No), the state counter SCMONO is decreased to prepare for the next round of copying operation (S5427), and the program returns to the step 5301 to wait for the time the standard position sensor 13 is turned on.

On the other hand, when the judgment is made that all of the copying operation is completed at step S5405 (S5405: Yes), the contact of the developing device with the photoconductive drum 4 is released (S5407), and judgment is made on the state of the dip switch SW3 (S5409, S5413, S5423). As a result, (i) in the case of 00 (S5409: Yes), the state counter SCMONO is cleared to 0 since returning action to the home position is not performed (S5411) to wait for the start of copying operation.

(ii) in the case of 10 (S5413: Yes), judgment is made whether the hoppers of the used developing devices are empty or not (S5415). As a result, when there is no hopper emptied among the devices used (S5415: No), the program proceeds to step S5411 since toner replenishment is not necessary, and the state counter SCMONO is cleared to 0 to wait for the start of copying operation.

On the other hand, when judgment is made at step S5415 that there is a developing device in the empty state (S5415: Yes), the program proceeds to step S5417 and judgment is made whether the developing unit 6 is positioned at the home position or not. As a result, when the developing unit 6 is at the home position (S5417: No), the program moves to step S5411 since the movement of the developing unit 6 is not necessary, and the state counter SCMONO is cleared to 0 to wait for the start of copying operation.

On the other hand, at the step S5417, when the developing unit 6 is not at the home position (S5417: Yes), the developing unit movement instruction flag FMOVEK is set in order to move the developing unit 6 to the home position (S5419), and the developing unit moving process under monocolor is performed (S5421).

(iii) in the case of 01 (S5423: Yes),

Judgment is first made whether there is any hopper in the empty state or not regardless of use or non-use (S5425).

As a result, when there is not any hopper in the empty state (S5425: No), the program moves to step S5411 since toner replenishment is not necessary, and the state counter SCMONO is reset at 0 to wait for the start of copying operation.

On the other hand, at the step S5425, when judgment is made that there is one or more hoppers in the empty state (S5425: Yes), the program moves to steps S5417 and further, and the moving process to the home position is conducted on the condition that the unit is not at the home position as described above (S5417 through S5421) and the value of the state counter SCMONO is decreased.

(iv) in the case of 11 (S5423: No), returning action to the home position is conducted irrespective of the state of the toner. More particularly, the program proceeds to steps S5417 and further, and the moving process to the home position is conducted on the condition that the developing unit is not at the home position yet as described above (S5417 through S5421) and the value of the state counter SCMONO is increased.

(f) SCMONO=5

An elevator motor brake processing routine for moving developing unit under monocolor mode is executed (S5501), and the value of the state counter SCMONO is increased.

(g) SCMONO=6

Stand by for the time until the developing unit 6 returns to the home position. When the developing unit 6 is returned to the home position and the developing unit lock sensor 62 is turned on (S5601: Yes), the developing unit motor 61 is turned off. Further, the state counter SCMONO is reset at 0 (S5605), and stand by for the start of copying operation. The developing unit processing under monocolor mode is thus performed and the control for selection of returning or non-returning action of the developing unit 6 is conducted at the time when all the copying operation is finished in compliance with the state the dip switch SW3 is set.

The control of the apparatus in the present embodiment is conducted in the manner as described above. In the copying machine for use in the present invention, judgment is made on the state the dip switch SW3 is set when the main switch is turned on and when the copying operation is finished as described above. Consequently, for instance, when there is any hopper which is emptied, the developing unit is returned to the home position in order to readily perform toner replenishing operation (in the case of SW3=01).

Or, in accordance with the state of monocolor mode or color mode, when the color to be used is emptied, the developing unit is returned to the home position in order to perform toner replenishing operation (in the case of SW3=10). When the color to be used is empty during the composite monocolor mode, the same process is performed. In other words, the returning or non-returning action can be most suitably set by use of the dip switch SW3 in compliance with users' requirement. In the present embodiment, the actions of returning or non-returning and the like are arranged to be set by combination of turning on and off of the dip switch SW3, however, communication may be made by inputting a mode in the form of mode selection from the operation panel and the like. In this case, the method for setting a mode can be made easily, and a setting by complicated mode (condition) can also be readily made since it is made in the form dialogue by use of message display. It may also be arranged to utilize a recording medium from outside such as IC card and the like.

The developing device and the photoconductive drum are controlled to be pressed in contact with each other with a timing before the original image is exposed, and therefore, the image on the photoconductive drum is protected from being disarranged by the shock or vibration when they are pressed in contact with each other.

The original image scanning operation is prohibited until the developing device is positioned at the developing position, and therefore, errors for producing defective image and the like can also be prevented.

Further, when some trouble or problem has happened during the moving operation of the developing unit, it is arranged to turn off power source after any one of the developing devices is positioned at the developing position. It may, therefore, be able to move the developing unit without any problem even if the copying machine is used after being reset.

Figure 64:
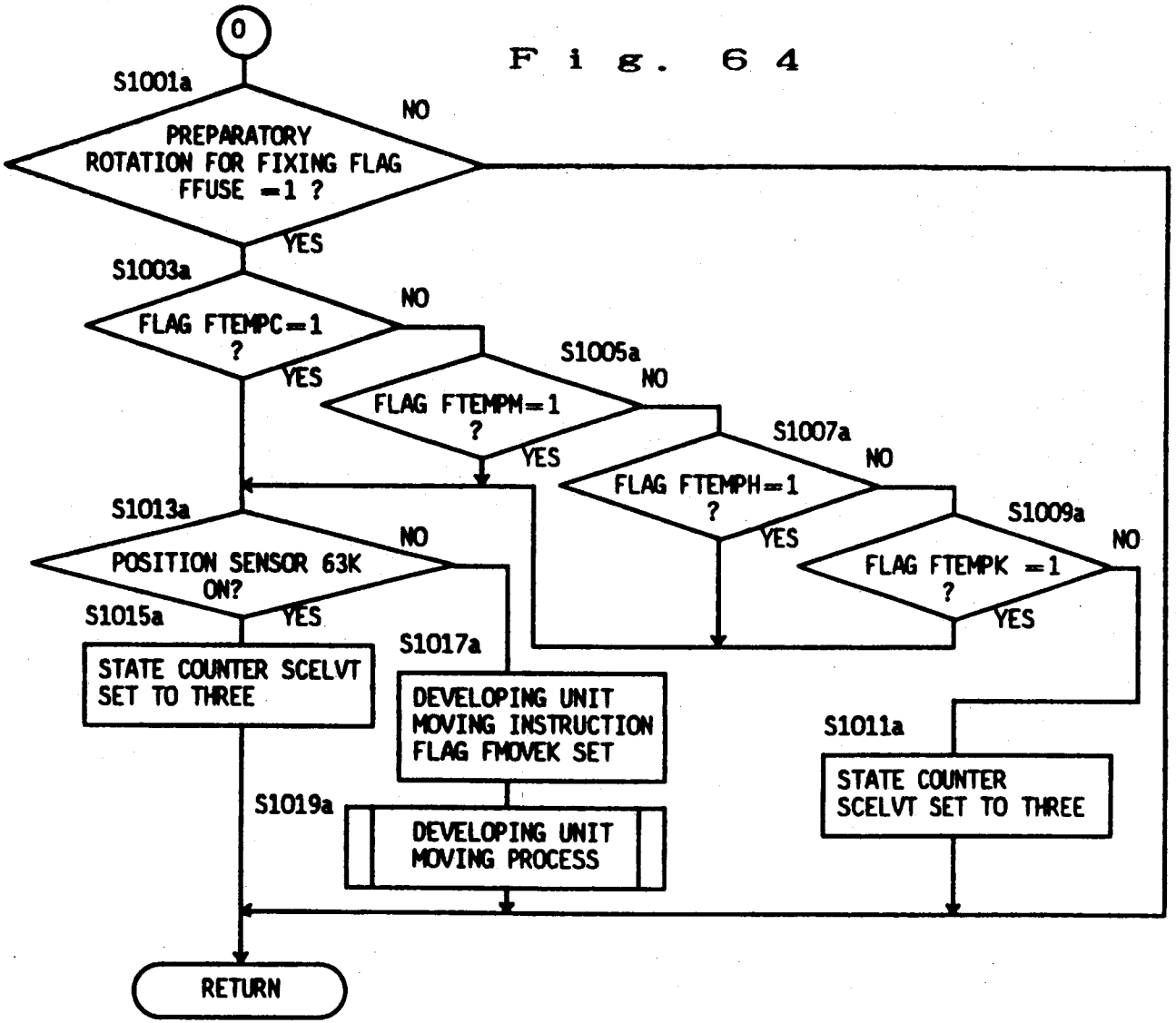
FIG. 64 is a flow chart showing a part of developing unit processing routine under color mode as a second embodiment of the present invention.

Description will now be made on a second embodiment of the present invention illustrated in the FIG. 64.

The present embodiment is arranged for performing a returning action of a developing device to a toner replenishing position whenever it is necessary at a predetermined timing when preparatory rotation for a fixing operation is conducted by use of a main motor, and a process which is performed when a developing unit process state counter SCELVT in a developing unit processing routine is "0" is different from the case of the first embodiment.

Description will now be made only on this point.

Firstly, stand by for the time a preparatory rotation for fixing flag FFUSE is set (S1001*a*). When the preparatory rotation for fixing flag is set (S1010*a*: Yes, refer to S707 in the FIG. 23), judgment is made on each toner empty flag (S1003*a*, S1005*a*, S1007*a*, S1009*a*). As a result, when any one of the toner empty flag is not set (S1009*a*: No), three is set to a state counter SCELVT (S1011*a*) to wait for the start of copying operation. More particularly, the movement to the home position (the uppermost position where the black developing device is positioned at the developing position) is not performed since toner replenishing operation is not necessary.

On the other hand, when any one of the toner empty flags is set (S1003*a*: Yes, or S1005*a*: Yes, or S1007*a*: Yes, or S1009*a*: Yes), the program proceeds to step S1013*a* and judgment is made whether or not the black developing device 6K is at the developing position, in other words, whether the device is positioned at the home position or not (S1013*a*). As a result, when the device is positioned at the home position already (S1013*a*: Yes), the state counter SCELVT is set at three since the movement of the developing unit 6 is not necessary (S1015*a*) and to wait for the start of copying operation.

On the other hand, at the step S1013*a*, when the developing unit 6 is not positioned at the home position (S1013*a*: No), a developing unit movement instruction flag FMOVEK is set (S1017*a*) and a developing unit moving process routine is executed (S1019*a*). The developing unit moving process routine is a process for moving the developing unit 6 to the position instructed by the developing unit movement instruction flag, which is the same process as described in the first embodiment of the present invention, and when the movement to the instructed position is set, the value of the state counter SCELVT is increased.

At the step S1013*a*, when the developing unit is not positioned at the home position, it means that, for instance, the last round of copying operation has been performed not using black toner (cyan, or magenta or yellow toner is used separately or the case of developing mode wherein colors are used in combination), or the developing unit is stopped at a position other than the home position due to some trouble a problem which happened during the moving operation of the developing unit or the like.

In short, the developing unit is returned to the toner replenishing position only when toner is empty in the present embodiment. Accordingly, there is no waste of energy in comparison with a case wherein the unit is forcibly returned when an image forming process is started or when it is finished. Besides, any specific input operation is not necessary for returning the unit to the home position for toner replenishment. Moreover, an image forming unit is used for making a preparatory rotation of fixing rollers for a warm-up operation, and when driving source of the unit driving means and the driving source for the preparatory rotation are used in common, the consumption of energy is decreased more since the replenishing control signal is transmitted at the timing of starting the preparatory rotation. As another timing for emitting the replenishing control signal, it may be arranged to emit the signal when the main switch of the image forming unit is turned on or when the image forming operation is finished.

As another embodiment, it may further be arranged to decide whether to move the developing unit or not by the condition set by the first embodiment, and to move the unit with the timing set by the second embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:
a developing unit which is provided with a plurality of developing devices and movable relative to a photoconductor;
a means for setting a predetermined operational condition;
a driving means for moving the developing unit to a supply position;
a detecting means for detecting a shortage of developer in the developing device and outputting a shortage signal; and
a control means for controlling operation of the driving means corresponding to a condition set when the shortage signal is output.

2. The image forming apparatus as defined in claim 1, wherein the predetermined operational condition to be set is the one which is selected from the following:
a color mode for forming an image by using all of the developing devices;
a monocolor mode for forming an image by using one of the developing devices.

3. The image forming apparatus as defined in claim 1, wherein the predetermined operational condition to be set is the one which is selected from the following:
a mode for forming an image with a plurality of colors;
a mode for forming an image with a single color.

4. The image forming apparatus as defined in claim 1, wherein the predetermined operational condition to be set is selected from the following:
the driving means being operated when the shortage signal is output;
the driving means being inoperative even if the shortage signal is output.

5. The image forming apparatus as defined in claim 1, wherein the predetermined operational condition to be set is selected from the following:
the driving means being operated when the shortage signal is output;
driving action being operative when the shortage signal is output and a developing device corresponding to the shortage signal is being used;
the driving means being inoperative even if the shortage is output.

6. The image forming apparatus as defined in claim 1, wherein the developing unit is vertically movable relative to the photoconductor.

7. The image forming apparatus as defined in claim 6, wherein the developing unit is provided with a toner replenishing hopper at its uppermost portion and the uppermost moving position is made as a toner replenishing position.

8. The image forming apparatus as defined in claim 1, further comprising a sensor for detecting the position of each developing device, wherein the control means controls the movement of the developing unit based on location of each developing device provided by a position sensor.

9. In an image forming apparatus comprising a developing unit which is provided with a plurality of developing devices and movable relative to a photoconductor, a driving means for moving the developing unit to a supply position, a detecting means for detecting a shortage of developer in the developing device and outputting the shortage signal and a control means for controlling operation of the driving means, toner supply operation control methods of the developing unit include the following steps of:
inputting a predetermined operational condition manually to the control means,
controlling operation of the driving means in accordance with operational condition inputted by the control means when the shortage signal is output.

10. The image forming apparatus as defined in claim 9, wherein input is performed by keys provided on an operation panel of the image forming apparatus.

11. The image forming apparatus as defined in claim 9, wherein input is performed by switches provided separately from the operation panel of the image forming apparatus.

12. An image forming apparatus, comprising:
a developing unit which is provided with a plurality of developing devices and movable relative to a photoconductor;
a driving means for moving the developing unit to a supply position;
a detecting means for detecting a shortage of developer in the developing device and outputting the shortage signal;
a means for selectively setting a first mode for operating the driving means or a second mode for not operating the driving means when the shortage signal is output; and
a control means for actuating the driving means when the shortage signal is transmitted on the condition that the second mode is set.

13. The image forming apparatus as defined in claim 12, further comprising a means for setting a predetermined operational condition wherein the control means controls operation of the driving means in accordance with an operational condition set when the driving means is activated.

14. The image forming apparatus as defined in claim 13, wherein the predetermined operational condition is the one which is selected from the following:
a color mode for forming an image by using all of the developing devices;
a monocolor mode for forming an image by using one of the developing devices.

15. The image forming apparatus as defined in claim 13, wherein the predetermined operational condition is the one which is selected from the following:
a mode for forming an image with a plurality of colors;
a mode for forming an image with a single color.

16. The image forming apparatus as defined in claim 13, wherein the predetermined operational condition is selected from the following:
the driving means being operated when the shortage signal is output;
the driving means being inoperative even if the shortage signal is output.

17. The image forming apparatus as defined in claim 13, wherein the predetermined operational condition is selected from the following:
the driving means being operated when the shortage signal is output;
driving action being operative when the shortage signal is output and a developing device corresponding to the shortage signal is being used;
the driving means being inoperative even if the shortage signal is output.

18. The image forming apparatus as defined in claim 13, wherein the developing unit is vertically movable relative to the photoconductor.

19. The image forming apparatus as defined in claim 18, wherein the developing unit is provided with a toner supply hopper at its uppermost portion and the uppermost moving position is made as a toner supply position.

20. The image forming apparatus as defined in claim 13, further comprising a sensor for detecting the position of each developing device, wherein the control means controls the movement of the developing unit which is provided with a driving means basing on a positional information of each developing device by the sensor.

21. An image forming apparatus, comprising:

a developing unit which is provided with a plurality of developing devices and movable relative to a photoconductor;

a means for specifying one of the developing modes in a plurality of developing modes that are set corresponding to the number of developing devices used in one round of image forming operation;

a driving means for moving the developing unit to a supply position;

a detecting means for detecting a shortage of developer in the developing device and outputting the shortage signal;

a means for selectively setting an operational mode for operating the driving means or a non-operational mode for not operating the driving means corresponding to said developing modes when the shortage signal is output; and a control means for actuating the driving means when the shortage signal is transmitted on the condition that an operational mode is set.

22. The image forming apparatus as defined in claim 21, wherein the control means controls operation of the driving means corresponding to a developing mode set when the driving means is actuated.

23. The image forming apparatus as defined in claim 21, wherein the developing unit is moved in the upward and downward direction and moves relative to the photoconductor.

24. The image forming apparatus as defined in claim 23, wherein the developing unit is provided with a toner supply hopper at its uppermost portion and the uppermost moving position is made as a toner supply position.

25. The image forming apparatus as defined in claim 21, further comprising a sensor for detecting a position of each developing device, wherein the control means controls the movement of the developing unit which is provided with a driving means basing on a positional information of each developing device by the sensor.

26. An image forming apparatus, comprising:

a developing unit which is provided with a plurality of developing devices;

a means for moving the developing unit to a supply position for supplying developer to a developing device;

a detecting means for detecting a shortage of developer in each developing device and outputting a shortage signal corresponding to each developing device respectively;

a means for specifying either a color mode wherein an image is formed by using all of the developing devices or a monocolor mode in which an image is formed by using one of the developing devices; and a means for controlling the operation of the moving means in accordance with a mode specified by the specifying means when the shortage signal is output.

27. The image forming apparatus as defined in claim 26, wherein the developing unit is moved in the upward and downward direction and moves relative to the photoconductor.

28. The image forming apparatus as defined in claim 27, wherein the developing unit is provided with a toner supply hopper at its uppermost portion and the uppermost moving position is made as a toner supply position.

29. The image forming apparatus as defined in claim 26, further comprising a sensor for detecting the position of each developing device, wherein the control means controls the movement of the developing unit which is provided with a driving means basing on a positional information of each developing device by the sensor.

30. An image forming apparatus, comprising:

a developing unit which is provided with a plurality of developing devices;

a means for moving the developing unit to a supply position for supplying developer to a developing device;

a detecting means for detecting a shortage of developer in each developing device and outputting a shortage signal corresponding to each developing device respectively;

a means for specifying either a color mode wherein an image is formed by using all of the developing devices or a monocolor mode in which an image is formed by using one of the developing devices, and under the monocolor mode, a developing device to be used is also specified; and a control means for controlling operation of the moving means wherein when the color mode is specified, the moving means is operated by output of at least one shortage signal, and when the monocolor mode is specified, the moving means is operated only when the shortage signal is output corresponding to the developing device to be used.

31. The image forming apparatus as defined in claim 30, wherein the developing unit is moved in the upward and downward direction and moves relatively to the photoconductor.

32. The image forming apparatus as defined in claim 31, wherein the developing unit is provided with a toner supply hopper at its uppermost portion and the uppermost moving position is made as a toner supply position.

33. The image forming apparatus as defined in claim 30, further comprising a sensor for detecting the position of each developing device, wherein the control means controls the movement of the developing unit which is provided with a driving means basing on a positional information of each developing device by the sensor.

34. An image forming apparatus, comprising:

a developing unit which is provided with a plurality of developing devices and movable relative to a photoconductor;

a driving means for moving the developing unit to a supply position;

a detecting means for detecting a shortage of developer in the developing device and outputting the shortage signal; and a control means for controlling the driving means so as to operate with a predetermined timing when the shortage signal is output.

35. The image forming apparatus as defined in claim 34, wherein the predetermined timing is the time when a fixing roller starts its warming up rotation.

36. The image forming apparatus as defined in claim 35, wherein the driving means in the image forming apparatus is used in common for the warming up rotating operation.

37. The image forming apparatus as defined in claim 34, wherein the predetermined timing is the time when a main switch in the image forming apparatus is turned on.

38. The image forming apparatus as defined in claim 34, wherein the predetermined timing means the time when an image forming operation is finished.

39. The image forming apparatus as defined in claim 34, wherein the developing unit is moved in the upward and downward direction and moves relative to the photoconductor.

40. The image forming apparatus as defined in claim 39, wherein the developing unit is provided with a toner supply hopper at its uppermost portion and the uppermost moving position is made as a toner supply position.

41. The image forming apparatus as defined in claim 34, further comprising a sensor for detecting the position of each developing device, wherein the control means controls the movement of the developing unit which is provided with a driving means basing on a positional information of each developing device by the sensor.

42. An image forming apparatus, comprising:

a plurality of movable developing devices;

a means for stopping a selected developing device at a predetermined position;

a signal output means for outputting a signal to interrupt power to the image forming apparatus; and a control means for interrupting power after a developing means is stopped at a predetermined position when the interrupt power signal is output.

43. The image forming apparatus as defined in claim 42, wherein electricity is turned off to the power source of the image forming apparatus.

44. The image forming apparatus as defined in claim 42, wherein the predetermined position is a position where developing operation can be performed.

45. The image forming apparatus as defined in claim 42, wherein the stopping means includes a lock mechanism for mechanically locking a developing device at a predetermined position.

46. The image forming apparatus as defined in claim 42, further comprising a lock means for locking a developing device at a predetermined position when the device has reached the position.

47. An image forming apparatus, comprising:

a plurality of movable developing devices;

a means for stopping a selected developing device at a predetermined position;

a detecting means for detecting malfunction of the image forming apparatus; and a control means to interrupt power after a developing device is stopped at the predetermined position when malfunction is detected.

48. The image forming apparatus as defined in claim 47, wherein electricity is turned off to the power source of the image forming apparatus.

49. The image forming apparatus as defined in claim 47, wherein the predetermined position is a position where developing operation can be performed.

50. The image forming apparatus as defined in claim 47, wherein the stopping means includes a lock mechanism for mechanically locking a developing device at a predetermined position.

51. The image forming apparatus as defined in claim 47, further comprising a lock means for locking a developing device at a predetermined position when the device has reached the position.

52. An image forming apparatus, comprising:

a plurality of movable developing devices;

a means for stopping a selected developing device at a predetermined position;

a detecting means for detecting malfunction of the image forming apparatus;

a signal outputting means for outputting a signal to interrupt power to the image forming apparatus corresponding to a detection of malfunction; and a means for delaying output of the interrupt power signal until a developing device is stopped at the predetermined position when malfunction is detected.

53. The image forming apparatus as defined in claim 52, wherein electricity is turned off against the power source of the image forming apparatus.

54. The image forming apparatus as defined in claim 52, wherein the predetermined position is a position where developing operation can be performed.

55. The image forming apparatus as defined in claim 52, wherein the stopping means includes a lock mechanism for mechanically locking a developing device at a predetermined position.

56. The image forming apparatus as defined in claim 52, further comprising a lock means for locking a developing device at a predetermined position when the device has reached the position.

* * * * *